US006494346B2

(12) United States Patent
Gross et al.

(10) Patent No.: US 6,494,346 B2
(45) Date of Patent: Dec. 17, 2002

(54) INVERTED PACKAGE DISPENSING SYSTEM

(75) Inventors: Richard A. Gross, Oconomowoc, WI (US); Daniel G. Schantz, Muskego, WI (US); Alan P. Hickok, Bloombury, NJ (US); Timothy R. Socier, Essexville, MI (US)

(73) Assignee: Seaquist Closures Foreign, Inc., Crystal Lake, IL (US)

( * ) Notice: Subject to any disclaimer, the term of this patent is extended or adjusted under 35 U.S.C. 154(b) by 0 days.

(21) Appl. No.: 09/769,572

(22) Filed: Jan. 25, 2001

(65) Prior Publication Data

US 2002/0096540 A1 Jul. 25, 2002

(51) Int. Cl.[7] ..... B67D 5/06

(52) U.S. Cl. ..... 222/185.1; 222/212; 222/481.5; 222/494

(58) Field of Search ..... 222/185.1, 212, 222/481.5, 494

(56) References Cited

U.S. PATENT DOCUMENTS 4,516,697 A * 5/1985 Dreps et al. ..... 222/212
4,930,668 A * 6/1990 Krall ..... 222/212
5,033,655 A 7/1991 Brown
5,060,830 A * 10/1991 Krall ..... 222/212
5,133,482 A * 7/1992 Burrows et al. ..... 222/185.1
5,626,262 A * 5/1997 Fitten et al. ..... 222/185.1
5,655,687 A 8/1997 Fitten et al.
5,819,984 A 10/1998 Krueger
5,868,288 A * 2/1999 Redmond, Sr. et al. .. 222/185.1

OTHER PUBLICATIONS

U.S. patent application Ser. No. 09/432,677, filed Nov. 2, 1999.

* cited by examiner

*Primary Examiner*—Joseph A. Kaufman
(74) *Attorney, Agent, or Firm*—Wood, Phillips, Katz, Clark & Mortimer

(57) ABSTRACT

A dispensing system is provided to dispense a fluent product from a container that has an opening to the container interior. A support base is provided for supporting the container with the container opening oriented at least somewhat downwardly to accommodate gravity flow of the fluent material out of the container through the container opening. The support base has (1) a receiving aperture for receiving the container opening, (2) a discharge aperture, and (3) a flow path extending between the receiving aperture and the discharge aperture.

24 Claims, 40 Drawing Sheets

INVERTED PACKAGE DISPENSING SYSTEM

CROSS REFERENCE TO RELATED APPLICATION(S)

Not applicable.

STATEMENT REGARDING FEDERALLY SPONSORED RESEARCH OR DEVELOPMENT

Not applicable.

REFERENCE TO A MICROFICHE APPENDIX

Not Applicable

TECHNICAL FIELD

The present invention relates to a system for dispensing a product from a container. This system is designed to permit the container to be supported in an inverted orientation to accommodate gravity flow of the product in and from the container. The system accommodates precise dispensing control of the product. The system is especially suitable for use with a flexible container which is squeezable.

BACKGROUND OF THE INVENTION AND TECHNICAL PROBLEMS POSED BY THE PRIOR ART

There are a wide variety of packages which include a (1) a container, (2) a dispensing discharge structure extending as a unitary part of, or as an attachment to, the container, and (3) a fluent product contained within the container. Such packages are typically employed for general household or home products, including personal care products such as skin care lotions, liquid soaps, and the like.

Some such packages employ finger-actuated pumps which are especially useful with highly viscous fluids because such pumps can be operated to dispense the product on demand in contrast with a non-pump package wherein the user must wait for the viscous product to flow under the force of gravity when a container is tipped over for dispensing.

There are other types of packages that do not employ a finger-actuatable pump, and which are normally maintained in an inverted orientation with a dispensing structure at the bottom of the package so that the viscous product is generally present at the bottom dispensing structure and available for immediate dispensing. See, for example, U.S. Pat. Nos. 5,033,655, 5,655,687 and 5,819,984 which disclose packages that employ a single dispensing valve for discharging a single stream of a fluent product (which maybe a liquid, cream, or particulate product). The package includes a flexible, resilient, slit-type valve at one end of a generally flexible bottle or container. The valve is normally closed and can withstand the weight of the product when the container is completely inverted, so that the product will not flow through the valve unless the container is squeezed.

Bottom dispensing packages and finger-actuatable pump packages do have some drawbacks. For example, a finger-actuatable pump package typically requires that the product be drawn up from the bottom of the container through a downwardly extending dip tube. Some product may remain in the bottom of the container and cannot be completely drawn out of the container through the dip tube. Also, some finger-actuatable pumps tend to drip or "drool" after each dispensing actuation because it is difficult for such pumps to cleanly and sharply cut off the product flow.

Further, if one wants to pack a finger-actuatable pump package for traveling, one must provide for the possibility that the pump could be inadvertently depressed during travel, and that could result in an unwanted discharge of product. Some finger-actuatable pump packages permit the pump to be pushed downwardly into the container and locked in that position to prevent further actuation during travel. However, pushing the pump to the fully actuated, locked-down position typically results in the dispensing of an unwanted amount of product.

Finger-actuatable pump packages have other disadvantages. They are relatively expensive owing to the number of small parts, typically including metal springs and metal ball check valves. Further, in order to refill a finger-actuatable pump package, the pump must be first removed from the container. This can be relatively messy because product typically clings to the pump and dip tube, and some product may tend to drip from the pump and dip tube when the pump is removed to permit refilling of the container.

Dispensing closures on inverted, "squeeze"-type packages also have some disadvantages. Typically, the inverted dispensing package closure must be relatively large and have a flat surface on which the package sits in order for the package to remain upright and not be easily tipped over. Because the dispensing opening is located within the base profile of such an inverted dispensing package, it is typically difficult to control the quantity of the dispensing flow and the direction of the flow owing to the fact that the discharge opening is not readily visible to the user during such use. Also, during dispensing of fluent product from such a large profile closure, the fluent product can more easily drip on portions of the closure. Further, with an inverted dispensing package, the package must be turned upright to be manually opened and closed for each use unless a dispensing valve is provided.

It would be desirable to provide an improved dispensing package or system in which fluent product could be always immediately available for dispensing until the container is substantially completely emptied. It would be preferable to provide such an improved package with a design that does not require the use of a relatively expensive and complicated finger-actuatable pump.

It would also be beneficial if such an improved dispensing system could operate to dispense fluent product with little or no mess or dribble.

It would also be desirable to provide an improved dispensing system that could readily accommodate refilling of the container with fluent product or that could readily accommodate removal of an empty container and replacement with a full container.

Such an improved dispensing system should also preferably have the capability for facilitating dispensing of the fluent product when the interior of the container is pressurized (e.g., when the container is squeezed or when the container's internal pressure is increased by other means).

It would also be advantageous if such an improved system could accommodate bottles, containers, or other packaging components having a variety of shapes and that are constructed from a variety of materials.

Further, it would be desirable if such an improved system could accommodate efficient, high-quality, large-volume manufacturing techniques with a reduced product reject rate to produce a system with consistent operating characteristics.

It would also be advantageous if such an improved dispensing system could (1) accommodate two or more constituent fluent materials which could be separately stored prior to use, and (2) subsequently permit the dispensing of the constituent materials together as a combined product. It would also be desirable to provide means for sealing such system to prevent inadvertent discharge of the constituents during manufacturing, shipping, handling, etc. Such a system should be readily operable by the user and not interfere with combining the constituent materials when it is desired to dispense the constituent materials together as a combined product.

The present invention provides an improved system which can accommodate designs having the above-discussed benefits and features.

BRIEF SUMMARY OF THE INVENTION

The present invention provides a system for dispensing a product. The system can accommodate the discharge of fluent materials such as liquids, creams, or particulate matter, including powders.

The dispensing system of the present invention is especially suitable for dispensing relatively viscous material in a manner that provides the viscous material at a discharge aperture for substantially immediate discharge. The user is not required to operate a finger-actuatable pump or to wait for gravity flow of the material to a discharge aperture.

The dispensing system of the present invention allows for substantially precise dispensing control and allows the user to readily observe the discharge of the product at the target area. There is substantially little or no mess or dribble after the desired amount of product has been discharged.

One form of the dispensing system of the present invention readily accommodates refill of the product container or complete replacement of an empty product container with a new, full product container.

According to one embodiment of the invention, the container employed with the dispensing system of the present invention can be readily re-sealed for travel.

The system of the present invention can also be optionally designed to advantageously store a plurality of constituent materials as separate quantities which are not combined during storage. During use, only the amounts of constituent materials that are to be dispensed are combined during the dispensing process.

According to one aspect of the dispensing system of the present invention, the dispensing system is in the form of a support base for supporting a container. The container has an opening to the container interior and is adapted to hold a fluent product. The container need not necessarily be regarded as a part of the dispensing system support base per se. However, according to another aspect of the invention, the container may be regarded as a part of a combination dispensing system.

The support base is adapted to support the container while the container opening is oriented at least somewhat downwardly to accommodate gravity flow of the fluent product out of the container through the container opening. The support base has (1) a receiving aperture for receiving the container opening, (2) a discharge aperture, and (3) a flow path extending between the receiving aperture and the discharge aperture.

In a preferred form of the system, there is a shut-off valve which is located in the flow path between the receiving aperture and the discharge aperture. The valve is manually actuatable between (i) a closed orientation occluding fluent flow through the flow path, and (ii) an open orientation permitting fluent flow through the flow path.

In a preferred form of the invention, at least part of the flow path extends through an elongate spout which accommodates discharge of the fluent product at a target area that is readily accessible and visible to the user.

Further, in a preferred embodiment, the container is a squeezable container which permits the user to squeeze the container to discharge a desired amount of product from the discharge aperture.

In a preferred embodiment, the container is provided with an initial seal, which can be a pressure-openable valve, such as a resiliently flexible, refill valve. Such a valve or other seal initially holds the product in the container. The use of a refill valve or seal permits the container to be refilled. If a refill valve is employed, then a travel seal, such as a rigid closure, is preferably provided over the valve on the container until the container is mounted in the support base.

In a preferred embodiment, the support base includes a discharge spout with a resiliently flexible dispensing valve which opens in response to a differential between the pressure acting against the side of the closed valve facing inwardly and the pressure acting against the side of the closed valve facing outwardly.

In a preferred embodiment, the support base also includes a vent for accommodating the in-venting of air from the ambient atmosphere to the interior of the container so as to accommodate flow of product out of the container. Preferably, such a vent system includes a resiliently flexible vent valve which opens inwardly toward the container in response to a differential between pressure acting against the side of the closed valve facing toward the container interior and the pressure acting against the side of the closed valve facing away from the container interior.

Numerous other advantages and features of the present invention will become readily apparent from the following detailed description of the invention, from the claims, and from the accompanying drawings.

BRIEF DESCRIPTION OF THE DRAWINGS

In the accompanying drawings that form part of the specification, and in which like numerals are employed to designate like parts throughout the same.

FIG. 78 shows the inlet vent valve;

DESCRIPTION OF THE PREFERRED EMBODIMENTS

While this invention is susceptible of embodiment in many different forms, this specification and the accompanying drawings disclose only some specific forms as examples of the invention. The invention is not intended to be limited to the embodiments so described, however. The scope of the invention is pointed out in the appended claims.

The first embodiment of the dispensing system of the present invention is illustrated in FIGS. 1–37. According to one aspect of the invention, the dispensing system comprises a support base 102 (FIG. 14) for receiving and supporting a container 104 which contains a fluent product. It is contemplated that, according to the broad aspect of the invention, the container 104 per se is not part of the inventive dispensing system per se which is adapted for use with a suitable container. That is, one aspect of the invention includes only the support base 102 per se. However, according to a further aspect of the invention, the container 104 and support base 102 together may be characterized as a combination dispensing system invention.

Figure 1:
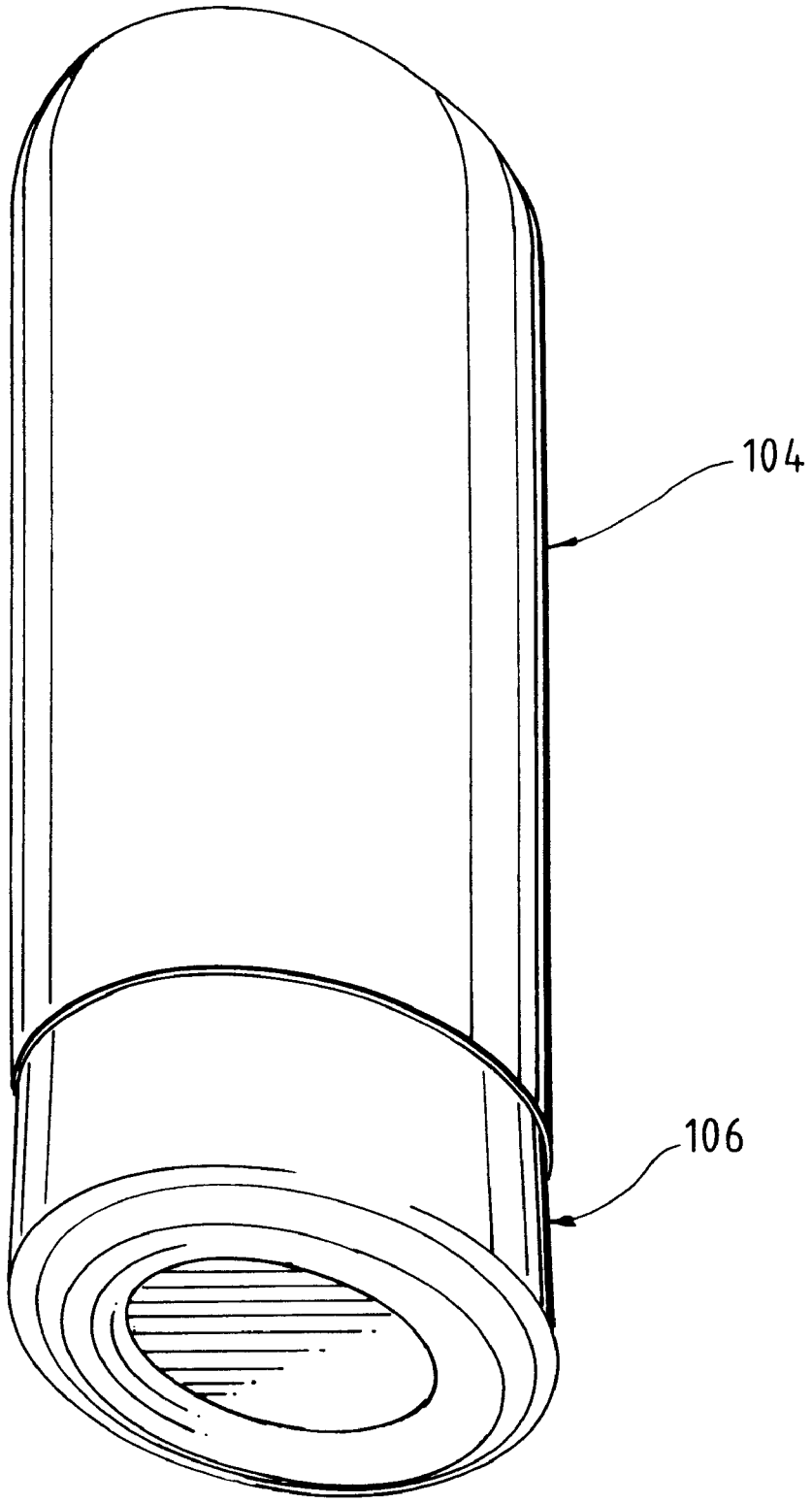
FIG. 1 is a perspective view of an inverted container and first embodiment of a closure or overcap which can be used with, or as part of, the dispensing system of the present invention.
Figure 2:
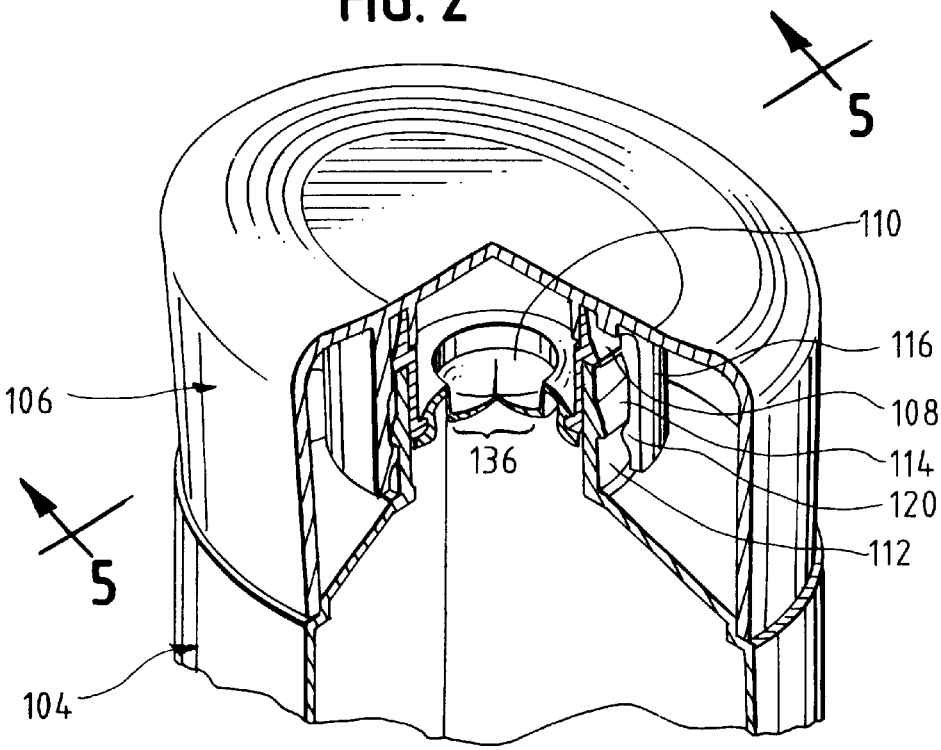
FIG. 2 is a fragmentary, perspective view of the discharge end of the dispensing container and closure or overcap shown in FIG. 1.
Figure 3:
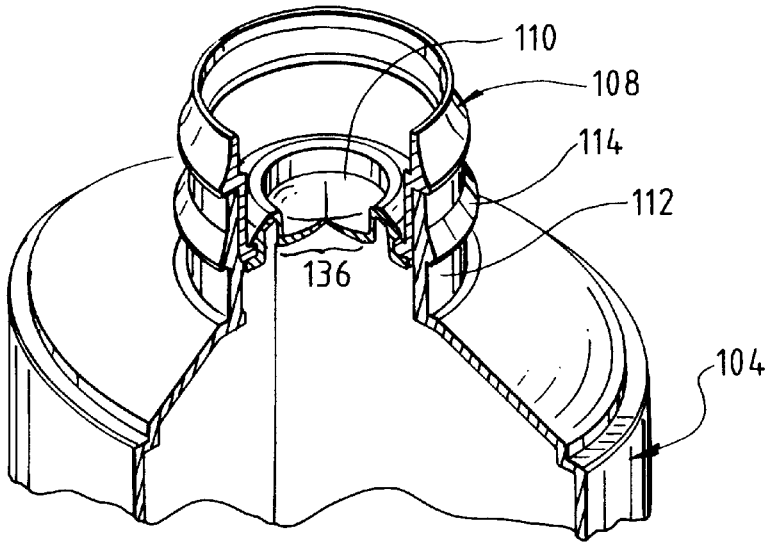
FIG. 3 is a fragmentary, perspective view of the discharge end of the a container shown in FIG. 2, with the overcap removed.
Figure 4:
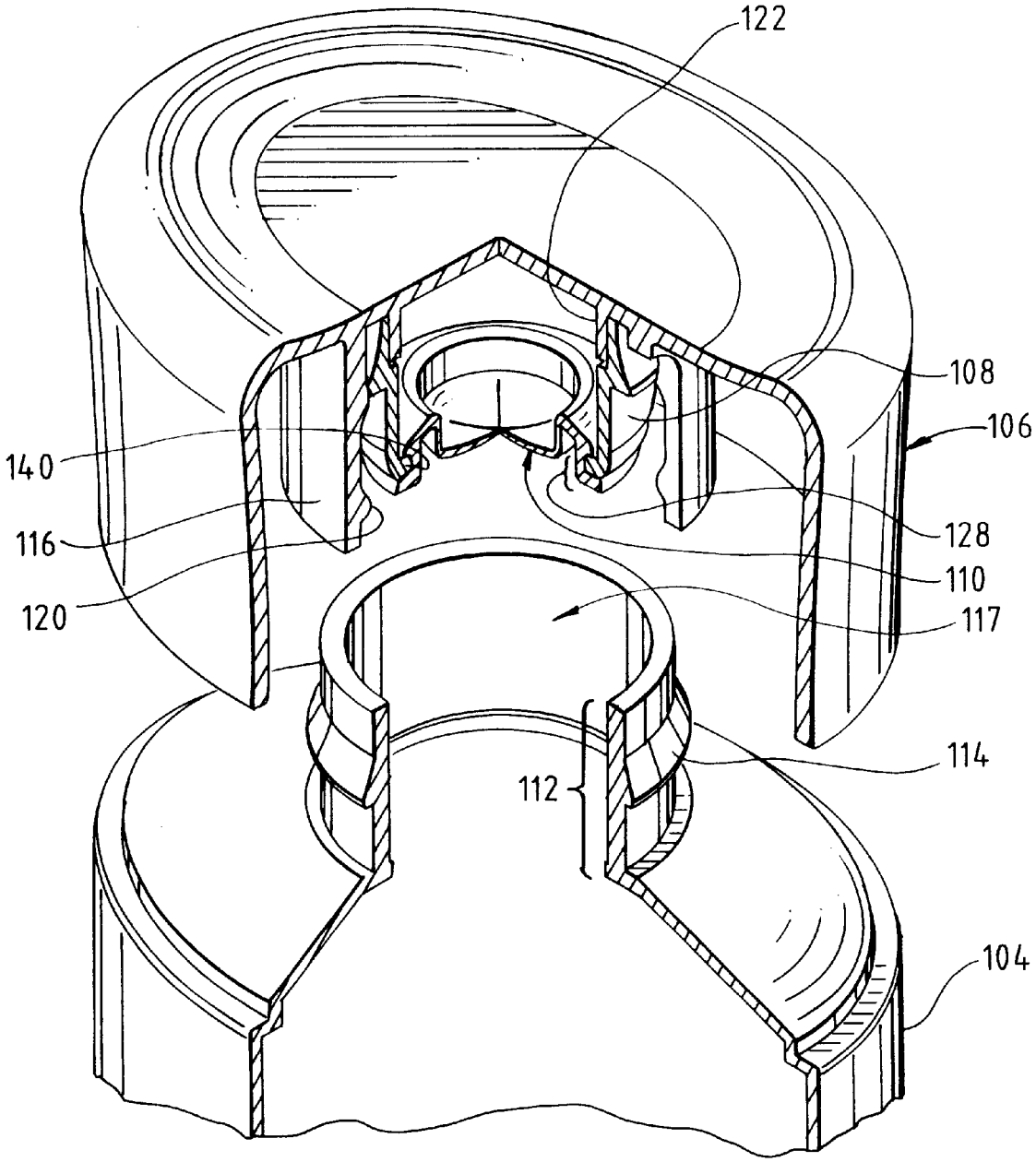
FIG. 4 is an exploded, fragmentary, perspective view of the container and overcap shown in FIG. 4.

With reference to FIGS. 1, 2, and 4, the container 104 is preferably provided initially as part of a package that includes the container 104 filled with a fluent product and that includes an overcap 106 (FIG. 1). The package also preferably includes an internal transition fitment 108 (FIGS. 2 and 4) and at least one refill valve 110 (FIGS. 2 and 4) which are initially mounted together in the overcap 106 that is in turn mounted on the container 104.

The container 104 may have a reduced diameter neck 112 as shown in FIG. 4, and the neck 112 preferably includes an annular snap bead 114 on the exterior surface of the neck 112. The neck 112 defines an opening 117 (FIG. 4) to the container interior. The container 104 need not have a reduced diameter neck 112 as illustrated in FIG. 4. In some applications, it may be desirable that the neck of the container defining the opening 117 have a size and shape substantially corresponding to the size and shape, respectively, of the main body of the container 104. Alternatively, in some applications it may be desirable that the neck of the container have a size and shape that is larger than, and different from, respectively, the size and shape of the body of the container 104.

The container 104 can be a squeezable container having a flexible wall or walls which can be grasped by the user and squeezed or compressed to increase the internal pressure within the container 104 so as to force the fluent product out of the container when the container 104 is inverted to orient the opening 17 at least somewhat downwardly to accommodate gravity flow of the fluent product to and through the opening 117.

The container wall typically has sufficient, inherent resiliency so that when the squeezing forces are removed, the container wall returns to its normal, unstressed shape. Such a squeezable wall structure is preferred in many applications but may not be necessary or preferred in other applications. For example, in some applications it may be desirable to employ a generally rigid container and to instead pressurize the container interior at selected times with a piston, with a bellows type pressurizer (not illustrated), or with some other pressurizing system (not illustrated).

Figure 5:
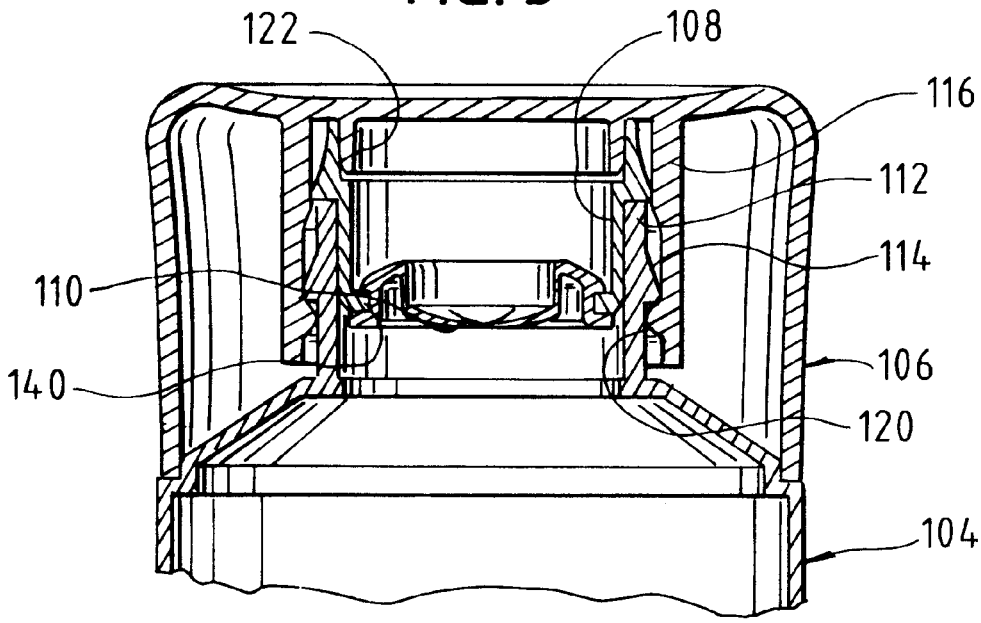
FIG. 5 is a fragmentary, cross-sectional view taken generally along plane 5—5 in FIG. 2.

The overcap 106 includes an inner, annular mounting wall 116 (FIG. 7) with two slots 118 to provide some flexibility. The inner mounting wall 116 includes an annular bead 120 (FIG. 7) for snap-fit engagement with the bead 114 on the exterior of the container neck as shown in FIGS. 2 and 5.

Figure 7:
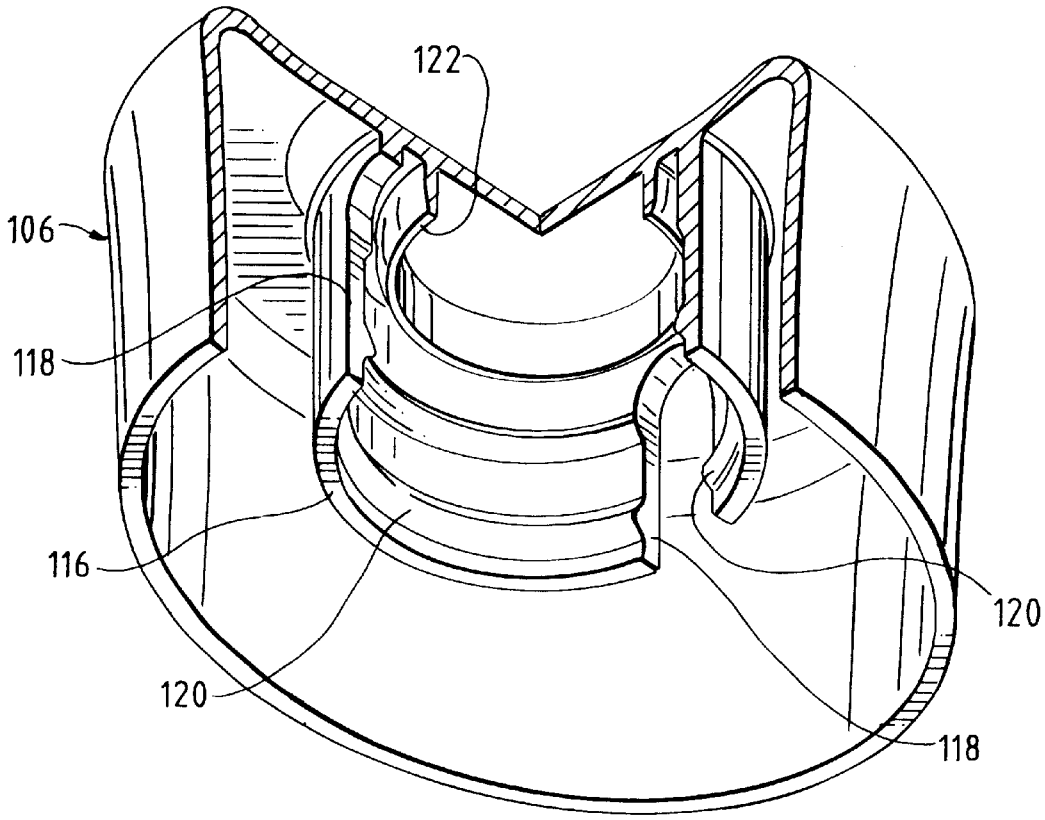
FIG. 7 is a partial, cross-sectional perspective view of the overcap without the transition fitment and refill valve installed.
Figure 8:
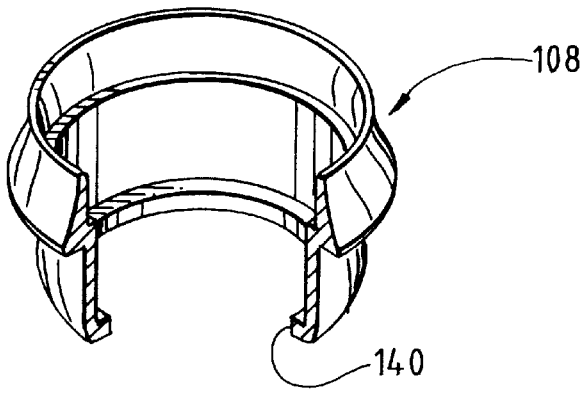
FIG. 8 is a partial, cross-sectional, perspective view of the transition fitment which is adapted to be received in the overcap as shown in FIG. 4.
Figure 9:
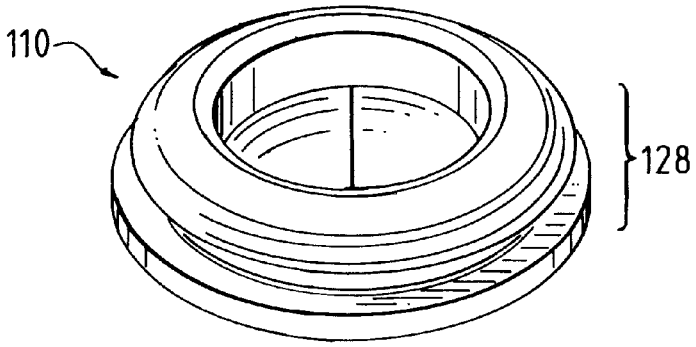
FIG. 9 is a perspective view of the exterior side of the refill valve which is adapted to be received in the transition fitment and in the overcap as shown in FIG. 4.

As shown in FIG. 7, the overcap 106 includes an annular mounting ring 122 within the annular wall 116. The annular mounting ring 122 is adapted to receive an open end of the transition fitment 108 as shown in FIGS. 4 and 5. The open end of the transition fitment 108 has an interior diameter which is slightly less than the maximum exterior diameter of the overcap mounting ring 122. When the transition fitment 108 is pushed onto the mounting ring 122, the transition fitment 108 will be stressed somewhat,and expand slightly circumferentially to effect a friction fit with the overcap mounting ring 122. As an be seen in FIG. 5, the inside surface of the overcap annular wall 116 may also frictionally engage the exterior of the transition fitment 108.

Prior to forcing the transition fitment 108. into the overcap 106, the refill valve 10 is mounted to the transition fitment 108. The valve 110 is separately illustrated in FIGS. 9–11. The valve 110 is preferably a pressure-openable, resiliently flexible valve which includes a margin al portion 128 defining a mounting groove 130. The transition fitment 108 includes a mounting flange 140 which is adapted to be received within the annular groove 130 of the marginal portion 128 of the valve 110 as illustrated in FIG. 4.

Figure 10:
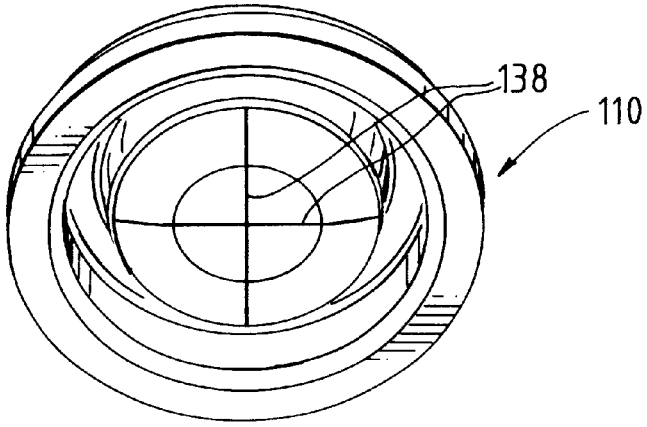
FIG. 10 is a perspective view of the interior side of the refill valve.
Figure 11:
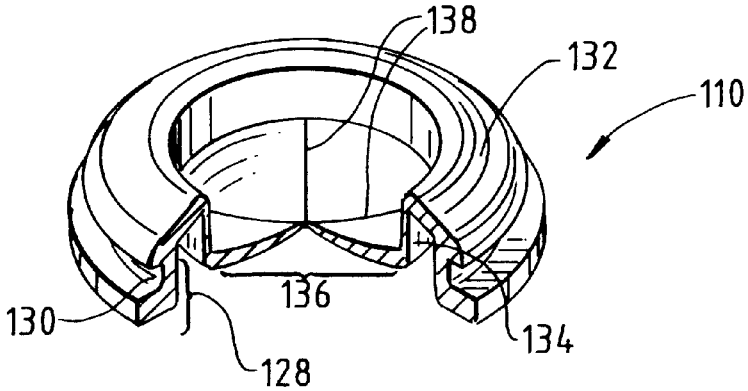
FIG. 11 is a view similar to FIG. 9, but, FIG. 11 shows the refill valve with a portion illustrated in cross section.

The marginal portion 128 includes a slanted portion 132 (FIG. 11) from which a sleeve 134 extends inwardly to a valve head or head portion 136. As shown in FIGS. 10 and 11, the valve head portion 136 preferably includes two, mutually perpendicular, intersecting, dispensing slits 138 of equal length which together define a closed dispensing orifice. The intersecting slits 138 define four, generally sector-shaped flaps or petals in the central head portion 136 which has a generally concave configuration (when viewed from the exterior of the package after the valve 110, transition fitment 108, and overcap 106 have been assembled together on the container 104 as shown in FIG. 2). The flaps open outwardly from the intersection point of the slits 138, in response to increasing container pressure of sufficient magnitude.

The refill valve 110 has substantially the same structure as the prior art valve 80 disclosed in the allowed U.S. patent application Ser. No. 09/432,135, now U.S. Pat. No. 6,186,374, the disclosure of which is incorporated by reference thereto to the extent pertinent and not inconsistent herewith. The slits 138 of the refill valve 110 are preferably somewhat longer than the slits 84 of the prior art valve 80. Specifically, the slits 138 extend radially outwardly to the bottom of the annular sleeve 134 (FIG. 11) compared to the prior art valve slits 84 which terminate somewhat short of the prior art valve sleeve 86 (FIG. 7 of the U.S. Pat. No. 6,186,374).

Preferably, the thicknesses of various portions of the valve 110 are designed so that when the flaps open beyond a certain amount, the flaps remain open and do not close. Preferably, the valve 110 is molded from a thermosetting elastomeric material, such as silicone rubber, natural rubber, and the like. The valve 110 could also be molded from a thermoplastic elastomer. Preferably, the valve 110 is molded from silicone rubber, such as the silicone rubber sold by The Dow Chemical Company in the United States of America under the trade designation DC 595. The valve could be molded with the slits 138. Alternatively, the valve slits 138 could be subsequently cut into the central head portion 136 of the valve 110 by suitable conventional techniques.

When the user wishes to install the package on the support base 102 (FIG. 14), the user must first remove the overcap 106 (FIG. 2). The user pulls the overcap 106 outwardly, by grasping the exterior vertical surfaces of the overcap 106, to pull the overcap 106 away from the container 104.

Figure 6:
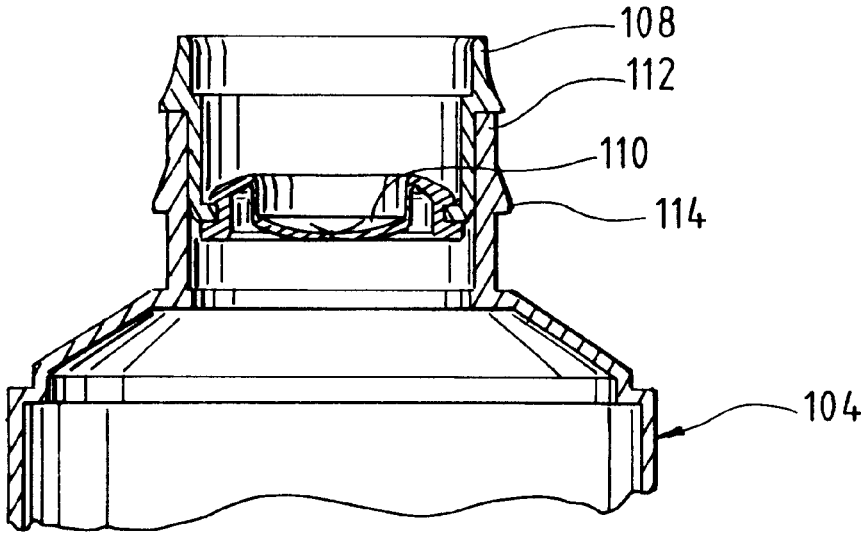
FIG. 6 is a view similar to FIG. 5, but FIG. 6 shows the container with the transition fitment and refill valve in place after removal of the overcap.

It will be appreciated that when the assembly of the overcap components is initially installed on the container neck as illustrated in FIG. 5, a portion of the transition fitment 108 is slidably received within the interior of the container neck 112. The engagement between the container neck 112 and the transition fitment 108 is a relatively tight or strong frictional engagement. This engagement is much stronger than the frictional engagement between the transition fitment 108 and the overcap mounting ring 122 and the overcap mounting wall 116. Thus, when the user pulls the overcap 106 outwardly away from the container 104 with sufficient force, the overcap 106 readily disengages from the fitment 108, and the fitment 108 remains tightly engaged with the inside of the container neck 112. FIG. 6 shows the container 104 after the overcap 106 has been removed whereby the transition fitment 108 and valve 110 remain in the container neck 112.

Preferably, the valve 110 is designed so that it is strong enough, in the closed orientation (as illustrated in FIG. 6), to withstand the weight or static head of the fluent material in the container 104 if the container 104 is tipped upside down. This allows the user to conveniently position the full container 104 in an inverted orientation in the support base 102 as described in detail hereinafter.

However, when the overcap 106 is initially in place on the container 104 (FIG. 5), the entire package is better able to withstand transient loadings which might cause fluent material to leak from the valve. For example, during shipping, handling, or storage, the container 104 could be subjected to significant impacts which might increase the interior pressure within the container 104 sufficiently to open the valve 110 and lead to an inadvertent discharge of some fluent material. Thus, it is preferred that the overcap 106 be employed during shipping and handling of the container by the manufacturer, as well as during subsequent handling by the user (such as when the user wishes to transport the container (e.g., in a suitcase during traveling, etc.)).

It will be appreciated that the separate refill valve 110 and transition fitment 108 may alternatively be molded together as a unitary structure, such as with bi-injection molding. Alternatively, the valve 110 could be compression-molded onto the transition fitment 108.

It will also be appreciated that the use of the transition fitment 108 and valve 110 permits the container 104 to be refilled after it has been emptied (or to be refilled after it has been only partially emptied). To this end, the empty container 104 could be returned to the manufacturer where the manufacturer could remove the fitment 108 and valve 110 and refill it.

Alternatively, the consumer could refill an empty container by merely removing the empty container from the support base 102, then inserting the spout of a filling reservoir or device (not shown) through the valve 110, and then discharging additional fluent material through the filling device spout into the interior of the container 104. It will be appreciated that refilling of the container 104 by the user in this manner would not require, removal of the valve 110 or transition fitment 108 and would not require the removal of any other component which could cause dripping. Thus, such a refill procedure is relatively clean and simple.

Figure 12:
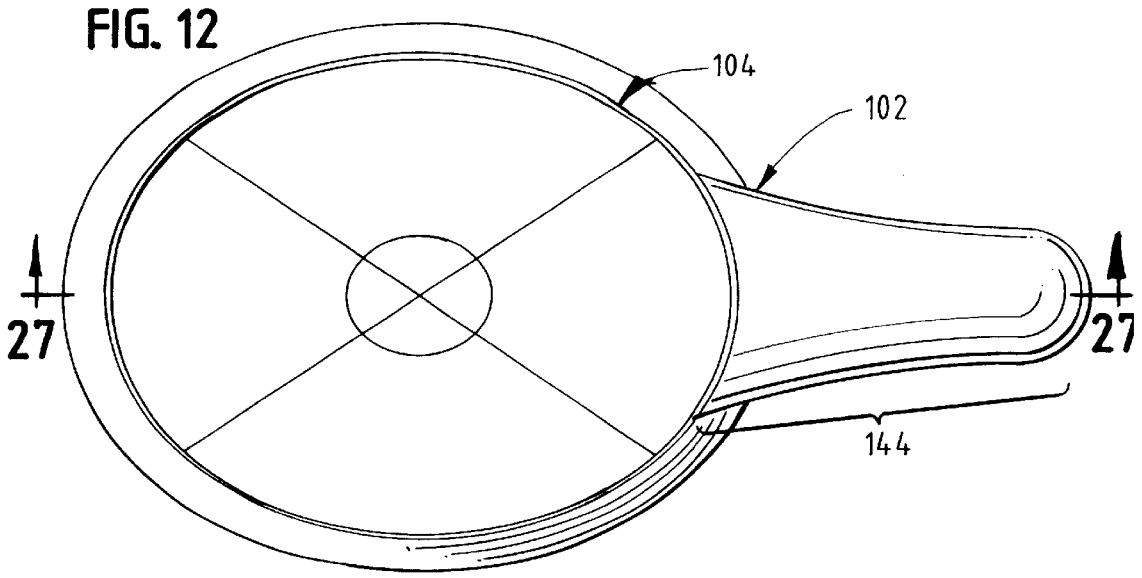
FIG. 12 is a top plan view of the container illustrated in FIG. 1 shown mounted in the first embodiment of the support base.
Figure 13:
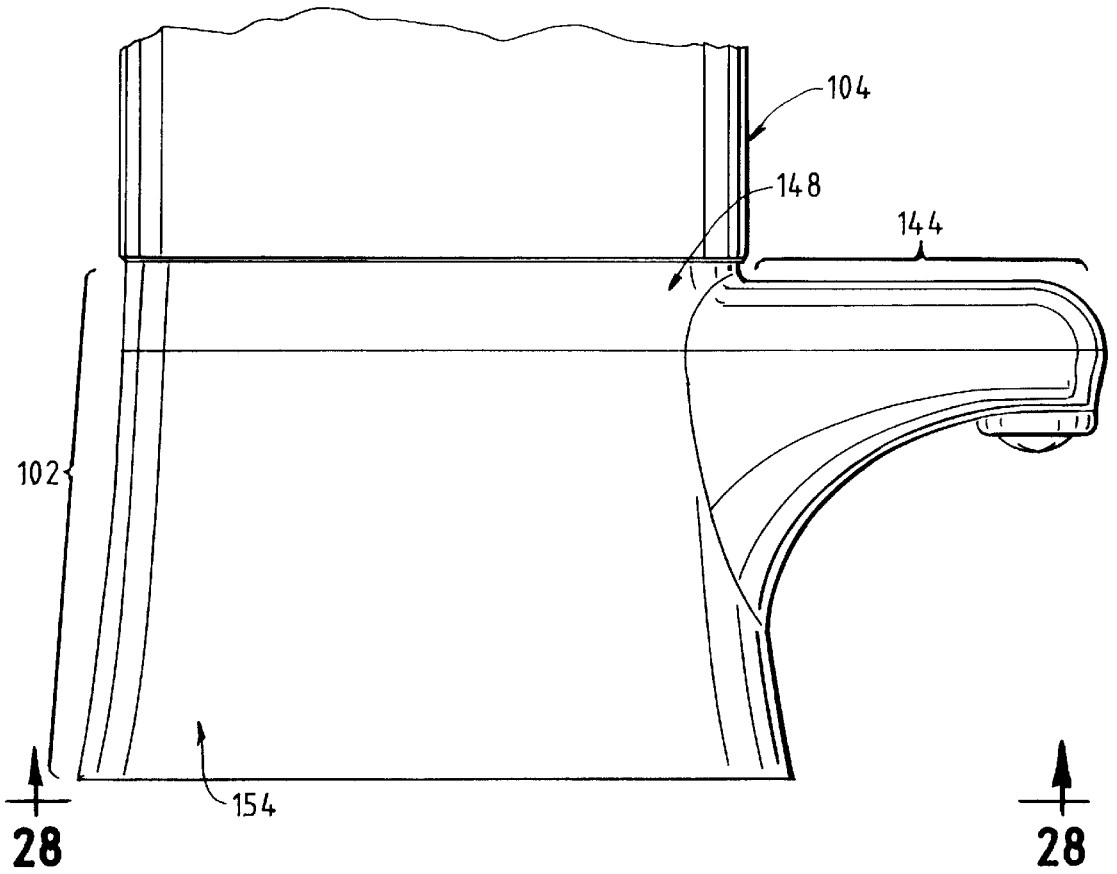
FIG. 13 is a fragmentary, side elevational view of the container illustrated in FIG. 1 mounted in the first embodiment of the support base.
Figure 14:
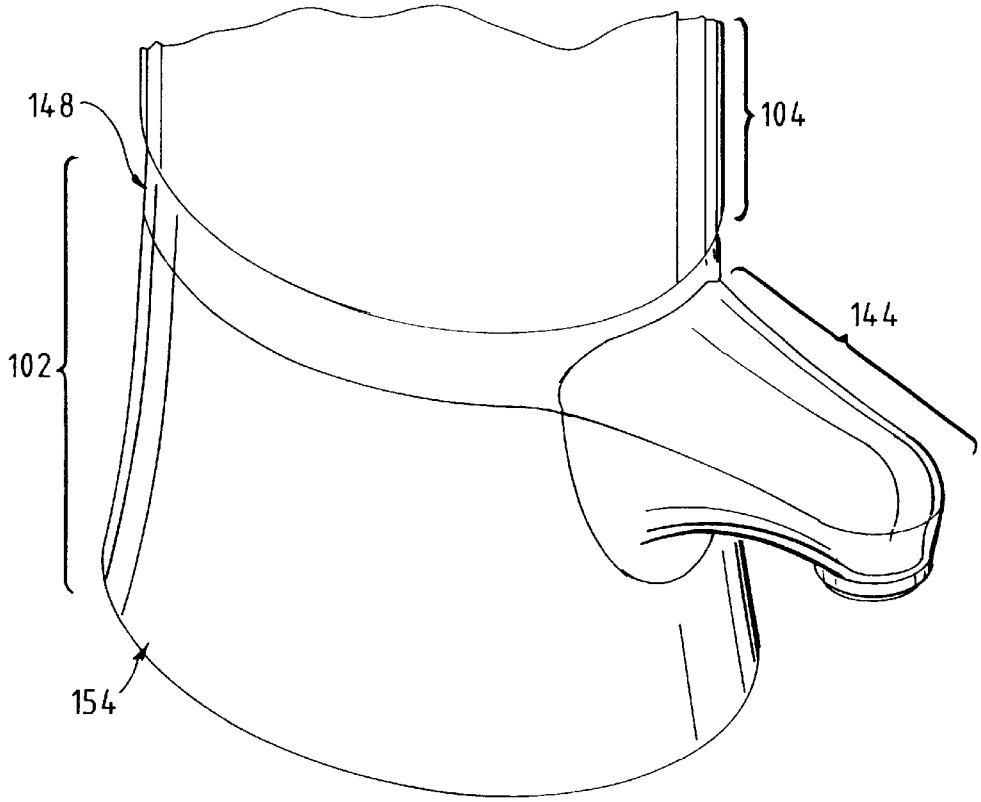
FIG. 14 is a fragmentary, perspective view of the container and support base of FIGS. 12–13.
Figure 15:
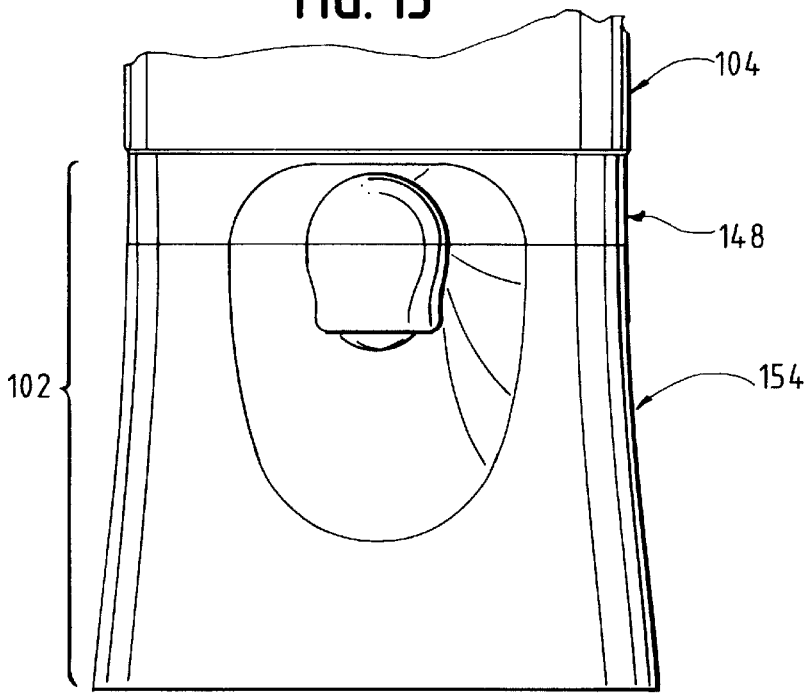
FIG. 15 is a fragmentary, front elevational view of the container and support base of FIGS. 12–14.

In any event, the container 104 can be installed on the support base 102 (FIG. 4) by first removing the overcap 106 as previously described, and then inverting the container to mount it in the support base 102 as shown in FIG. 14. The support base 102 includes an outwardly extending spout 144 from which the fluent product may be conveniently dispensed as described hereinafter in detail. As shown in FIGS. 12 and 13, the spout 144 extends laterally beyond the profile of the container 104 and is elevated above the bottom of the support base 102 so as to provide a convenient receiving region or target region for dispensing the fluent product. Typically, a user may position his or her hand beneath the spout 144 for receiving a quantity of the product to be dispensed from the container 104.

Figure 16:
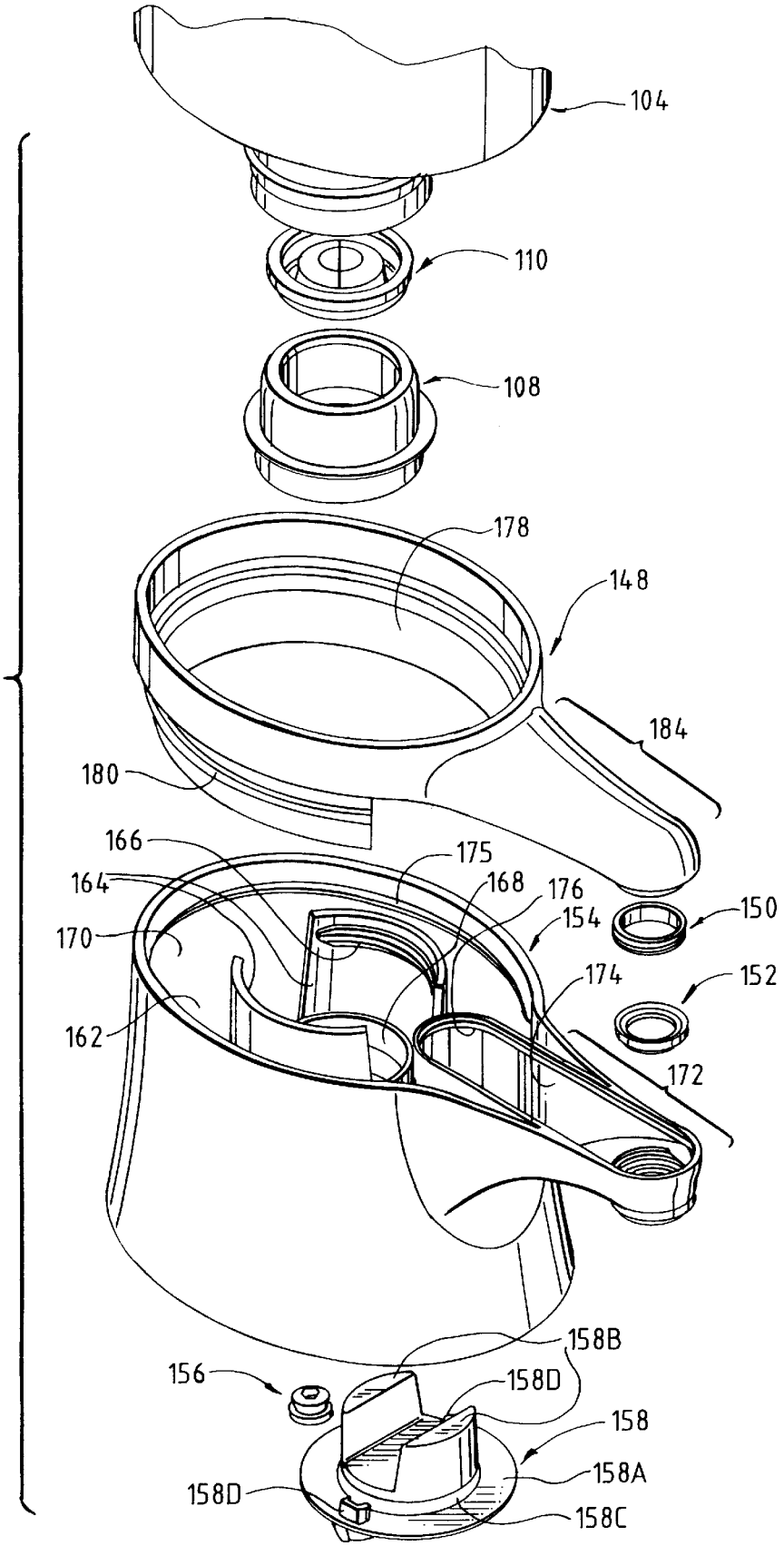
FIG. 16 is a fragmentary, exploded, perspective view of the container, refill valve, transition fitment, and support base components of FIGS. 12–15.

As shown in FIG. 16, the support base includes a number of components: a top component 148, a base component 154, a venting valve 156, a plug component 158, a valve retaining ring 150, and a dispensing valve 152.

Figure 17:
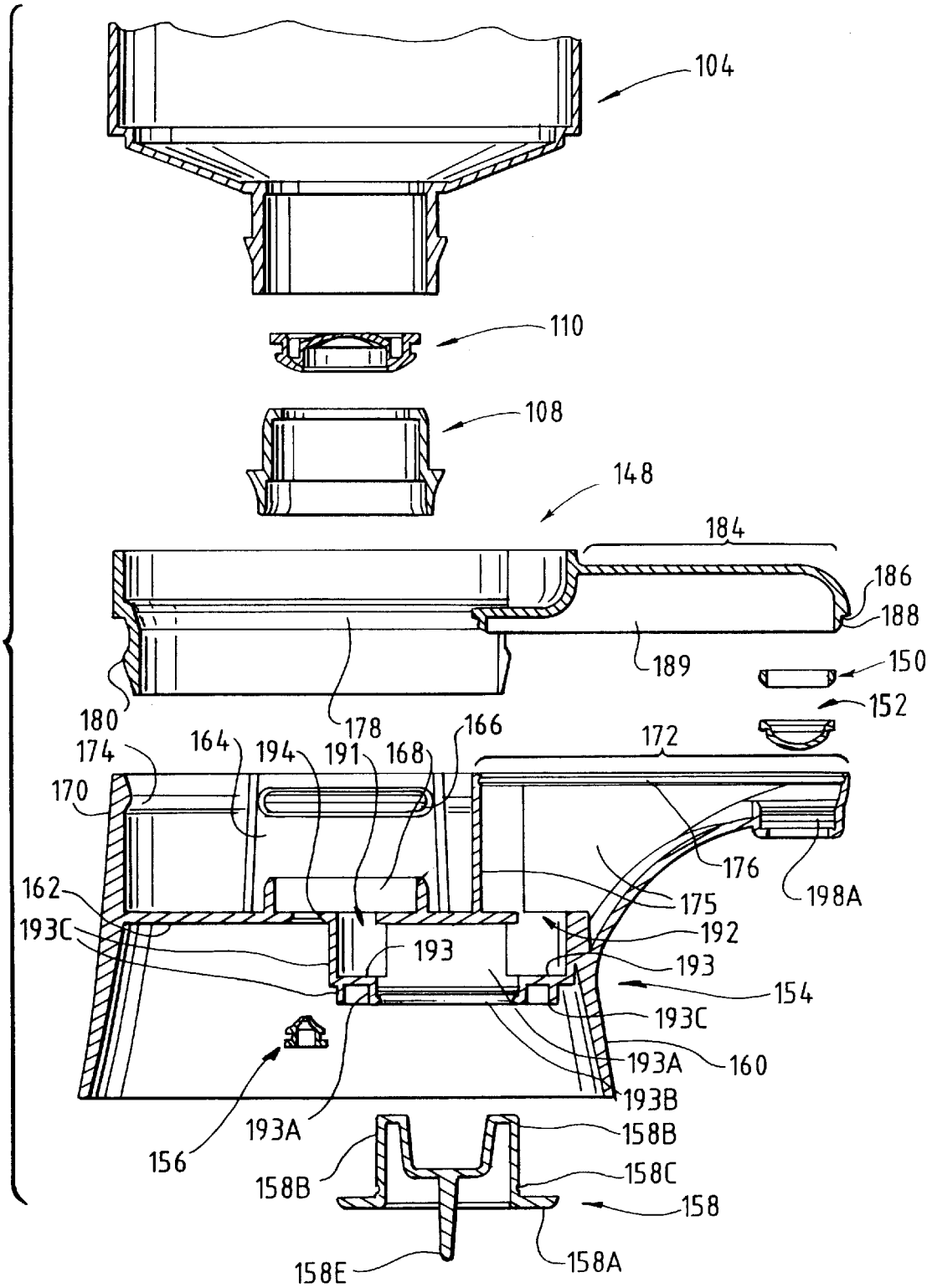
FIG. 17 is a fragmentary, exploded, cross-sectional view of the components shown in FIG. 16.
Figure 18:
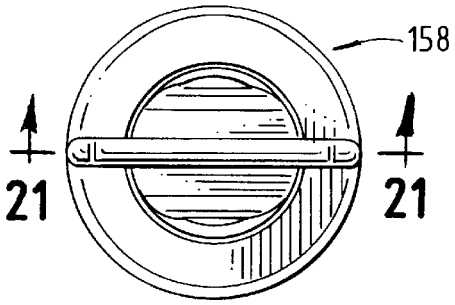
FIG. 18 is a bottom, plan view of the exterior side of the plug component which is adapted to be received within the first embodiment of the support base shown in FIGS. 16 and 17.
Figure 19:
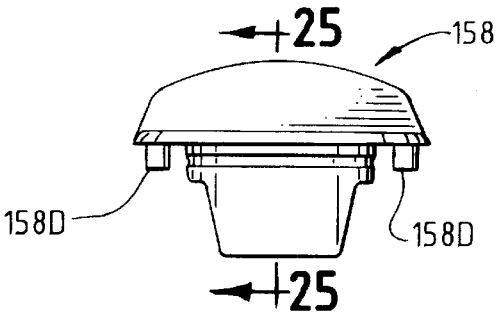
FIG. 19 is a side elevational view of the plug component of FIG. 18.
Figure 20:
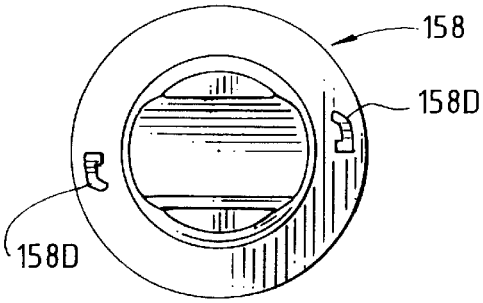
FIG. 20 is a top, plan view of the inside surface of the plug component of FIG. 18.
Figure 21:
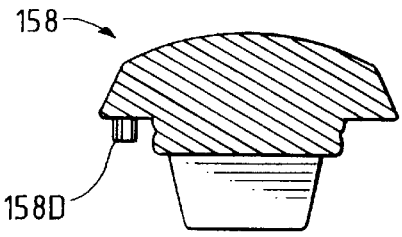
FIG. 21 is a cross-sectional view taken generally along the plane 21—21 in FIG. 18.
Figure 22:
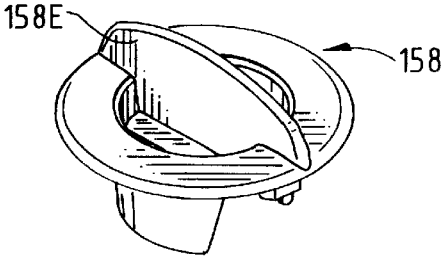
FIG. 22 is a perspective view of the plug component of FIG. 18.
Figure 23:
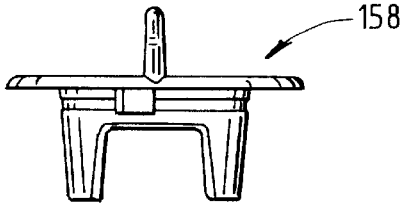
FIG. 23 is an end view of the plug component of FIG. 18.
Figure 32:
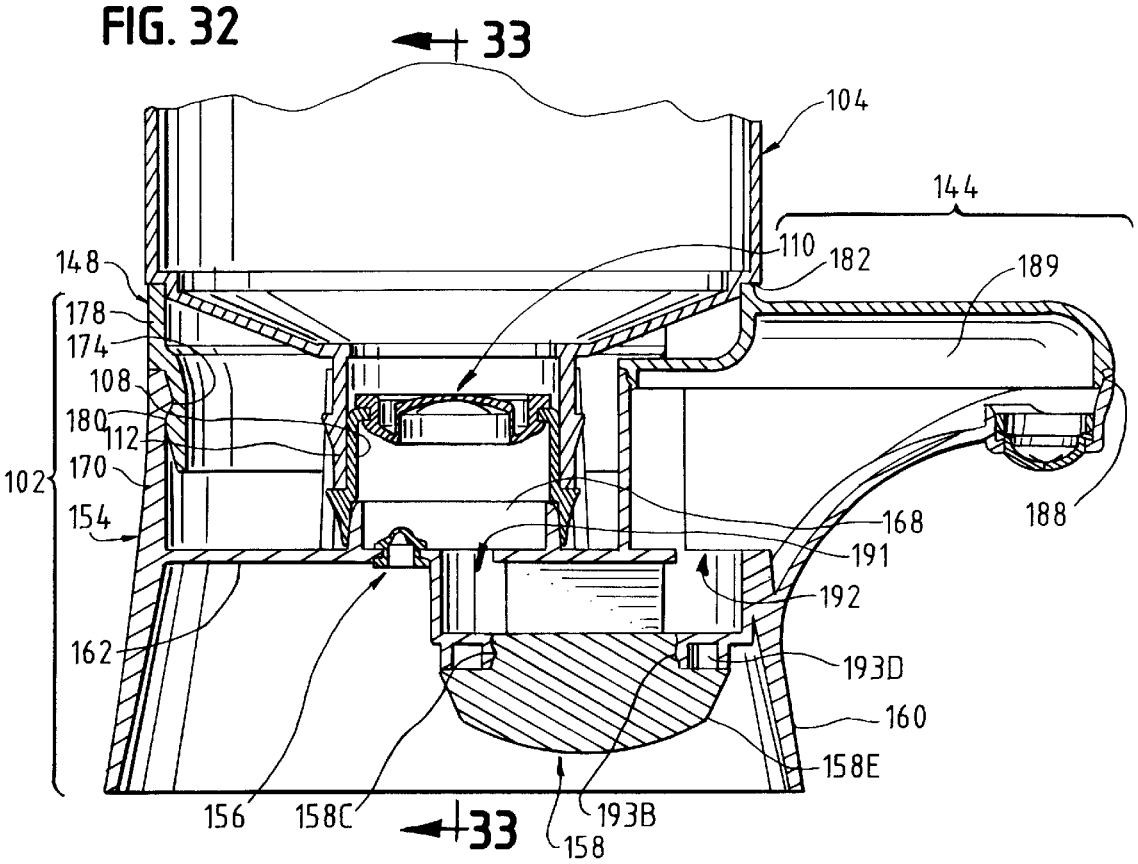
FIG. 32 is a fragmentary, cross-sectional view taken generally along the plane 32—32 in FIG. 29.
Figure 33:
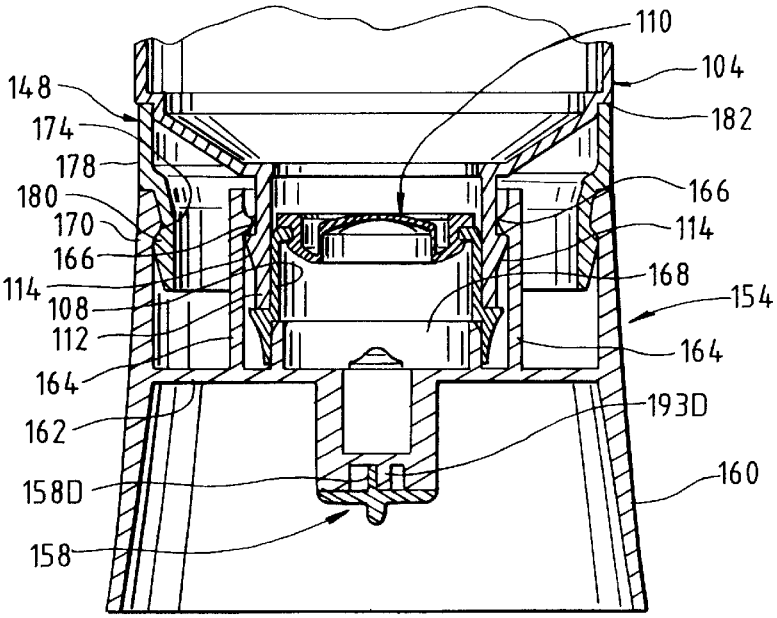
FIG. 33 is a fragmentary, cross-sectional view taken generally along the plane 33—33 in FIG. 32.

As shown in FIGS. 17, 32, and 33, the base component 154 includes a lower, exterior wall 160 which defines a stable support. As can be seen in FIGS. 17, 32, and 33, a horizontal wall or deck 162 extends across the inside of the wall 160. As can be seen in FIGS. 16, 17, 30, and 33, a pair of spaced-apart, arcuate, mounting walls 164 project upwardly from the horizontal wall or deck 162. Each of the two walls 164 includes an inwardly extending bead 166 (FIGS. 16 and 33) for engaging the bead 114 on the inverted container neck after the overcap 106 has been removed and the inverted container mounted in the support base walls 164 as shown in FIG. 33.

As shown in FIGS. 16, 17, 32, and 33, an annular plug seal wall 168 projects upwardly from the horizontal wall or deck 162 between the two spaced-apart mounting walls 164. The plug seal wall 168 is adapted to be received within the transition fitment 108 as shown in FIGS. 32 and 33 so as to provide a substantially fluid-tight connection between the container 104 and support base component 154 via the transition fitment 108 which is sealingly engaged at one end with the inside of the container neck 112 and which is sealingly engaged at the other end with the annular plug seal wall 168. This provides a leak-tight flow path from the interior of the container 104 into the support base 154. The above-described structure in the support base component 154 for receiving the container neck may be characterized as a receiving aperture for receiving the container opening. Other suitable structures could be provided for the purpose of functioning as a receiving aperture.

As can be seen in FIGS. 16 and 17, the base component 154 has a peripheral wall 170 extending upwardly from the plug seal wall or horizontal wall 162. The wall 170 extends forwardly from the base component 154 to define a spout lower portion 172. A bead 174 (FIG. 16) extends around the inside surface of much of the wall 170 and terminates at the area where the spout lower portion 172 begins to project. Within the spout lower portion 172 is an inner wall 175 (FIG. 16) which is somewhat U-shaped and merges with the distal end of the spout lower portion 172. The U-shaped wall 175 and spout lower portion 172 together define a flow path within the spout lower portion 172. The interior, upper edge of the distal end of the spout lower portion 172 and the interior, upper edge of the wall 175 define a groove or channel 176 (FIGS. 16 and 17) for engaging the top component 148 as described hereinafter.

The base component outer wall 170 and inner wall 174 are adapted to receive the top component 148 (FIGS. 16 and 17). As shown in FIG. 16, the top component 148 includes an annular wall 178, the bottom portion of which extends downwardly and defines an outwardly projecting bead 180 (FIGS. 16 and 17) for being received in snap-fit engagement below the bead 174 in the base component wall 170 (FIGS. 16 and 17) to form a snap-fit connection as shown in FIGS. 32 and 33. As shown in FIG. 32, the container 104 is preferably provided with a shoulder 182 for resting on the upper edge of the annular wall 178 of the top component 148.

Figure 27:
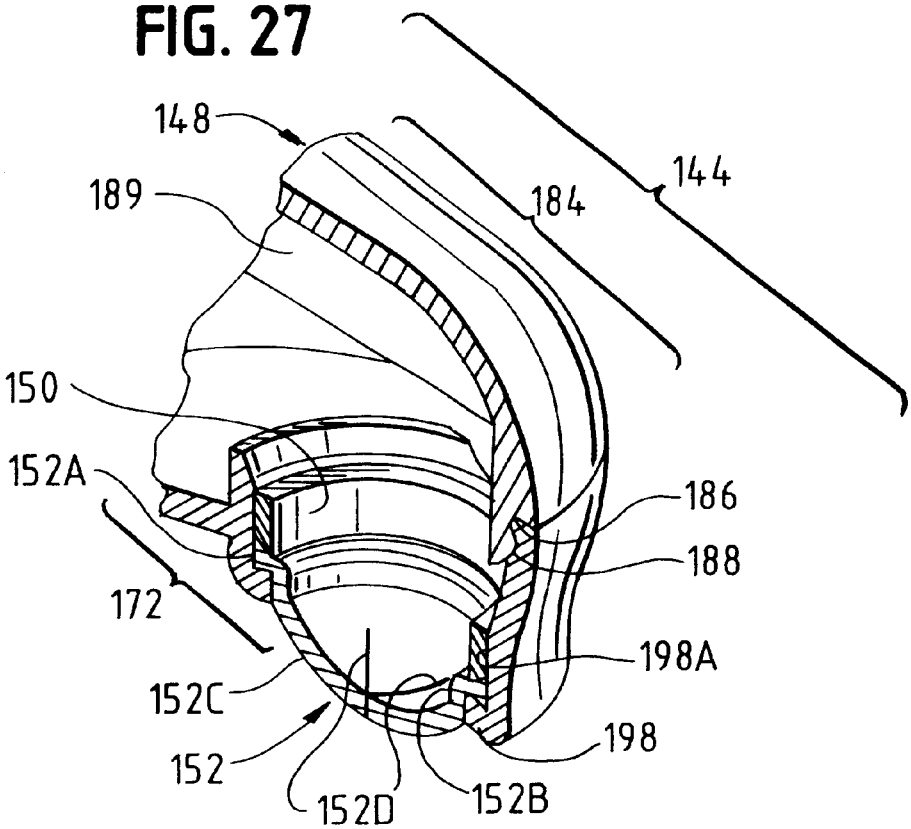
FIG. 27 is a fragmentary, cross-sectional view of the spout and dispensing valve taken generally along the plane 27—27 in FIG. 12.
Figure 28:
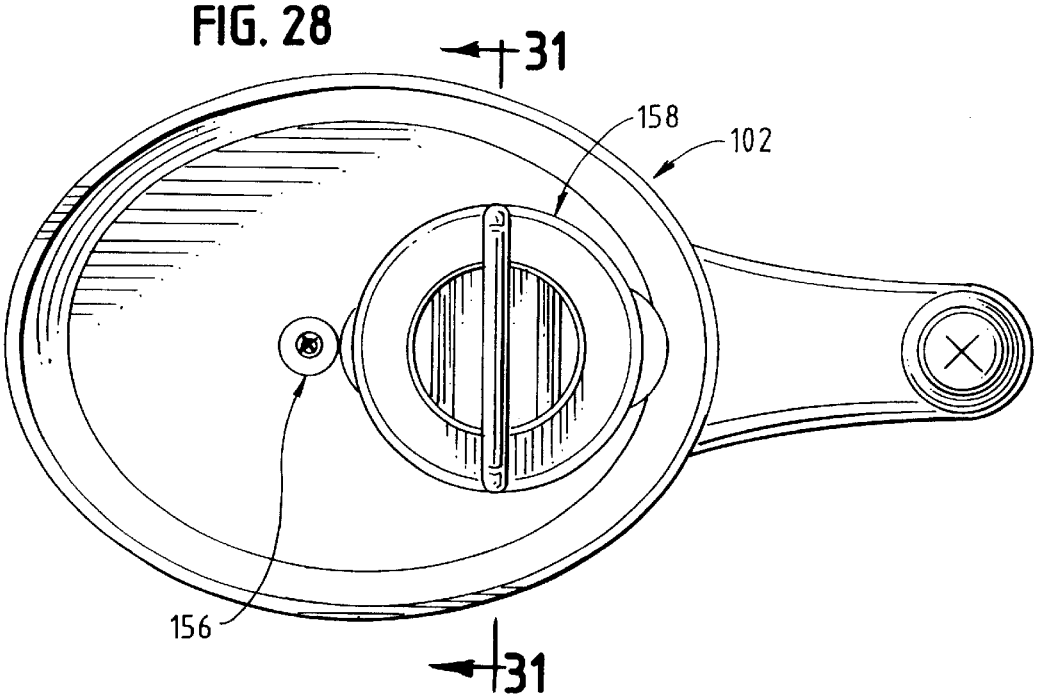
FIG. 28 is a bottom plan view of the support base taken generally along the plane 28—28 in FIG. 13, and the support base is shown with the plug component in the closed orientation.
Figure 29:
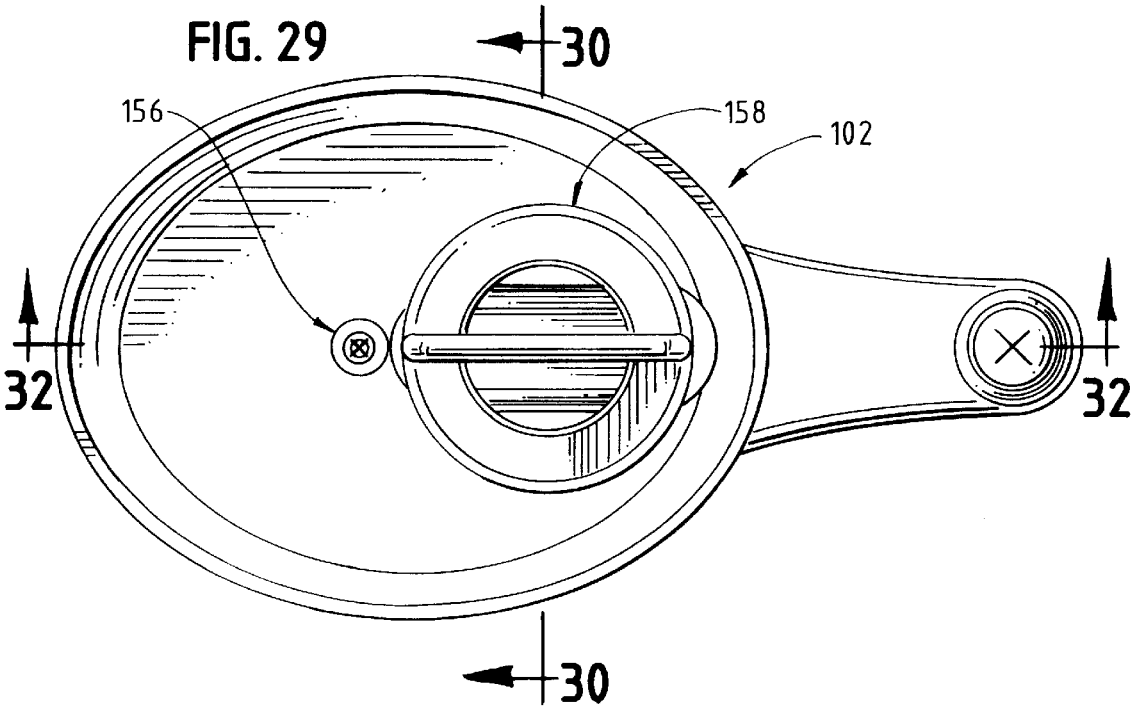
FIG. 29 is a view similar to FIG. 28, but FIG. 29 shows the plug component turned to the open orientation.

The top component 148 includes an outwardly projecting spout upper portion 184 as shown in FIGS. 16 and 17. As shown in FIGS. 17 and 27, the lower, peripheral margin of the distal end of the spout upper portion 184 defines a groove 186 and bead 188 for engaging the spout lower portion. The spout upper portion 184 also includes an interior, generally U-shaped wall 189 (FIGS. 27 and 32) which corresponds to, and is in registry with, the spout lower portion wall 175. The wall 189 merges with the inside of the distal end of the spout upper portion 184.

As shown in FIGS. 17, 27 and 32, the U-shaped wall 189 and the inside of the spout upper portion of the top component 148 extend over the base component spout and lower portion wall 175 to define the top of the flow passage of the spout 144. The bottom edge of the U-shaped wall 189 of the upper spout portion 184 continues the groove 186 and bead 188 from the distal end of the spout upper portion to form the snap-fit engagement with the base component groove 176 of the component spout lower portion 172 and inner U-shaped wall 175.

Figure 36:
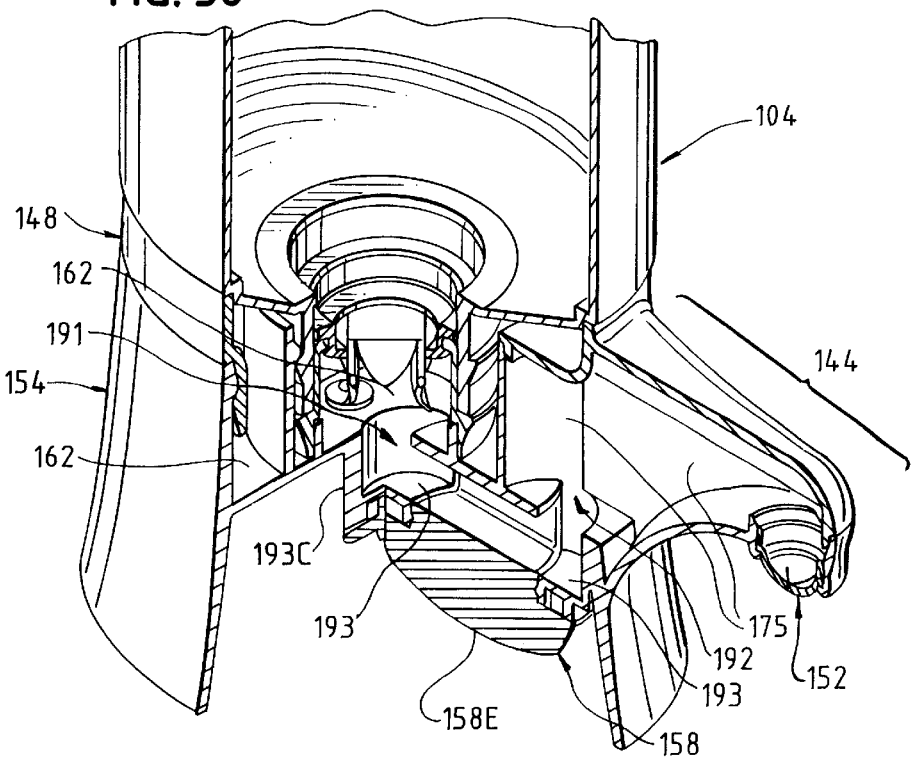
FIG. 36 is a fragmentary, partial cross-sectional, perspective view of the assembly shown in FIGS. 34 and 35.

As shown in FIGS. 17 and 36, the deck 162 defines an inlet opening 191 and an outlet opening 192 which are separated, above the deck 162, by the plug seal wall 168 and the U-shaped end of the wall 175 which defines the spout lower portion 172.

Figure 30:
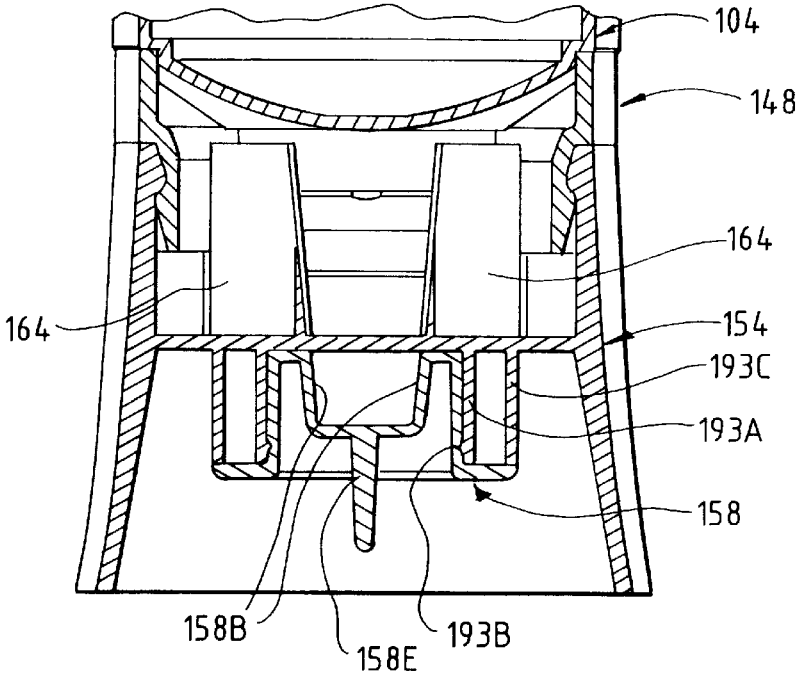
FIG. 30 is a fragmentary, cross-sectional view taken generally along the plane 30—30 in FIG. 29.
Figure 31:
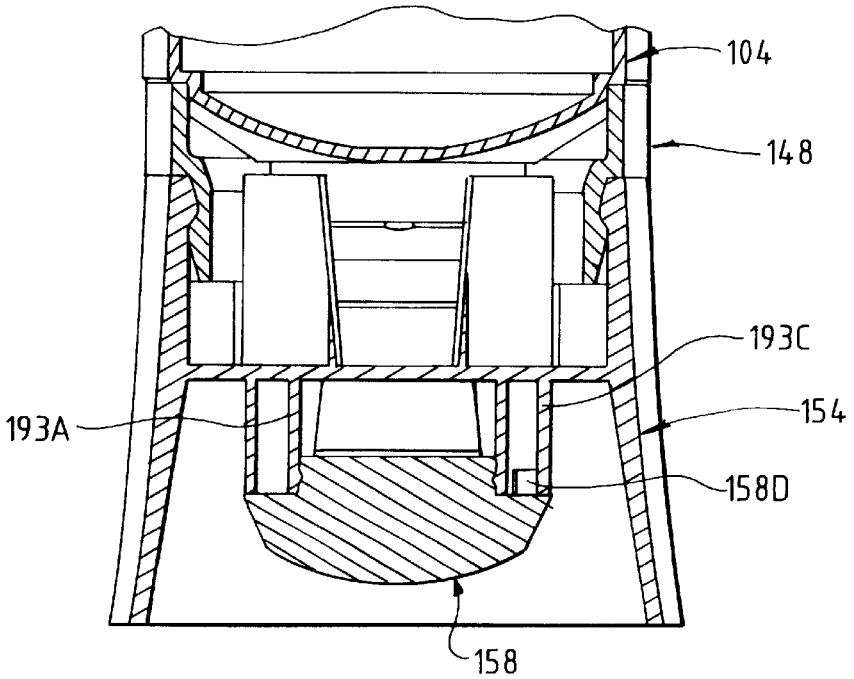
FIG. 31 is a view similar to FIG. 30, but FIG. 31 shows the plug component rotated 90 degrees to the closed position.

As shown in FIGS. 17, 30, and 31, the base, component 154 defines an inner annular wall 193A for receiving the plug component 158. The inner annular wall 193A is surrounded by an outer wall 193C (FIG. 17). As shown in FIGS. 17 and 36, a horizontal bottom wall 193 (FIG. 17) joins the walls 193A and 193C to define a pocket on each end of the plug component 158—one at the deck inlet opening 191 and one at the deck outlet opening 192.

As shown in FIGS. 17 and 36, one pocket communicates at the top with the container 104 through the inlet opening 191 and also communicates laterally through an opening in the inner wall 193A with the interior of the inner wall 193A. The other pocket communicates at the top with the spout through the outlet opening 192 and also communicates laterally through an opening in the inner wall 193A with the interior of the inner wall 193A.

Figure 24:
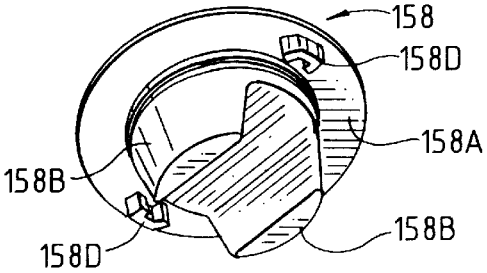
FIG. 24 is a perspective view of the inside surface of the plug component of FIG. 18.
Figure 25:
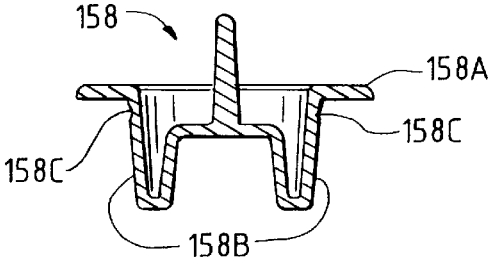
FIG. 25 is a cross-sectional view taken generally along the plane 25—25 in FIG. 19.

As shown in FIGS. 17 and 30, the inner wall 193A defines a bead 193B around an opening for receiving the plug component 158. As shown in FIGS. 24 and 25, the plug component 158 includes a flange 158A from which project a pair of spaced-apart, hollow wall members 158B. The exterior surface of each hollow wall member 158B defines a groove 158C for receiving in snap-fit engagement the bead 193B on the wall 193A of the base component 154 as shown in FIG. 32.

Figure 37:
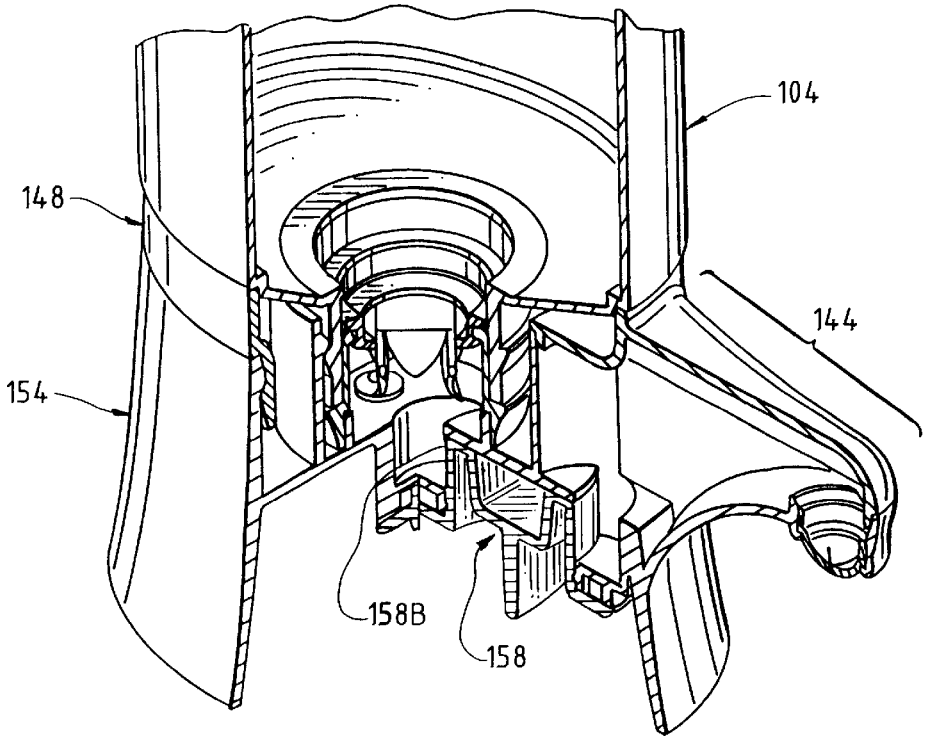
FIG. 37 is a fragmentary, partial cross-sectional view similar to FIG. 36, except that FIG. 37 shows the plug component rotated 90 degrees in the closed orientation.

As shown in FIG. 24, the plug 158 includes a pair of oppositely oriented lugs 158D which are oriented 180 degrees apart on the diameter of the plug component 158. As shown in FIG. 32, each lug 158D is adapted to be received within a channel defined by the base component wall 193A and the outer wall 193C (one lug 158D being visible in FIG. 32). Extending between the inner annular wall 193A and the outer wall 193C are four ribs which are spaced about 90 degrees apart. One of the ribs 193D is visible in FIG. 33. One pair of ribs are 180 degrees apart and are adapted to be engaged by the plug component lugs 158D when the plug component 158 is in the open orientation (FIGS. 30, 32, and 36). FIG. 33 shows one of the ribs 193D engaged by one of the plug component ribs 158D when the plug component 158 is in the open orientation. The other pair of ribs are 180 degrees apart and are adapted to be engaged by the plug component lugs 158D when the plug component 158 is rotated to the closed orientation (FIGS. 31 and 37). The plug component 158 is manually rotatable between the open and closed orientations, and an operating tab 158E (FIGS. 17, 22, 32, and 36) is provided for grasping by the user to assist in rotating the plug component 158.

When the plug component 158 is in the open orientation (FIGS. 32 and 36), the fluent product can flow from the container 104 through the base component inlet 191 (FIG. 36), through the plug component 158 (between the spaced-apart walls 158B (FIG. 30)), and up through the base component outlet opening 192 into the spout 144 (FIG. 36).

Figure 34:
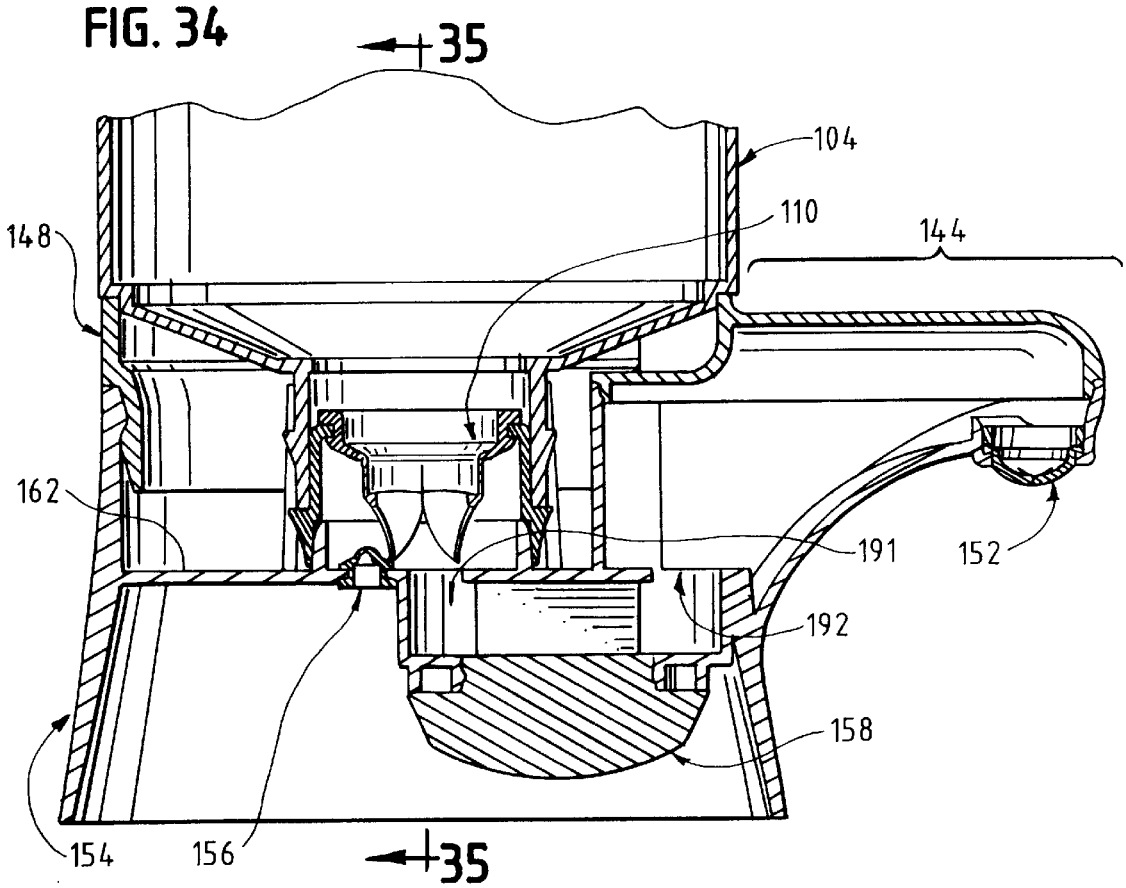
FIG. 34 is a view similar to FIG. 32, but FIG. 34 shows the refill valve in the full open position after the container has been squeezed to discharge product from the container through the refill valve and into the support base (the fluent product being omitted for ease of illustration in FIG. 34)
Figure 35:
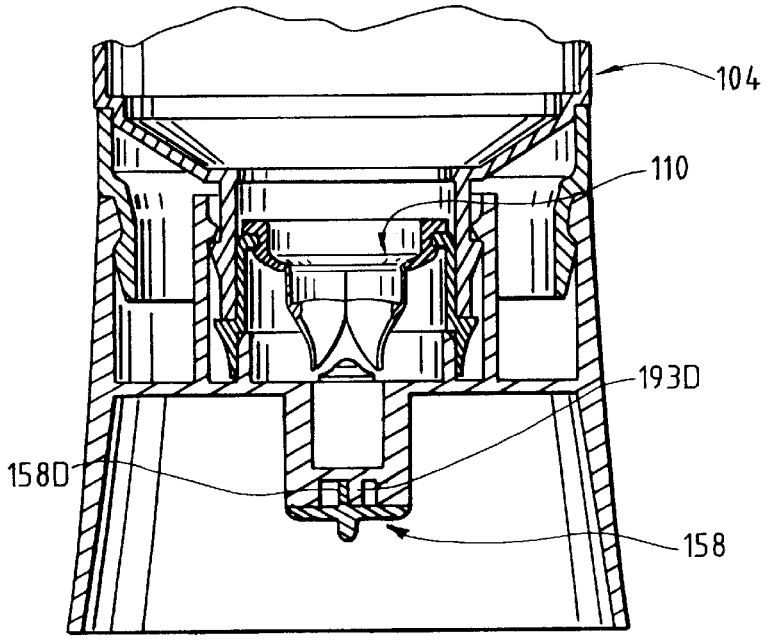
FIG. 35 is a fragmentary, cross-sectional view taken generally along the plane 35—35 in FIG. 34.

Product flow is preferably effected by pressurizing the interior of the container 104, as by squeezing the walls of the container if it is a flexible container, so as to open the refill valve 110 (as illustrated in FIG. 34).

Figure 26:
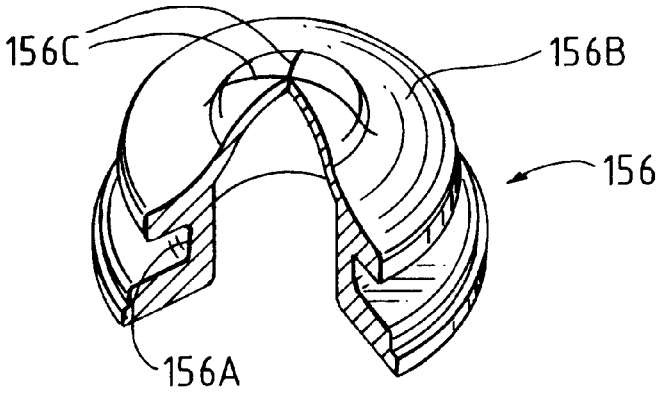
FIG. 26 is a partial, cross-sectional view of the one-way venting valve or vent valve used in the first embodiment of the support base shown in FIG. 16.

As shown in FIG. 17, the horizontal wall or deck 162 of the base component 154 defines an aperture 194 within the diameter of the annular plug seal wall 168 adjacent the downwardly extending annular wall 193C. The aperture 194 is adapted to receive the vent valve 156. The vent valve 156 is illustrated in FIG. 26 and is preferably a pressure-openable, resiliently flexible valve which includes a peripheral margin defining a mounting groove 156A for engaging a peripheral portion of the base deck 162 around the aperture 194 to hold the vent valve 156 in the deck 162.

The vent valve 156 includes a head portion 156B which preferably includes two, mutually perpendicular, intersecting, slits 156C of equal length which together define a closed vent orifice. The intersecting slits 156C define four, generally sector-shaped flaps or petals in the head 156B. The flaps open upwardly or inwardly toward the container 104 when the pressure within the container is less than the exterior ambient pressure. This allows air to vent into the container for equalizing the pressure in the container. This in-venting flow of air occurs after the container has been squeezed by the user and the walls of the container return to the normal, unstressed configuration which increases the volume in the container compared to the "squeezed" volume of the container. As the wall or walls of the container 104 return to the unstressed condition, the pressure within the container drops. That causes the vent valve 156 to open to allow air to enter the container and equalize the pressure within the container. This assists the fluent product within the container in later flowing downwardly within the container and into the base component 154 when the container is again squeezed.

The particular structure of the vent valve 156 forms no part of the present invention. Any suitable vent valve may be employed, including an umbrella valve, a duck bill valve, or some other suitable elastomeric valve or mechanical valve, including a mechanical valve employing a spring and ball valve member. In some applications, the valve 156 could be omitted altogether, depending upon the viscosity of the fluent product and the length of the flow paths within the system.

The dispensing valve 152 is mounted at the distal end of the spout 144 as illustrated in FIGS. 36 and 27. With reference to FIG. 27, the dispensing valve 152 is preferably a pressure-openable, resiliently flexible valve. The valve 152 preferably includes an annular, marginal flange 152A which has a dovetail cross section and from which extends a generally cylindrical wall or body 152B. The flange 152A is adapted to be engaged on one side by the valve retaining ring 150 and on the other side by a lip or flange 198 at the bottom of the spout 144. The valve retaining ring 150 is adapted to be snap-fit into the inside of the spout lower portion 172 (FIG. 17). To this end, the exterior periphery of the valve retaining ring 150 has a slightly outwardly extending radius or bead for being received in a snap-fit engagement within an annular recess 198A in the spout lower portion 172 (FIG. 27).

The valve wall 152B is closed by a dome-shaped head 152C. The head 152C preferably includes two, mutually perpendiculars intersecting, dispensing slits 152D of equal length which together define a closed dispensing orifice. The intersecting slits 152D define four, generally sector-shaped flaps or petals in the head 152C which has a generally convex configuration (when viewed from the exterior of the package). The flaps open outwardly from the intersection of the slits 152D in response to increasing pressure within the spout 144 when the container 104 is squeezed or otherwise pressurized. The flaps return to the closed condition illustrated in FIG. 27 after the squeezing pressure is released.

The dispensing valve 152 has substantially the same structure as the prior art valve 132 described in the U.S. Pat. No. 5,033,655, the disclosure of which is incorporated herein by reference thereto to the extent pertinent and to the extent not inconsistent herewith. The dispensing valve 152 may be molded from the same resilient materials as described above for the refill valve 110.

It will be appreciated that, according to one aspect of the present invention, the structure of the dispensing valve 152 may be altered from that illustrated in FIGS. 17, 27, and 36. The dispensing valve 152 may have other shapes, and the dispensing valve need not be molded from a resilient, flexible material. The dispensing valve may instead be a mechanical valve which could include a spring and ball shut-off member biased to keep the valve closed except when the internal pressure within the discharge spout is increased a certain amount above the ambient pressure. Other types of valves, such as a duck bill valve, could be employed. In some applications, where a clean shut-off of the fluent product at the spout is not critical, the dispensing valve 152 could be eliminated altogether. In such a case, however, the container 104 would preferably be provided with an outlet valve or refill valve 110 that would return to the closed position after the squeezing pressure on the container has been terminated.

For most applications, however, it is contemplated that the dispensing valve 152 would be designed to open in response to a relatively small increase in pressure within the spout resulting from the user squeezing the container 104, and the dispensing valve 152 would close quickly, and in a substantially seal-tight manner, after the internal pressure has dropped to the ambient atmospheric pressure (or slightly above) when the user terminates pressurization of the container 104. This will prevent the fluent product dripping or dribbling from the spout 144 after the user has dispensed the desired quantity of fluent product.

With respect to the flow path for the fluent product within the dispensing system that has been described with reference to the first embodiment illustrated in FIGS. 1–37, it will be appreciated that one aspect of the invention may be characterized as a support base 102 for supporting the container 104. The support base 102 has a receiving aperture for receiving the container opening. The receiving aperture in the support base 102 is generally defined by the upwardly open configuration of the support base 102, and in particular, may be regarded as including, in the preferred embodiment, the mounting walls 164 and/or the plug seal wall 168. The walls 164 and/or the wall 168 may be characterized as defining a receiving aperture for receiving the container opening. With reference to FIG. 17, a flow path is defined to extend between the container-receiving aperture of the base component 154 to the discharge aperture at the end of the spout, which discharge aperture is preferably occluded by the dispensing valve 152.

With reference to FIG. 32, the flow path may be characterized as being defined in the support base 102 to include the inlet opening 191, the outlet opening 192, and the spout 144. When the plug component 158 is in the open orientation (FIG. 32), the flow path includes the opening through the plug component 158. The plug component 158 functions as shut-off valve which is located in the flow path between the above-described receiving aperture and the spout discharge aperture. The plug component 158 is adapted to be rotated 90 degrees to the closed orientation (FIG. 37) wherein one of the spaced-apart walls 158B of the plug component occludes the flow path through the base component 154 and prevents the fluent product from flowing from the container through the spout 144. The plug component 158 may be characterized as being manually actuatable between a closed orientation (FIG. 37) occluding fluent flow through the flow path and an open orientation (FIG. 36) permitting fluent flow through the flow path.

The plug component 158 does not need to be rotated to the closed orientation after every use. It may remain in the open orientation (FIG. 36). However, it may be desirable to rotate the plug component 158 to the closed orientation (FIG. 37) prior to moving or otherwise transporting the dispensing system. Closing the plug component 158 in such a situation would prevent any unintended impact on the container 104 from causing the product to be dispensed from the system.

The first embodiment dispensing system illustrated in FIGS. 1–37 can be refilled and reused after it is empty. This is effected by first removing the empty container 104, along with the attached transition fitment 108 and valve 110, from the support base 102. The empty container is then discarded. The user then procures a new, full container, with the protective overcap 106 initially in place. The overcap 106 is subsequently removed (as described above with respect to the first container 104) so as to leave the transition fitment 108 and valve 110 in the neck of the new, full container. The new, full container is then inverted and mounted in the support base 102. When the new, full container is to be first used, the initial squeezing of the container will cause the refill valve 110 to open and stay open.

Alternatively, the consumer could refill an empty container by merely removing the empty container from the support base 102, then inserting the spout of a filling reservoir or device (not shown) through the valve 110, and then discharging additional fluent material through the filling device spout into the interior of the container 104. It will be appreciated that refilling of the container 104 by the user in this manner would not require removal of the valve 110 or transition fitment 108 and would not require the removal of any other component which could cause dripping. Thus, such a refill procedure is relatively clean and simple.

The support base 102 may be combined with the container 104 according to a further aspect of the invention to provide a combination dispensing system which includes the container 104 and the support 102 together as an integral system. However, the support base 102 alone may also be characterized as a broad aspect of the invention.

A second embodiment of the dispensing system is illustrated in FIGS. 38–62E. The second embodiment includes many features which are identical, similar, or analogous to features of the first embodiment described above with reference to FIGS. 1–37. The elements or features of the first embodiment have been designated with reference numbers in the 100 series. The reference numbers for the second embodiment are in the 200 series. The elements of the second embodiment which are identical, similar, or functionally analogous to the elements of the first embodiment employ the same last two digits as used for the reference numbers of the first embodiment elements.

In the second embodiment, a container 204 is provided for holding fluent product and has substantially the same configuration as the first embodiment container 104. In the second embodiment, the container 204 does not have a transition fitment or refill valve, such as the transition fitment 108 and refill valve 110 illustrated for the first embodiment in FIGS. 3 and 6.

Figure 54:
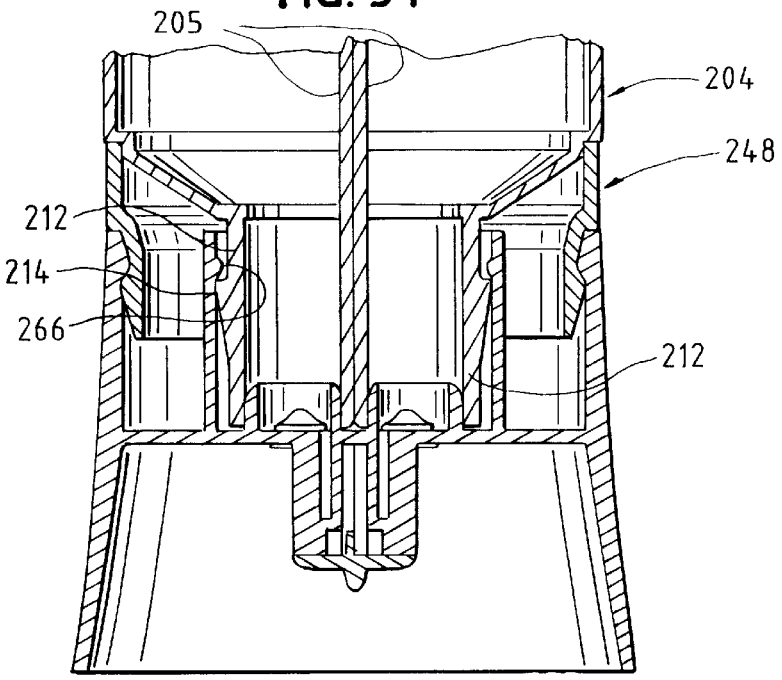
FIG. 54 is a fragmentary, cross-sectional view taken generally along the plane 54—54 in FIG. 50.
Figure 55:
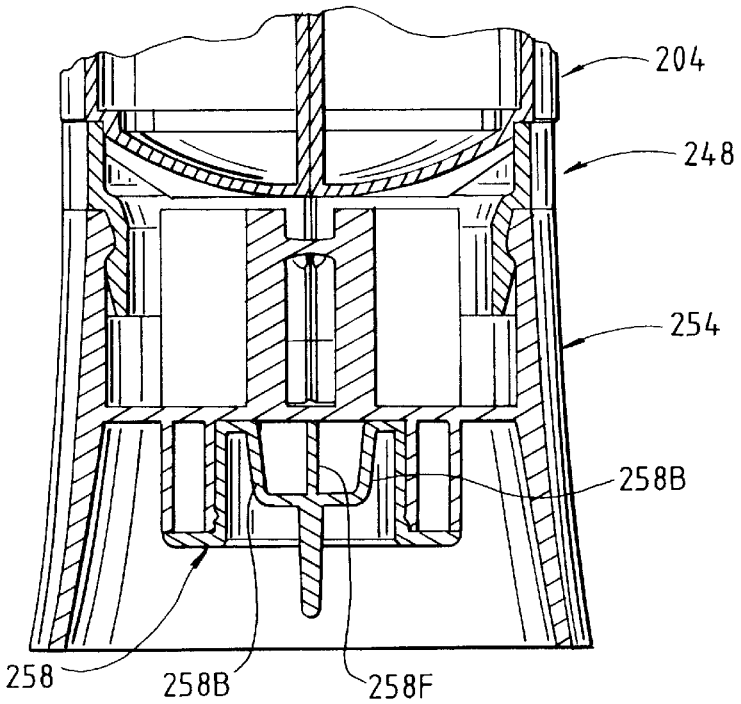
FIG. 55 is a fragmentary, cross-sectional view taken generally along the plane 55—55 in FIG. 50.

The second embodiment container 204 is adapted to hold two different fluent materials in separated, internal compartments. With reference to FIG. 54, the container 204 includes a pair of face-to-face internal divider walls 205 which function to divide the interior of the container 204 into two reservoirs or chambers which may or may not be of equal volume. The divider walls 205 extend throughout the length of the container 204 and to the opening defined by the container neck 212.

Figure 42:
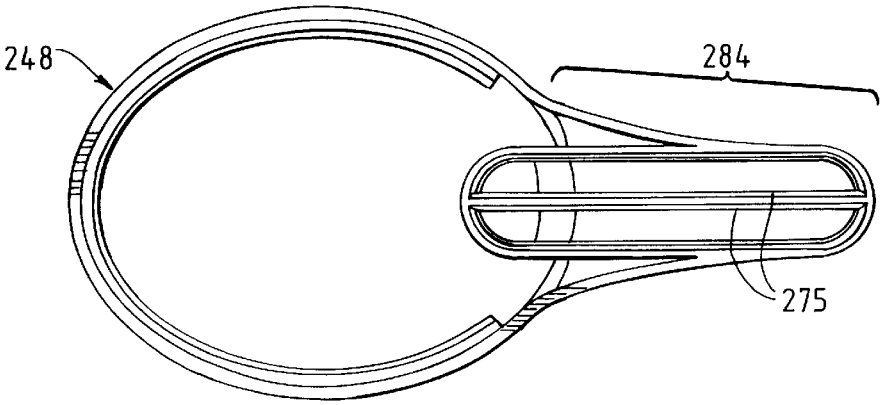
FIG. 42 is a bottom plan view taken generally along the plane 42—42 in FIG. 40.
Figure 43:
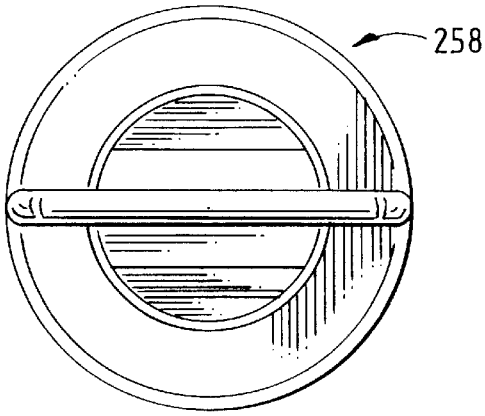
FIG. 43 is a top plane view of the plug component employed in the second embodiment of the support base shown in FIG. 38.

The second embodiment of the system includes a top component 248 (FIG. 38) which is substantially similar to the top component 148 of the first embodiment described above with reference to FIG. 16. However, the top component 248 has a spout upper portion 284 with a pair of spaced-apart, central dividing walls 275 (FIG. 42).

Figure 50:
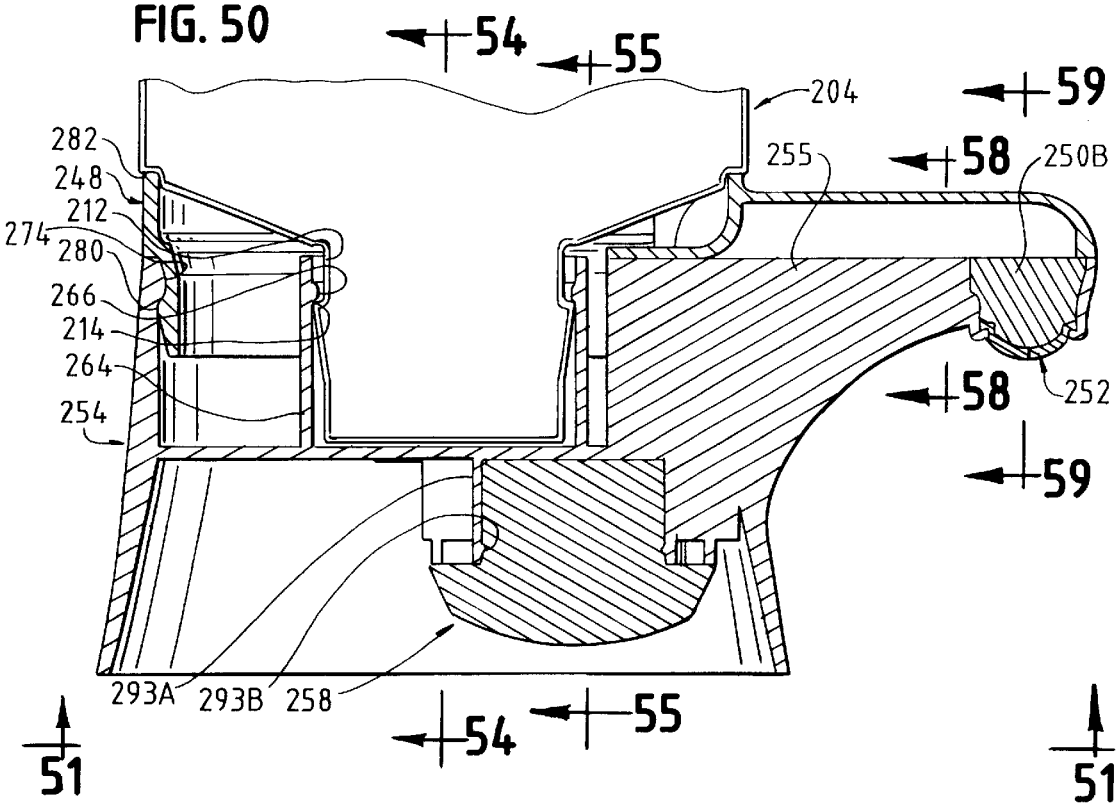
FIG. 50 is a fragmentary, cross-sectional view of the second embodiment of the assembled components illustrated in FIG. 48.

As shown in FIG. 50, the container 204 has a shoulder 282 which is adapted to rest on an upper edge of the top component 248 so as to support the container 204 in an inverted orientation. The top component 248 is adapted to be mounted in a snap-fit engagement into the upper portion of a base component 254 which is generally similar to the first embodiment base component 154. The second embodiment base component 254 includes a single, upwardly projecting mounting ring 264 with a bead 266 for engaging a bead 214 (FIGS. 50 and 54) around the container neck 212.

Figure 48:
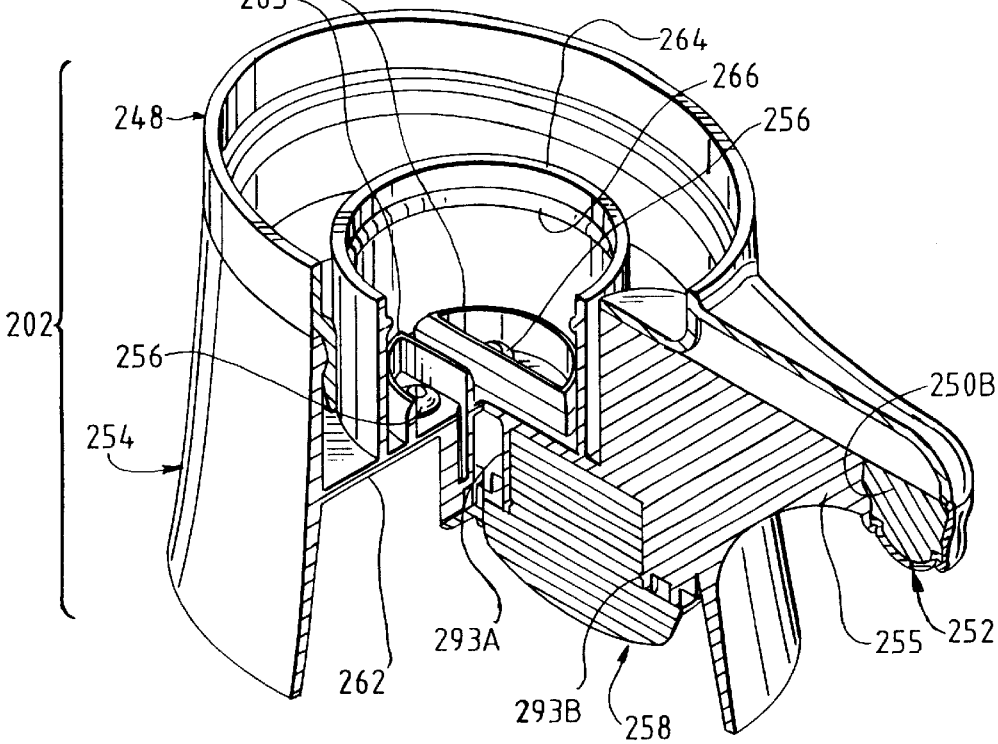
FIG. 48 is a partial cross-sectional, perspective view of the second embodiment of the support base assembled from some of the components illustrated in FIG. 38.
Figure 49:
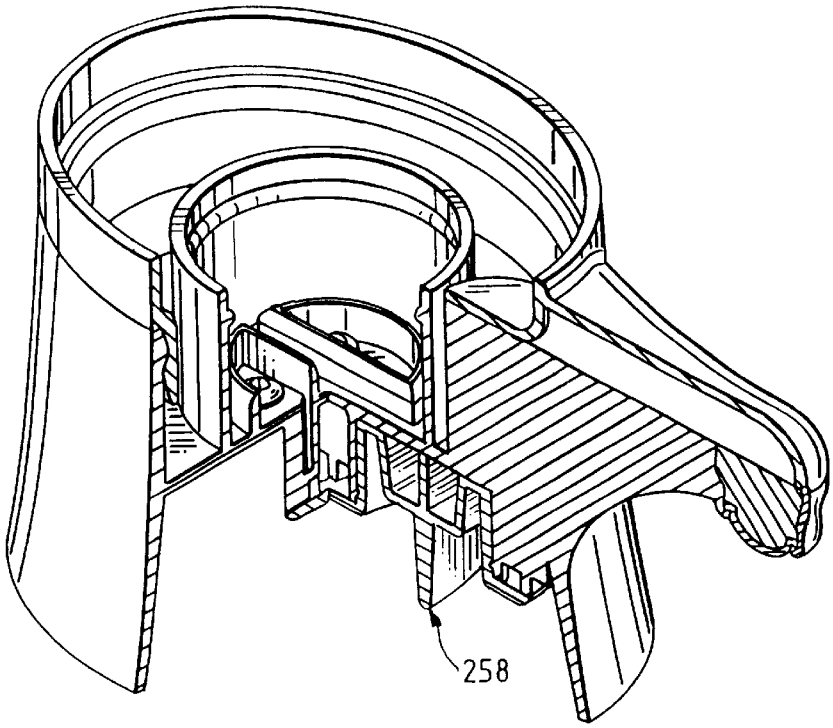
FIG. 49 is a view similar to FIG. 48, but FIG. 49 shows the plug component rotated 90 degrees in the closed orientation.
Figure 56:
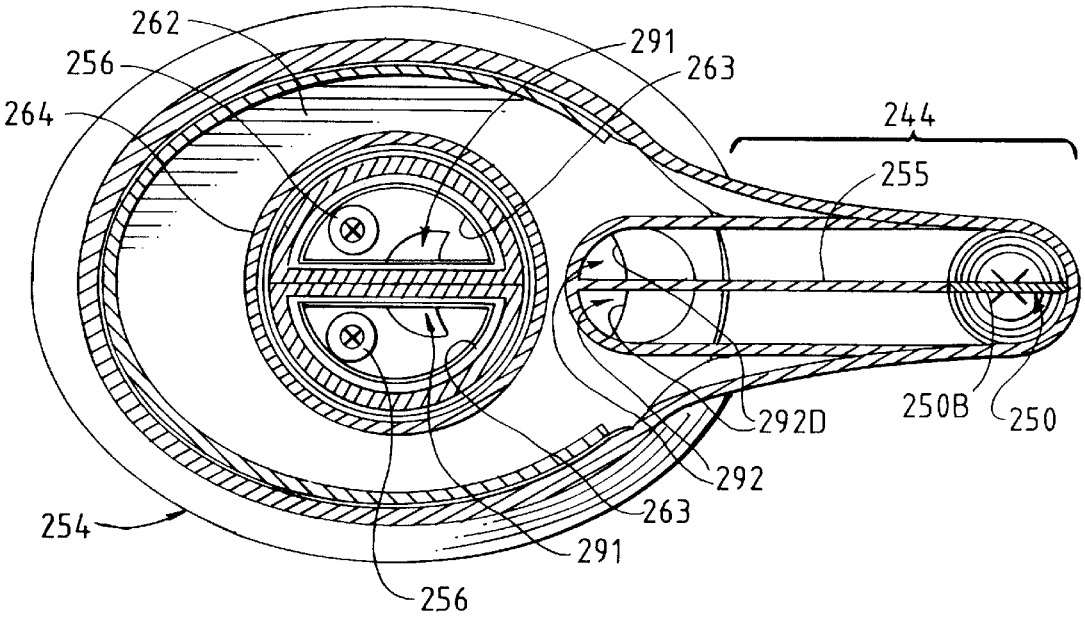
FIG. 56 is a cross-sectional view taken generally along the plane 56—56 in FIG. 52.
Figure 57:
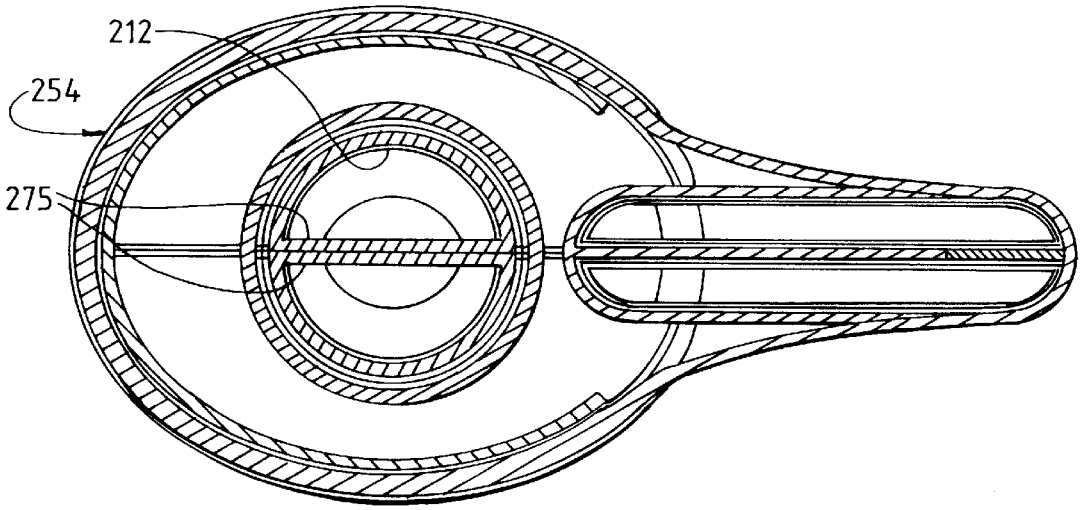
FIG. 57 is a cross-sectional view taken generally along the plane 57—57 in FIG. 52.
Figure 61:
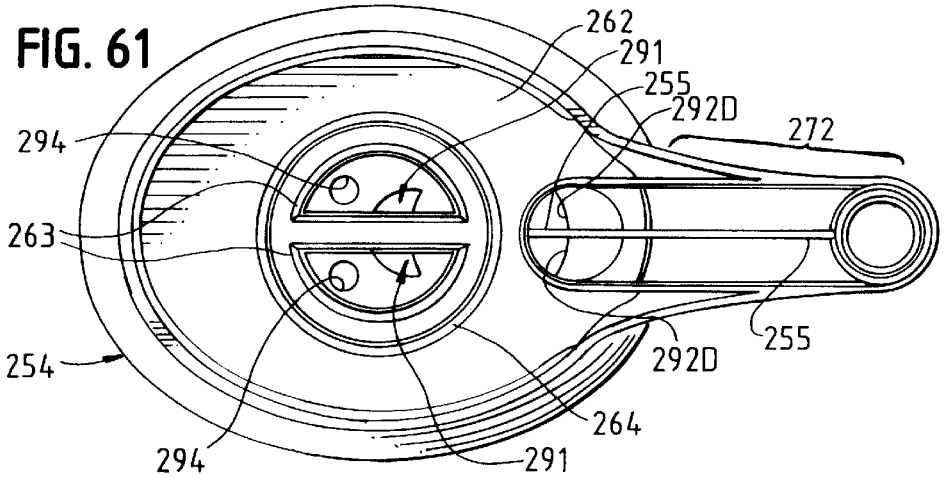
FIG. 61 is a top plan view taken generally along the plane 61—61 in FIG. 60.

As illustrated in FIGS. 48 and 61, the base component 254 includes a horizontal cross wall or deck 262 from which the annular mounting wall 264 projects upwardly for receiving the container 204. Within the mounting wall 264 are a pair of D-shaped seal walls 263. As can be seen in FIG. 61, within each D-shaped wall 263, the deck 262 defines a vent valve receiving aperture 294 and an inlet opening 291. As can be seen in FIGS. 48 and 56, a vent valve 256 is mounted in each aperture 294 in the deck 262.

Figure 60:
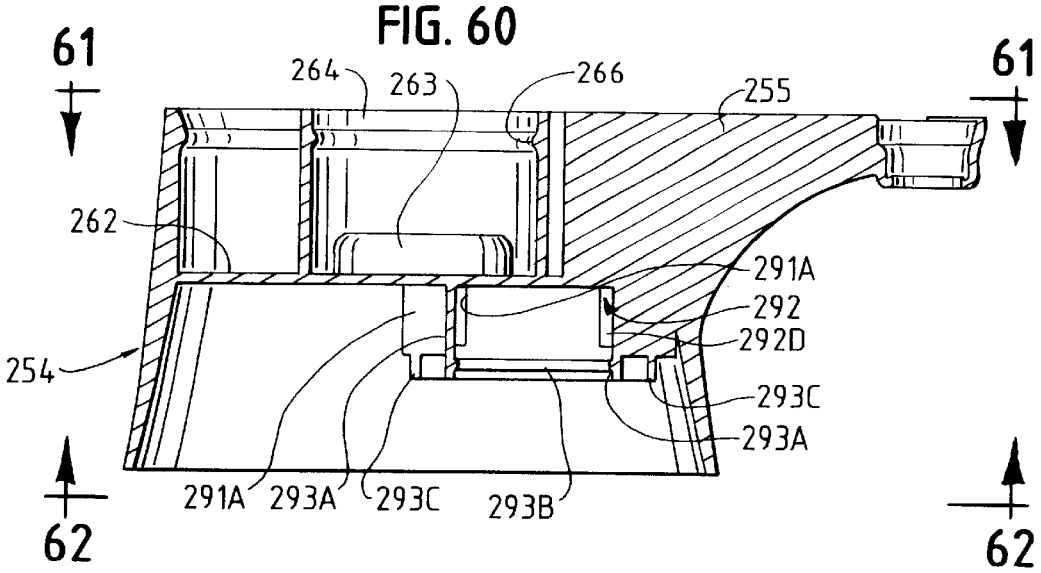
FIG. 60 is a cross-sectional view of the base component shown in FIG. 38 with the plug component and vent valves removed.
Figure 62:
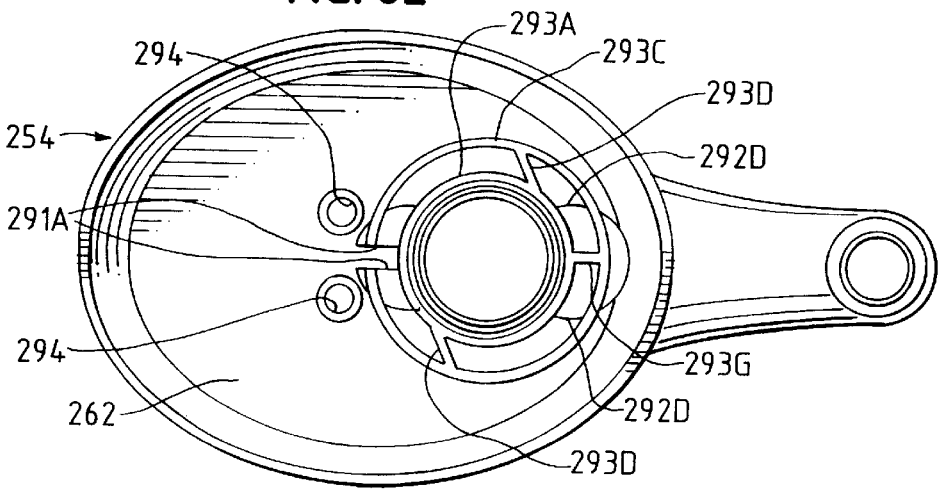
FIG. 62 is a bottom plan view taken generally along the plane 62—62 in FIG. 60.

As shown in FIGS. 60 and 62, the base component 254 defines a cylindrical inner wall 293A and a cylindrical outer wall 293C which each projects downwardly from the deck 262. As shown in FIG. 62, the outer wall 293C is interrupted by a notch adjacent the vent valve apertures 294. Also, the upper part of the outer wall 293C is interrupted by a pair of spaced-apart pocket wall structures 291A (FIGS. 60 and 62) each defining a cavity that communicates at the top with one of the deck inlet openings 291 and communicates laterally through an opening in the inner annular wall 293A with the interior of the annular wall 293A.

As shown in FIG. 62, the outer wall 293C and inner wall 293A are connected by a pair of slanted ribs 293D and by la third rib 293G.

As shown in FIG. 60, the support base component 254 includes a snap-fit bead 293B on the downwardly projecting wall 293A. The bead 293B is adapted to effect a snap-fit engagement with the plug component 258 as shown in FIG. 48. The plug component 258 is illustrated in detail in FIGS. 43–47 and is similar to the first embodiment plug component 158 described above with reference to the first embodiment illustrated in FIGS. 1–37. The second embodiment plug component 258 includes a pair of spaced-apart wall members 258B projecting from a base region which defines a receiving groove 158C for receiving in snap-fit engagement the bead 293B of the support base component 254 as shown in FIG. 48. The second embodiment plug component spaced-apart members 258B define a flow channel between them which is divided by a central divider plate 258F. The divider plate 258F functions to keep the two constituent fluent materials separated as they flow from the container 204 through the base support 202.

Figure 44:
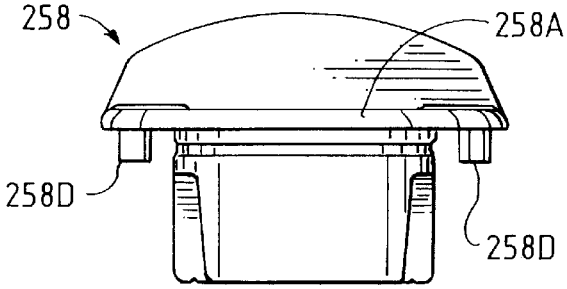
FIG. 44 is a side elevational view of the plug component shown in FIG. 43.
Figure 45:
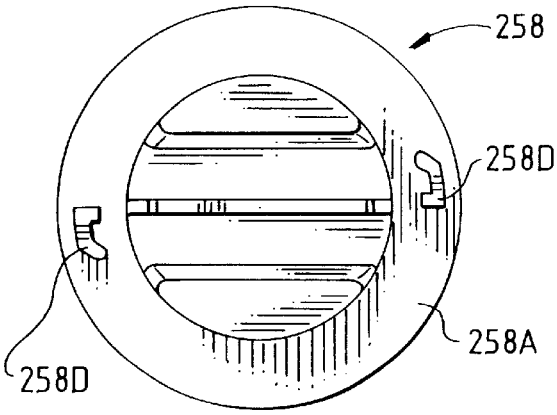
FIG. 45 is a bottom plan view of the plug component shown in FIGS. 43 and 44.
Figure 46:
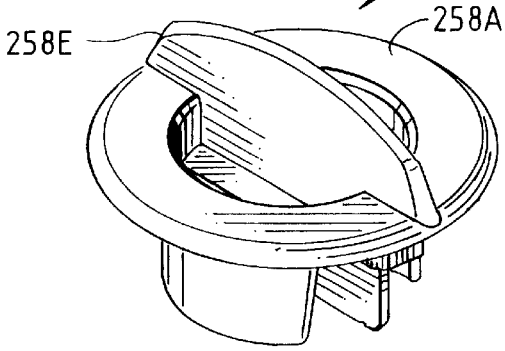
FIG. 46 is a perspective view of the plug component shown in FIG. 43.
Figure 47:
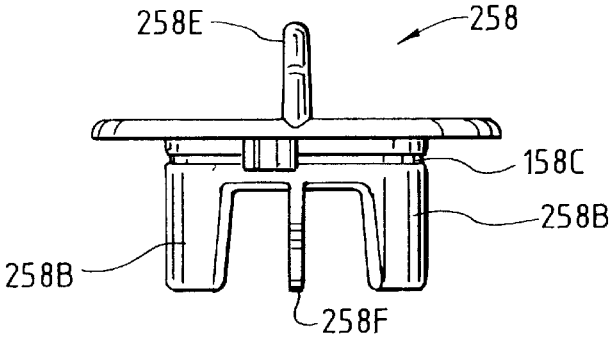
FIG. 47 is an end elevational view of the plug component shown in FIG. 43.
Figure 51:
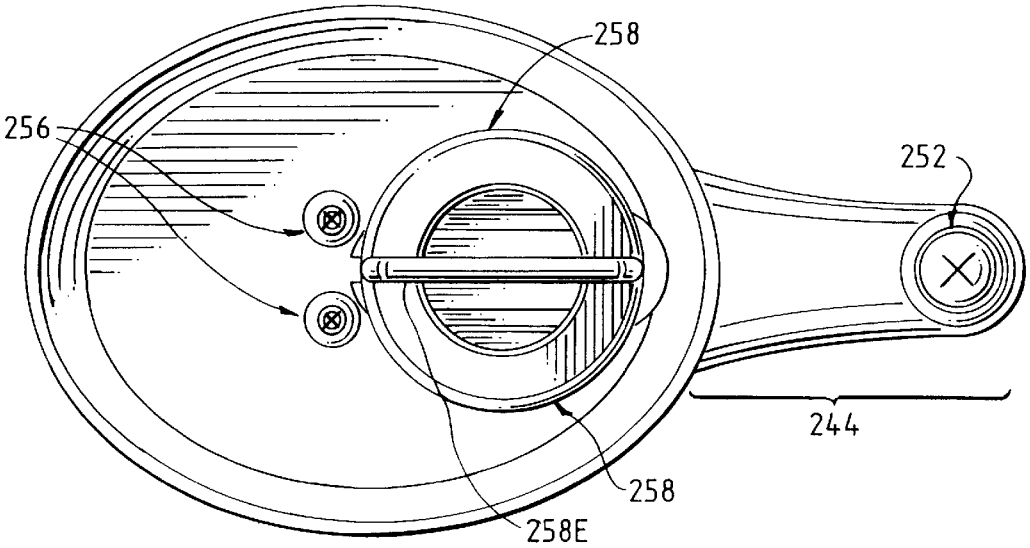
FIG. 51 is a bottom plan view taken generally along the plane 51—51 in FIG. 50.
Figure 52:
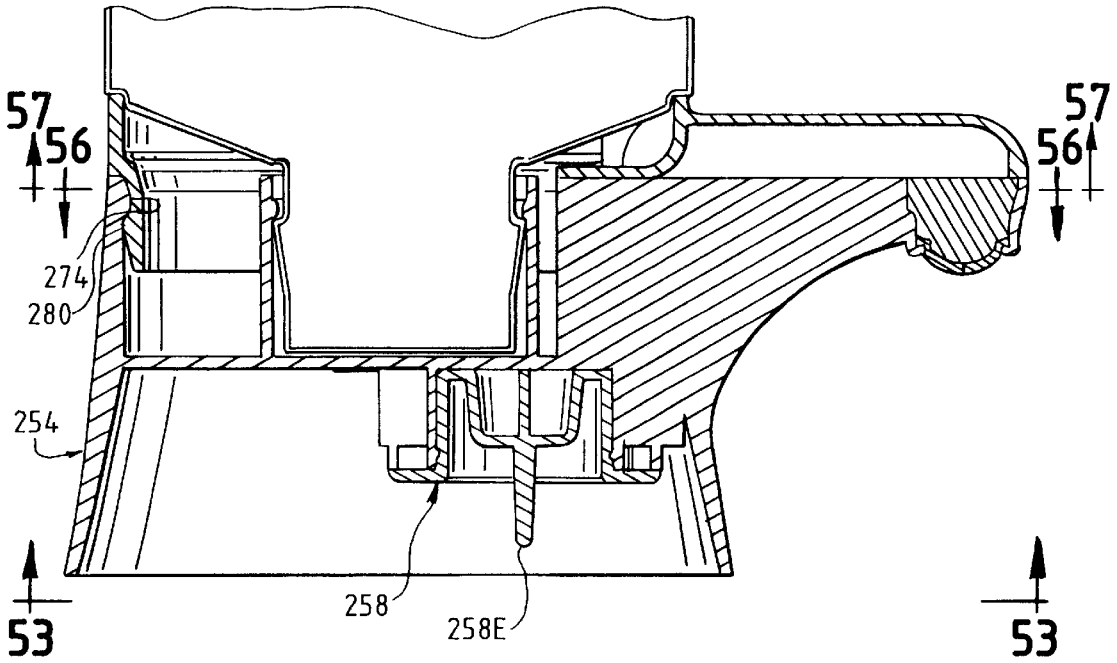
FIG. 52 is a view similar to FIG. 50, but FIG. 52 shows the plug component rotated 90 degrees in the closed orientation.
Figure 53:
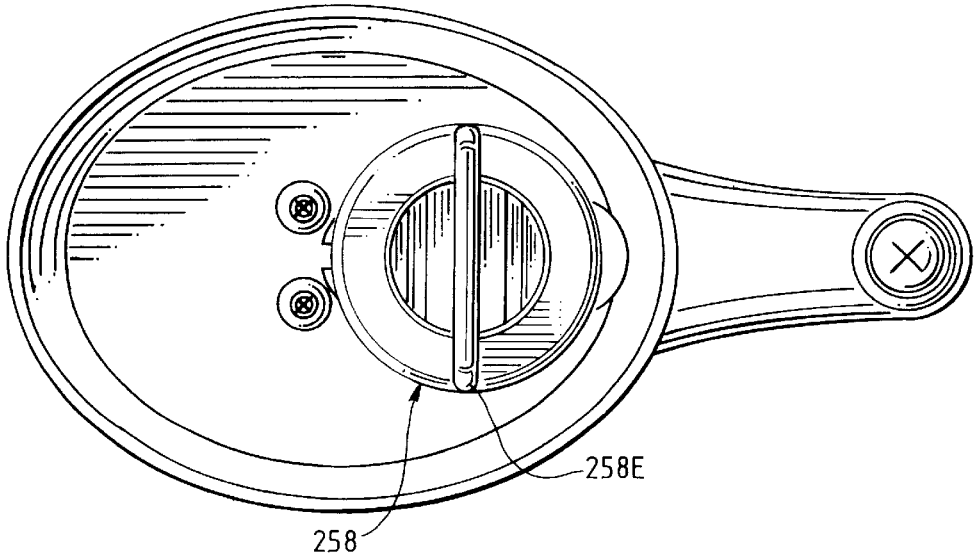
FIG. 53 is a bottom plan view taken generally along the plane 53—53 in FIG. 52.

The plug component 258 also includes a tab 258E (FIG. 46) which can be grasped by the user to rotate the plug component 258 between the open orientation illustrated in FIGS. 50 and 51 and the closed orientation illustrated in FIGS. 52 and 53. The plug component 258 also includes a flange 258A (FIG. 46) from which project a pair of lugs 258D (FIGS. 44 and 45). The lugs 258D function to limit the rotation of the plug component 258 at the open orientation and closed orientation. Specifically, with reference to FIG. 62, the two ribs 293D in the bottom of the support base component 254 are each adapted to be engaged by one of the two lugs 258D on the plug component 258 when the plug component 258 is in the closed orientation (FIGS. 52 and 53). When the plug component 258 is rotated 90 degrees to the open orientation (FIGS. 50 and 51), one of the two lugs 258D on the plug component 258 engages the third rib 293G (FIG. 62) which extends between the inner wall 293A and outer wall 293C. Thus, the combination of the plug component lugs 258D in the base component ribs 293D and 293G function as limit stops and define the rotational limit of the plug component 258 between the open and closed orientations.

When the plug component 258 is in open orientation as illustrated in FIGS. 48 and 50, the plug component directs the two fluent materials in parallel from the inlet openings 291 (FIG. 56) forwardly on either side of the plug component divider wall 258F (FIG. 55) toward the spout 244 (FIG. 56). As shown in FIGS. 61 and 62, the base component 254 includes a pocket wall structure 292D which is divided by a wall 255 to define two cavities which each communicates laterally through an opening in the annular wall 293A with the interior of the annular wall 293A and which each communicates upwardly, through one of two outlet apertures or openings 292 (FIGS. 56 and 60), with the spout 244 (FIG. 56). Thus, when the plug component 258 is in the open orientation, the two flow channels defined by the plug component walls 258B and divider plate 258F (FIGS. 47 and 55) will direct the flow through the plug component 258 and through the openings 292 into the spout 244 on the downstream side of the plug component 258.

Figure 38:
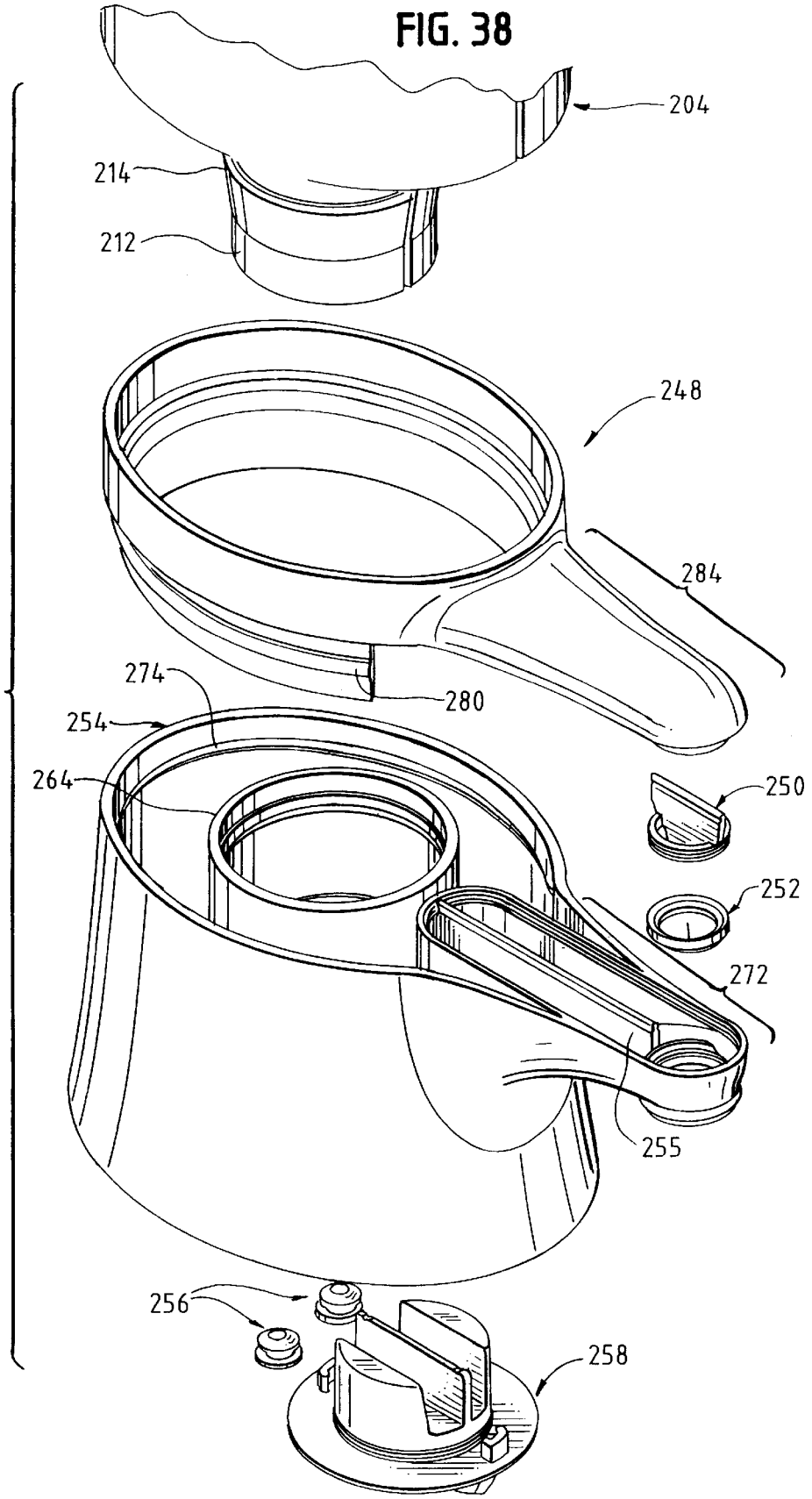
FIG. 38 is an exploded, fragmentary, perspective view of a second embodiment of the support base of the present invention shown with a container that is not initially provided with a refill valve.
Figure 39:
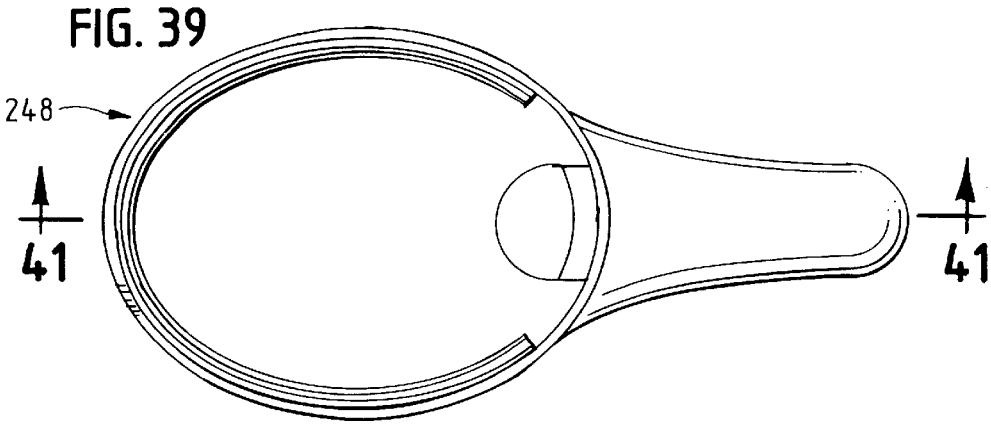
FIG. 39 is a top plan view of the top component of the second embodiment of the support base shown in FIG. 38.
Figure 40:
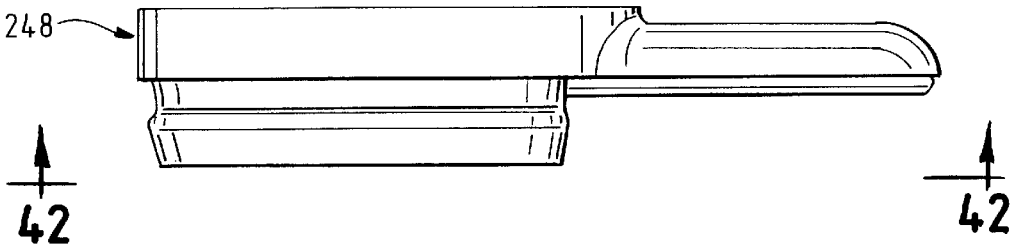
FIG. 40 is a side elevational view of the top component shown in FIG. 39.
Figure 41:
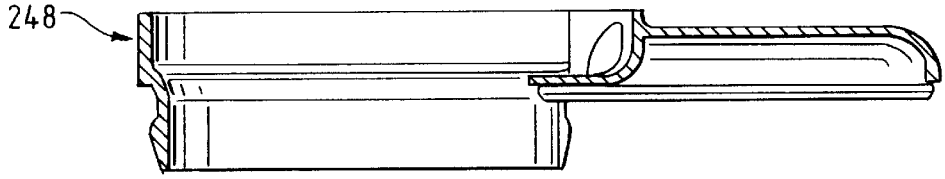
FIG. 41 is a cross-sectional view taken generally along the plane 41—41 in FIG. 39.
Figure 58:
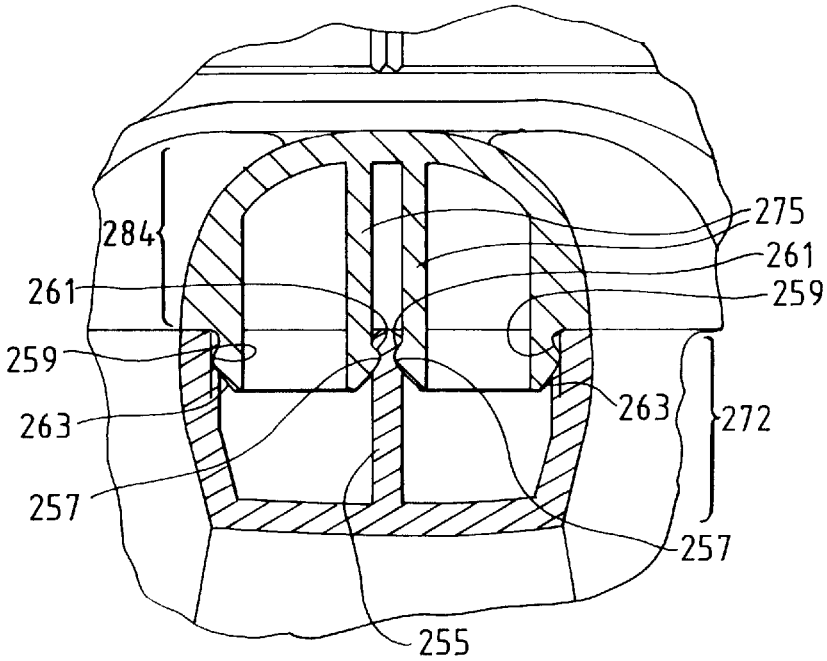
FIG. 58 is a greatly enlarged, fragmentary, cross-sectional view taken generally along the plane 58—58 in FIG. 50.

As shown in FIGS. 38 and 61, the outlet opening 292 communicates upwardly with the base component spout lower portion 272 which includes an extension of the divider wall 255. As shown in FIG. 58, the upper edge of the divider wall 255 defines a pair of oppositely facing grooves 257, and the inside surfaces of the base component spout lower portion 272 also define longitudinal grooves 259. As shown in FIG. 58, the grooves 257 are adapted to receive, in snap-fit engagement, beads 261 which are defined on the bottom edges of the top component spout upper portion divider walls 275. The exterior walls of the top component spout upper portion 284 (FIG. 58) also define beads 263 along their lower edges for effecting a snap-fit engagement with the base component spout lower portion grooves 259.

Rearwardly of the spout, the upper edge of the base component 254 has a bead 274 (FIG. 38) for engaging a bead 280 (FIG. 38) on the bottom edge of the top component 248 to form a snap-fit engagement as shown in FIG. 52.

Figure 59:
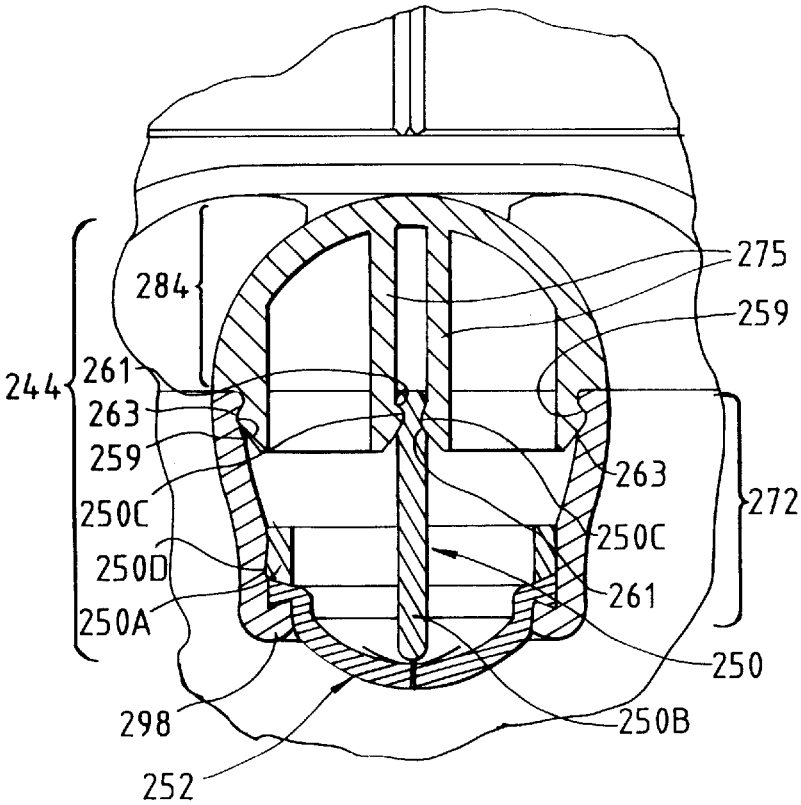
FIG. 59 is a greatly enlarged, cross-sectional view taken generally along the plane 59—59 in FIG. 50.
Figure 62A:
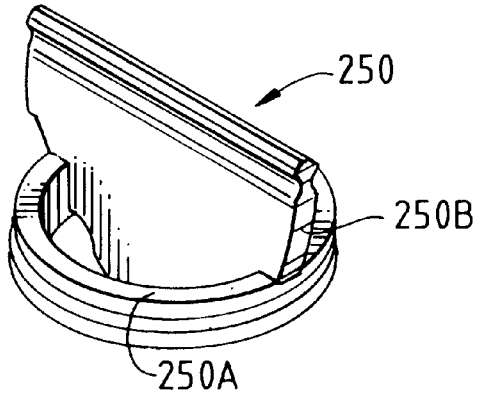
FIG. 62A is a perspective view of the dispensing valve-retaining ring or member employed with the second embodiment of the dispensing system illustrated in FIGS. 38–62.
Figure 62B:
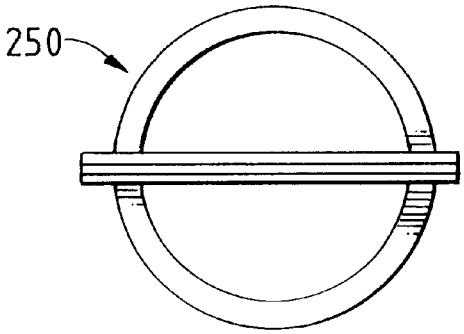
FIG. 62B is a top plan view of the valve-retaining member shown in FIG. 62A.
Figure 62C:
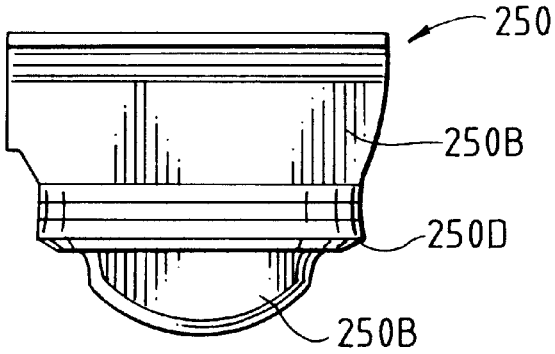
FIG. 62C is a side elevational view of the valve-retaining member shown in FIG. 62A.
Figure 62D:
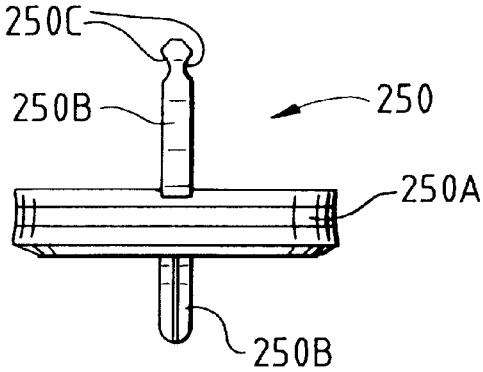
FIG. 62D is an end elevational view of the valve-retaining member shown in FIG. 62A.
Figure 62E:
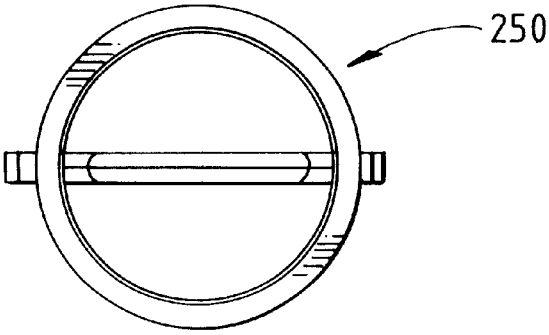
FIG. 62E is a bottom plan view of the valve-retaining member shown in FIG. 62A.

As shown in FIGS. 38, 56, and 59, the distal end of the spout 244 includes a retaining ring or member 250 which is illustrated in more detail in FIGS. 62A, 62B, 62C, 62D, and 62E. With reference to FIG. 62A, the retaining member 250 includes an annular portion 250A and a central divider wall 250B. As shown in FIGS. 62C and 62D, the divider wall 250B extends both above and below the annular portion 250A. The top edge of the divider wall 250B defines a pair of oppositely facing grooves 250C (FIG. 62D) for receiving the beads 261 of the top component spout upper portion interior divider walls 275 as shown in FIG. 59.

As shown in FIG. 62C, the lower edge of the retaining ring annular portion 250A flairs outwardly somewhat at 250D to provide a protuberance which, as shown in FIG. 59, is received in snap-fit engagement with the interior surfaces of the support base component spout lower portion 272 so as to hold the valve retaining ring or member 250 within the spout on top of the dispensing valve 252.

The second embodiment dispensing valve 252 (FIGS. 38 and 59) has substantially the same configuration as the first embodiment dispensing valve 152 described above with reference to FIG. 27. The second embodiment dispensing valve 252 has a lateral margin or flange with a dovetail cross section that is clamped between (1) the annular portion 250A of the valve retaining member 250 on the top, and (2) a flange 298 on the bottom of the spout 244 which defines a dispensing aperture or discharge aperture occupied by the normally closed valve 252.

The second embodiment of the dispensing system described above with reference to FIGS. 38–62E is thus seen to define a divided flow system for accommodating the flow of two constituent fluent materials from the container 204 which are combined or commingled upon discharge from the dispensing valve 252. Each material or constituent may be the type of substance which, when mixed the other constituent, reacts to form a combination product that is best used relatively quickly (e.g., a foaming cleaning product). Each constituent material could be a fluent product, such as a liquid, particulate matter, cream, or the like. The constituents could be components of a comestible product, personal care product, industrial or household cleaning product, or other chemical composition (e.g., compositions for use in activities involving manufacturing, commercial or household maintenance, construction, agriculture, etc.).

Although the illustrated second embodiment dispensing system (FIGS. 38–62E) does not include a refill valve like the refill valve 110 of the first embodiment (FIGS. 1–37), the process of dispensing of the two constituent materials from the container 204 through the dispensing system is effected in generally the same way that the single fluent material is dispensed from the first embodiment as described above with reference to FIGS. 1–37. The alternate methods for pressurizing the first embodiment container 104 as described above are also applicable to pressurizing the second embodiment container 204. The alternate ways of using, refilling, and operating the first embodiment dispensing system as described above may also be employed with the second embodiment dispensing system illustrated in FIGS. 38–62E. Features or elements of the second embodiment of the dispensing system illustrated in FIGS. 38–62E which are identical, similar, or analogous to the features or elements of the first embodiment of the dispensing system illustrated in FIGS. 1–37 may be modified or eliminated in generally the same manner as described with respect to the first embodiment.

A third embodiment of the dispensing system is illustrated in FIGS. 63–84. The third embodiment includes many features which are identical, similar, or analogous to features of the first embodiment described above with reference to FIGS. 1–37. The elements or features of the first embodiment have been designated with reference numbers in the 100 series. The reference numbers for the third embodiment are in the 300 series. The elements of the third embodiment which are identical, similar, or functionally analogous to the elements of the first embodiment employ the same last two digits as used for the reference numbers of the first embodiment elements.

In the third embodiment, a container 304 (FIGS. 63, 75, and 79) is provided for holding fluent product and has substantially the same configuration as the first embodiment container 104. In the third embodiment, the container 304 does not have a transition fitment or refill valve, such as the transition fitment 108 and refill valve 110 illustrated for the first embodiment in FIGS. 3 and 6.

The third embodiment includes a top component 348 (FIGS. 69–74) which is substantially similar to the top component 148 of the first embodiment described above with reference to FIG. 16. The second embodiment top component 348 is adapted to be mounted in a snap-fit engagement into the upper portion of a base component 354 which is generally similar to the first embodiment base component 154. The assembly of the top component 348 and base component 354 define the support base 302 (FIG. 75) for supporting the container 304 in an inverted orientation in generally the same manner that the first embodiment container 104 is supported in the first embodiment support base 102 as described above with reference to FIGS. 1–37.

Figure 67:
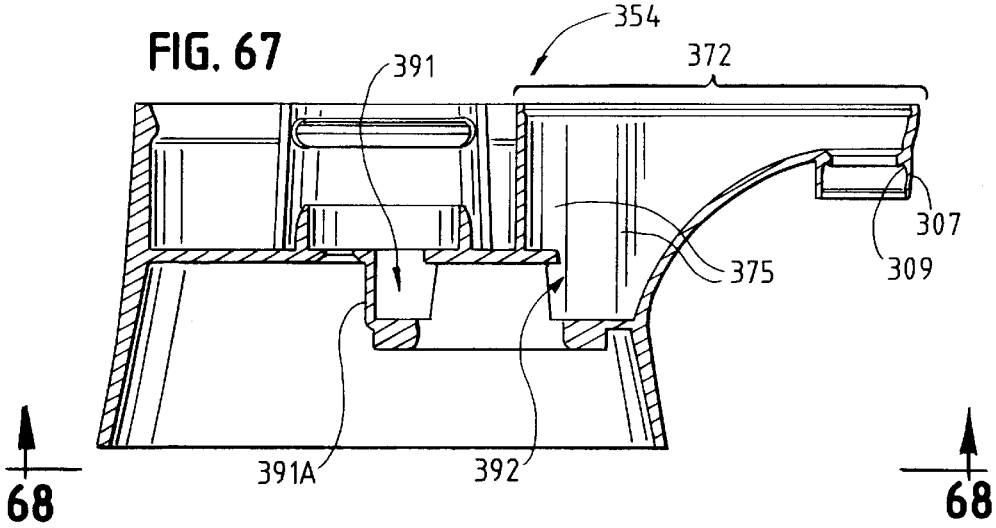
FIG. 67 is a cross-sectional view taken generally along the plane 67—67 in FIG. 66.
Figure 68:
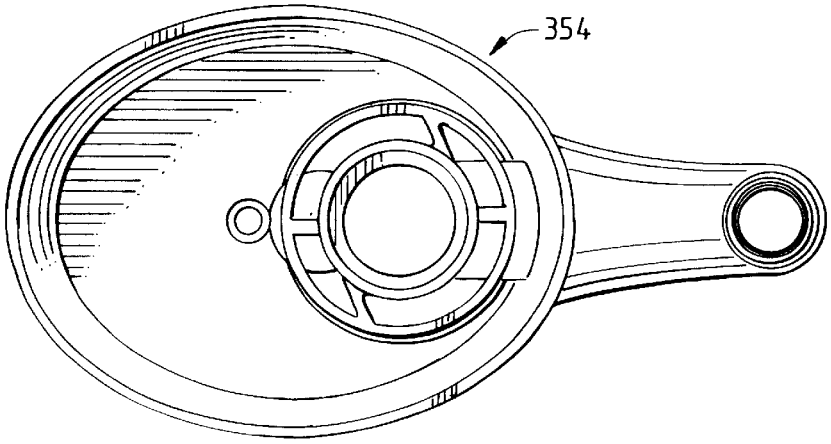
FIG. 68 is a bottom plan view taken generally along the plane 68—68 in FIG. 67.
Figure 69:
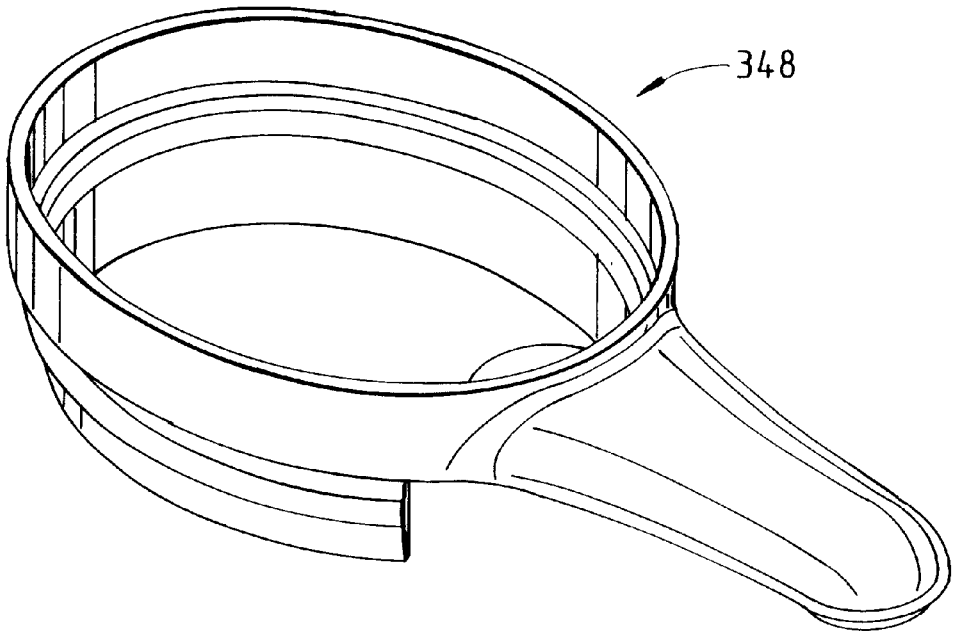
FIG. 69 is a top, perspective view of the top component of the third embodiment shown in FIG. 63.
Figure 70:
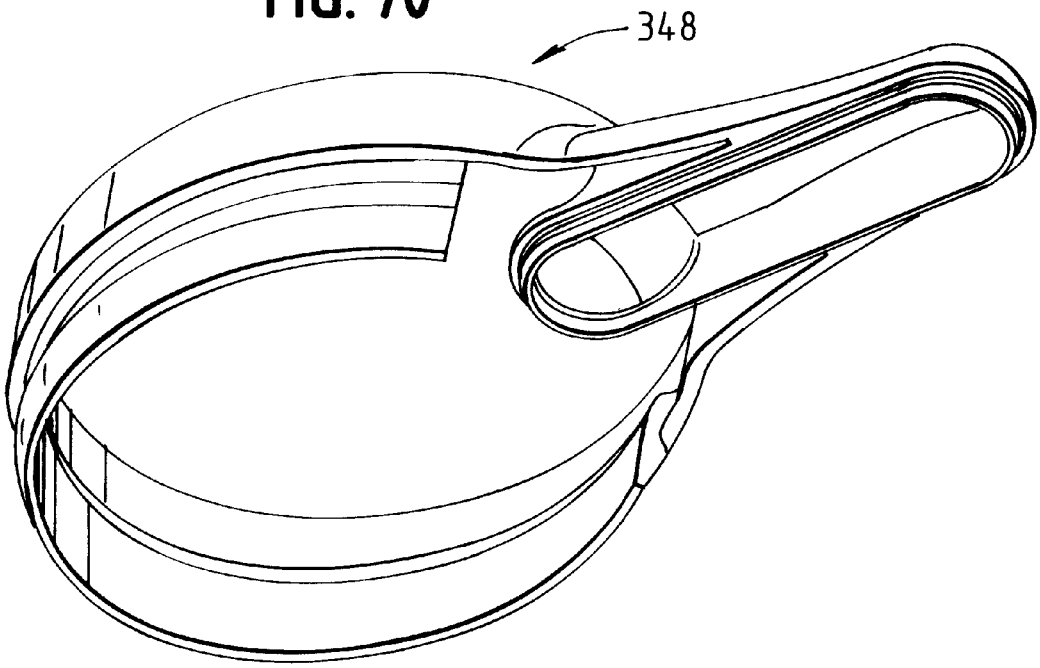
FIG. 70 is a bottom perspective view of the third embodiment top component shown in FIG. 69.
Figure 71:
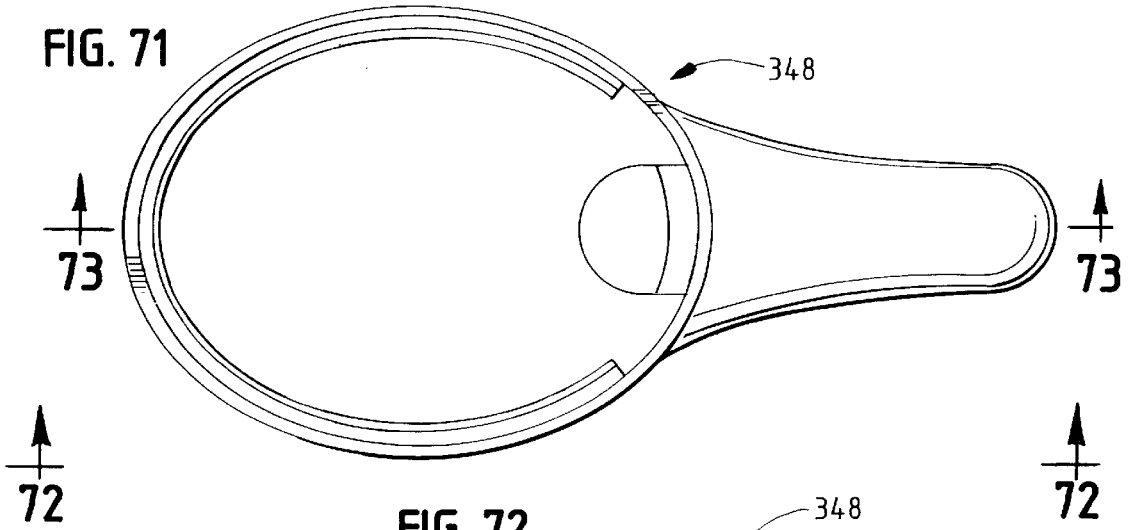
FIG. 71 is a top plan view of the third embodiment top component shown in FIG. 69.
Figure 72:
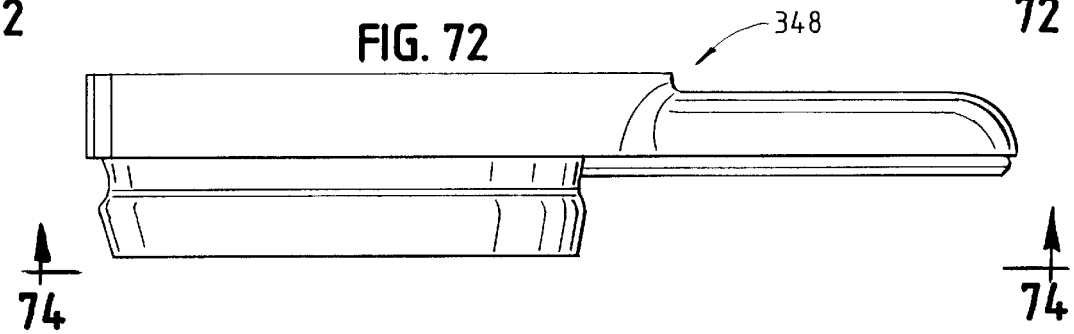
FIG. 72 is a side elevational view taken generally along the plane 72—72 in FIG. 71.
Figure 73:
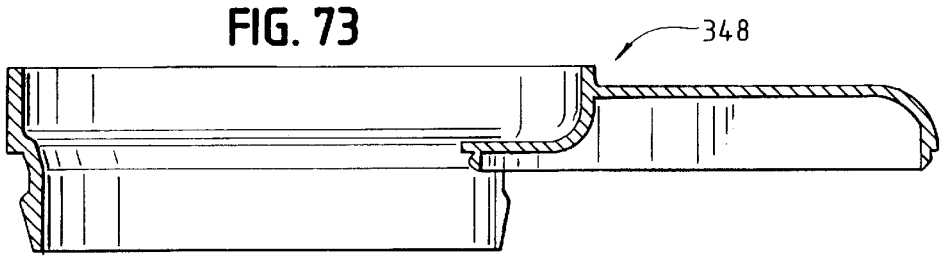
FIG. 73 is a cross-sectional view taken: generally along the plane 73—73 in FIG. 71.
Figure 74:
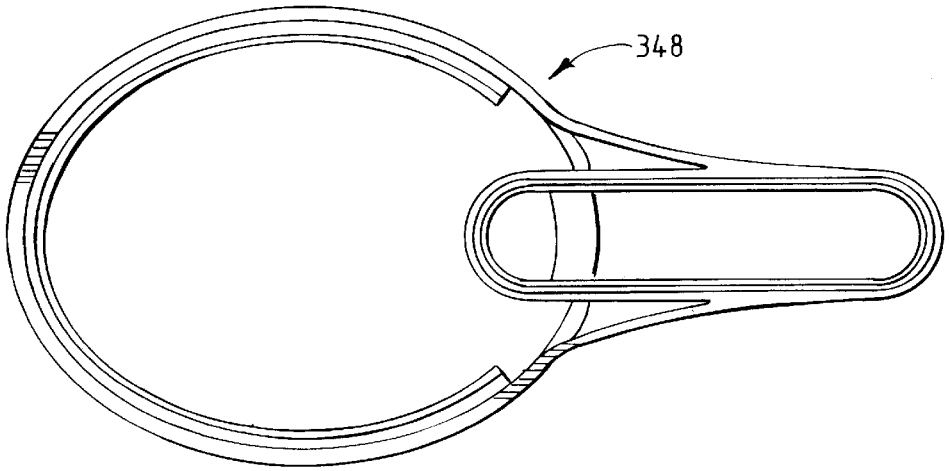
FIG. 74 is a bottom plan view taken generally along the plane 74—74 in FIG. 72.
Figure 77:
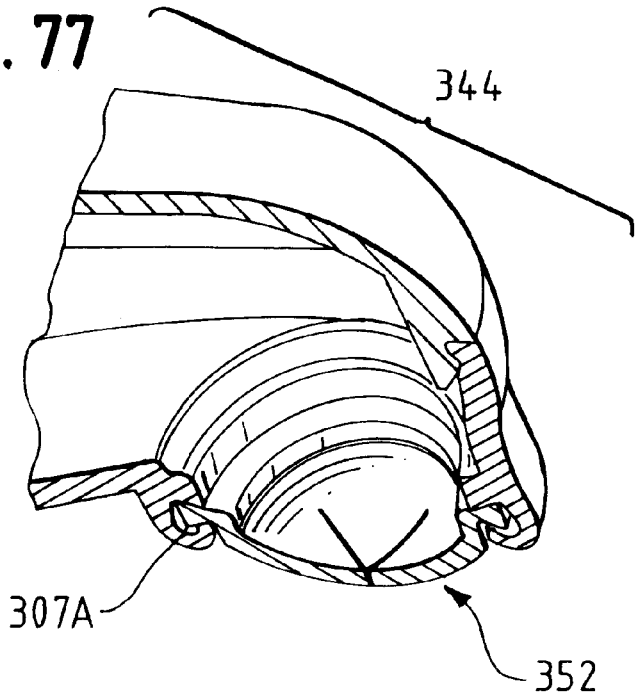
FIG. 77 is an enlarged, fragmentary, perspective view of the spout discharge structure of the assembly shown in FIG. 75.
Figure 78:
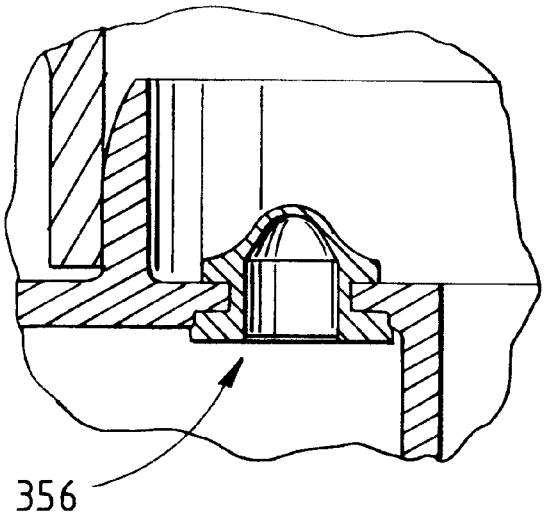
FIG. 78 is an enlarged, fragmentary, cross-sectional view of the portion of the third embodiment of the assembled components shown in FIG. 75.

There are some differences between the third embodiment base component 354 and the first embodiment base component 154. One of these differences relates to the structure at the distal end spout 344 (FIG. 75) for holding the dispensing valve 352. In particular, as can be seen in FIGS. 63, 64, 65, and 67, the base component 354 is initially molded with a dispensing opening or discharge aperture defined by a downwardly extending, relatively long flange 307. As shown in FIG. 67, the distal end of the base component 354 inwardly of the flange 307 defines an annular, frustoconical seating surface 309 for receiving the dispensing valve 352. The manufacturer initially positions the dispensing valve 352 within the downwardly extending flange 307 and against the seat 309, and the manufacturer then crimps the flange 307 upwardly to form a permanently deformed locking flange 307A (as illustrated in FIG. 77), and this securely holds the valve 352 within the spout 344. The flange 307 may be deformed upwardly in conjunction with the application of heat, such as with an ultrasonic forming process.

Figure 63:
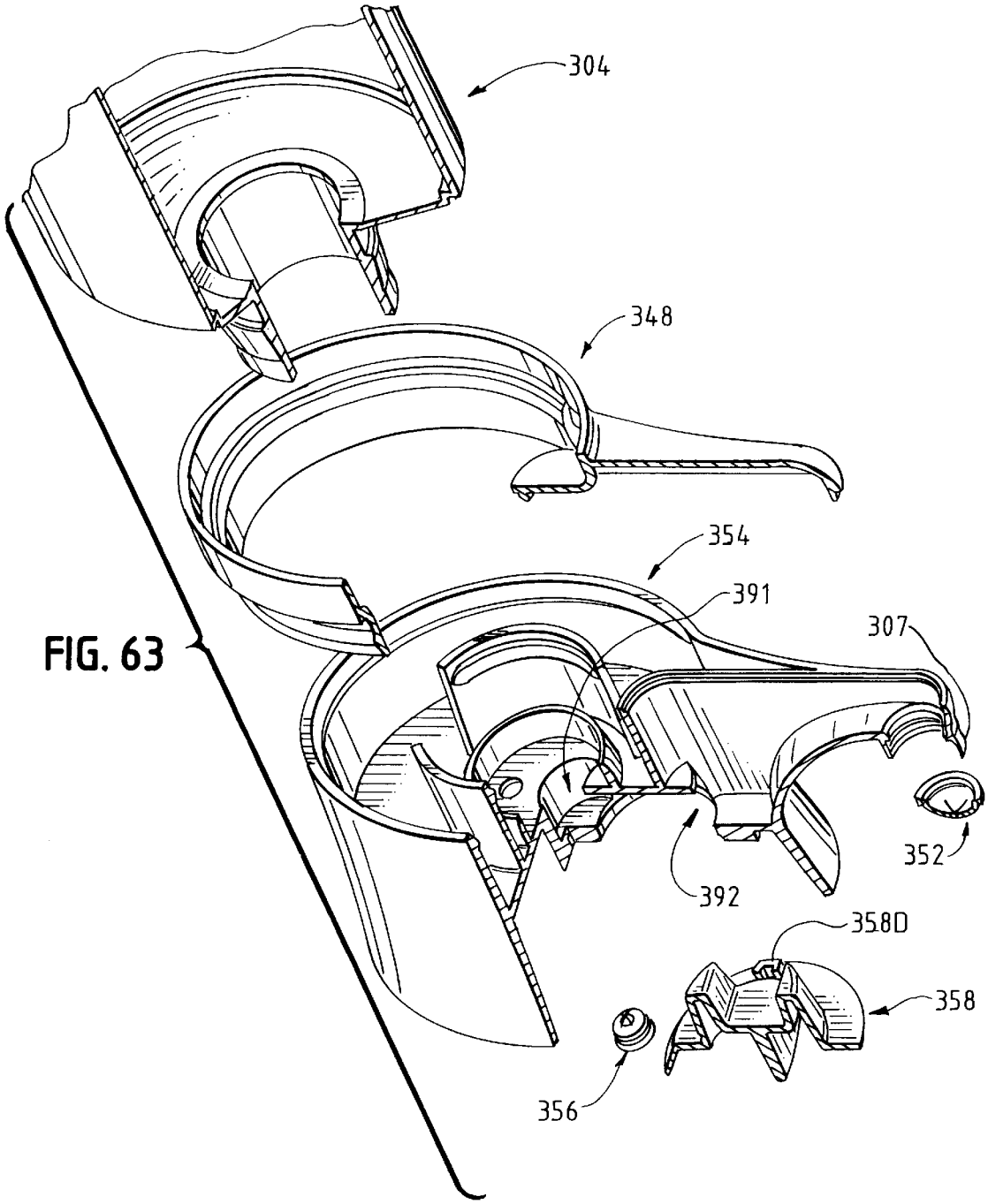
FIG. 63 is an exploded, fragmentary, partially cross-sectional, perspective view of a third embodiment of the support base components and a fluent product container.
Figure 64:
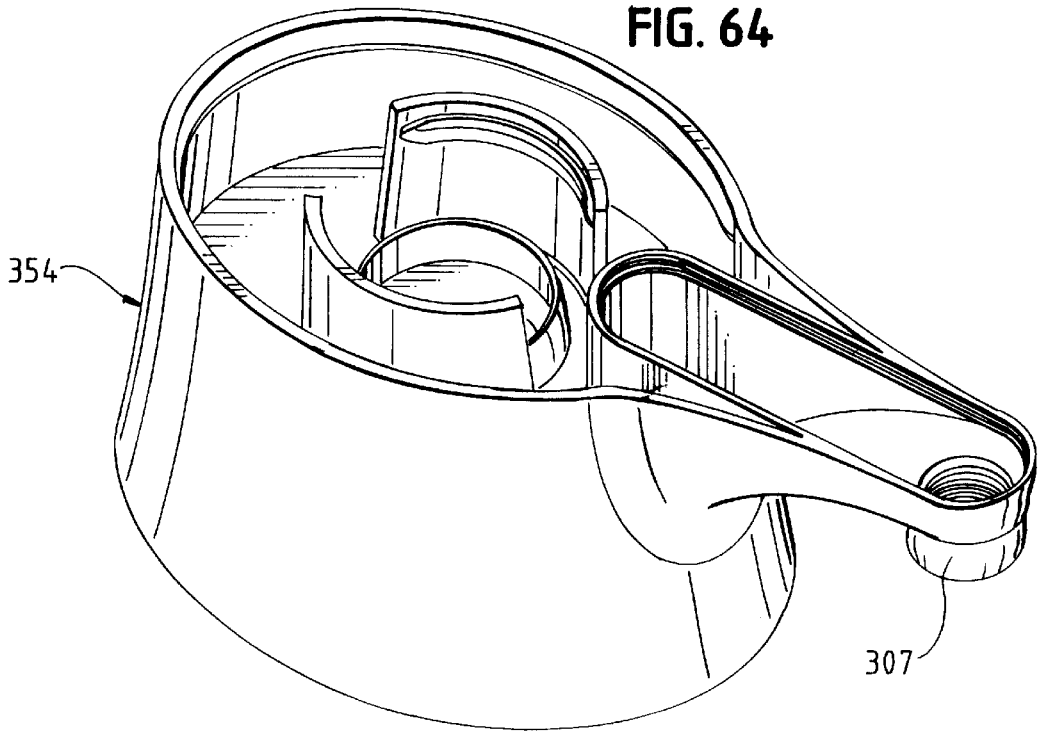
FIG. 64 is a top perspective view of the base component of the third embodiment illustrated in FIG. 63.
Figure 65:
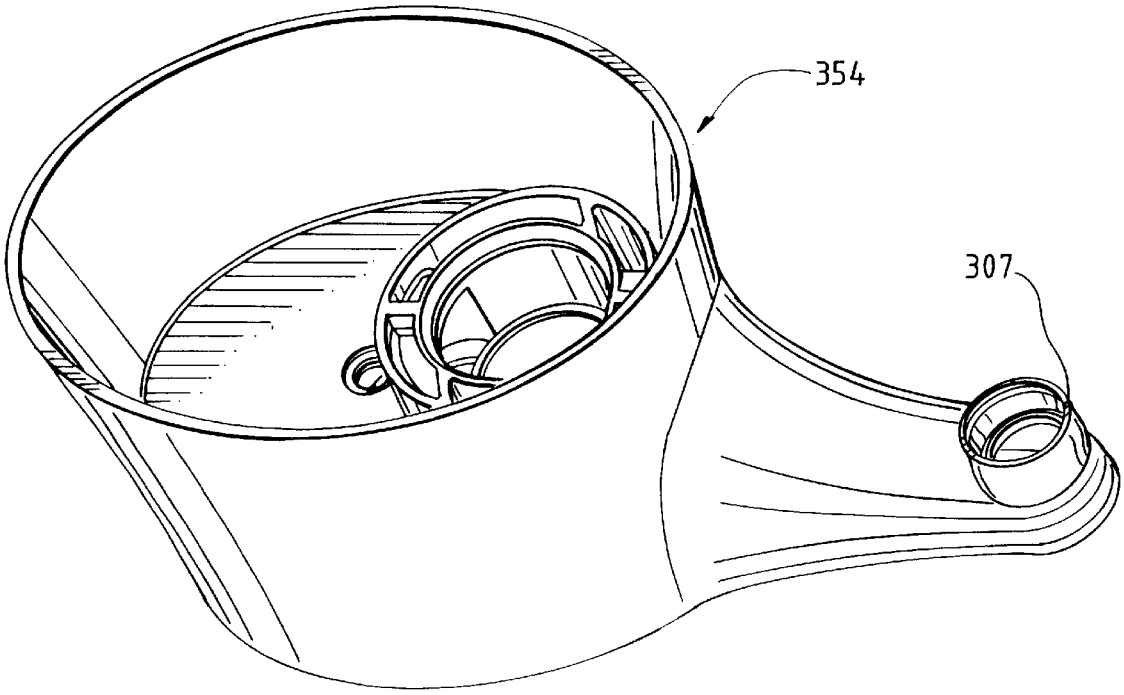
FIG. 65 is a bottom perspective view of the base component shown in FIG. 64.
Figure 66:
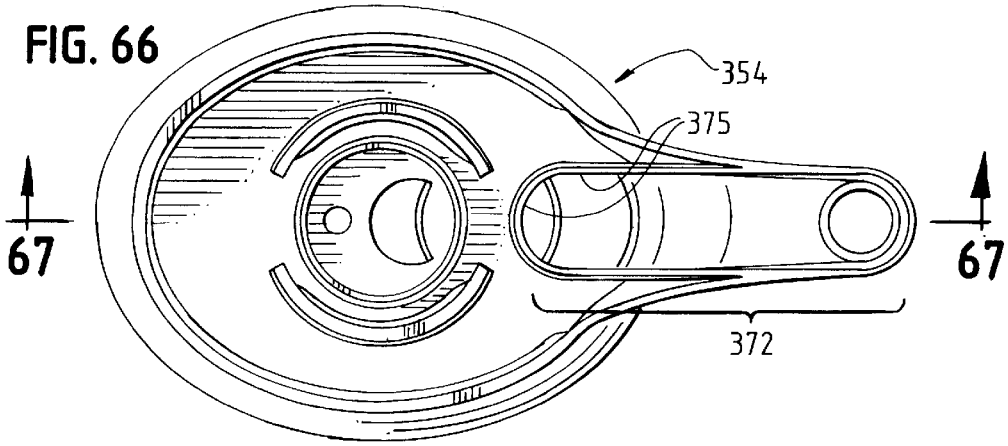
FIG. 66 is a reduced scale, top plan view of the base component shown in FIG. 64.
Figure 75:
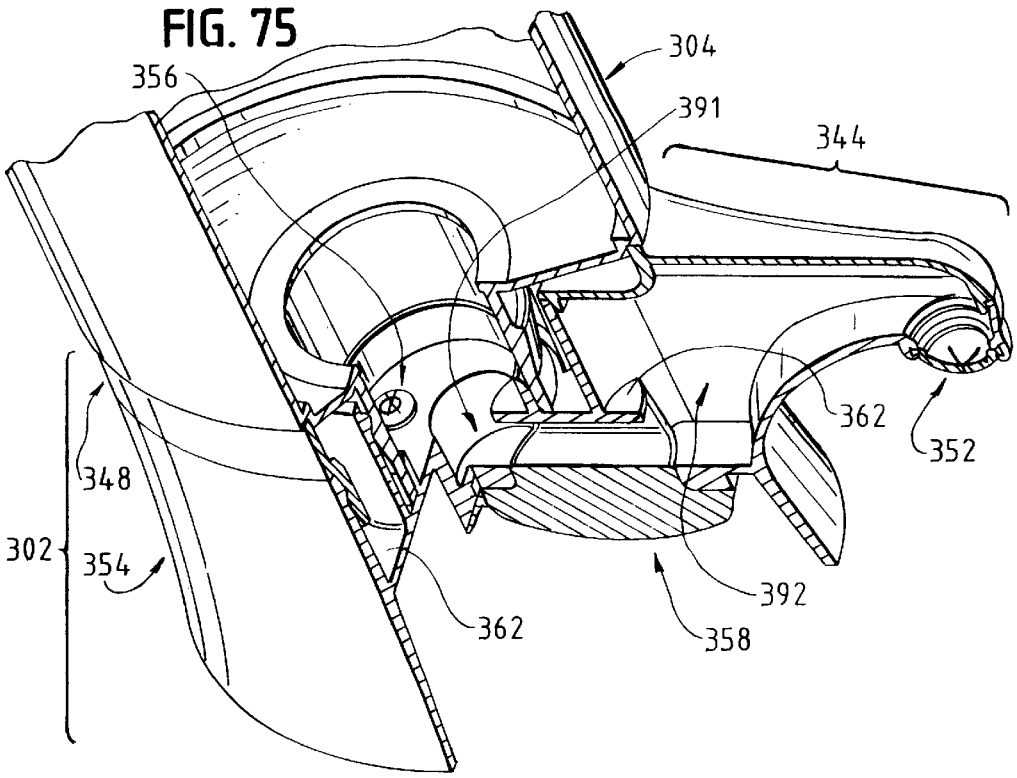
FIG. 75 is a fragmentary, partial cross-sectional, perspective view of the components of the third embodiment illustrated in FIG. 63 after the components have been fully assembled with the plug component in the open orientation.
Figure 76:
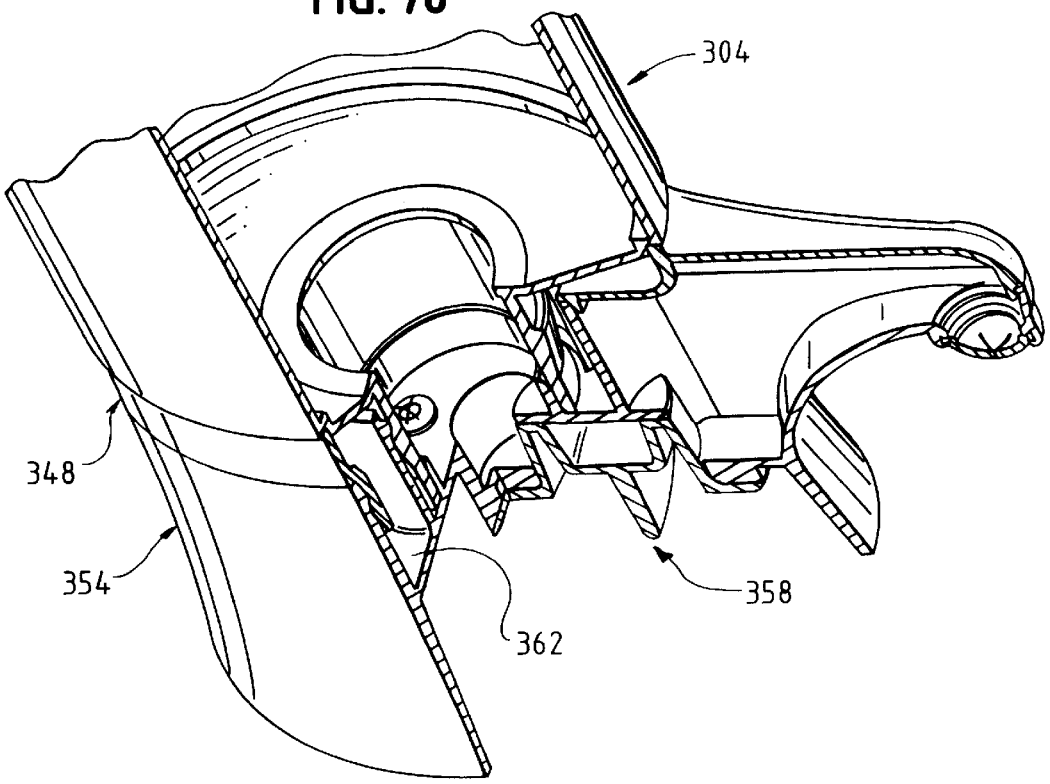
FIG. 76 is a view similar to FIG. 75, but FIG. 76 shows the plug component rotated 90 degrees in the closed orientation.

As shown in FIGS. 63 and 75, the support base component 354 is adapted to receive the vent valve 356 which is substantially identical with the first embodiment vent valve 156 described above with reference to FIGS. 1–37. The base component 354 is also adapted to receive a plug component 358 which is substantially identical with the first embodiment plug component 158 described above with reference to FIGS. 18–25.

As shown in FIG. 67, the base component 354 includes a pocket wall structure 391A defining an inlet opening 391 to the receiving cavity in which the plug component 358 is disposed (FIG. 75). The base component 354 has a lower spout portion 372 (FIGS. 66 and 67) that includes an internal U-shaped wall 374 (FIGS. 66 and 67) defining the lateral margin of the flow path through the spout. The rear end of the U-shaped wall 374 defines an outlet opening 392 (FIGS. 63, 67, and 75) which establishes communication between the spout and the plug component 358 in the open orientation.

Figure 79:
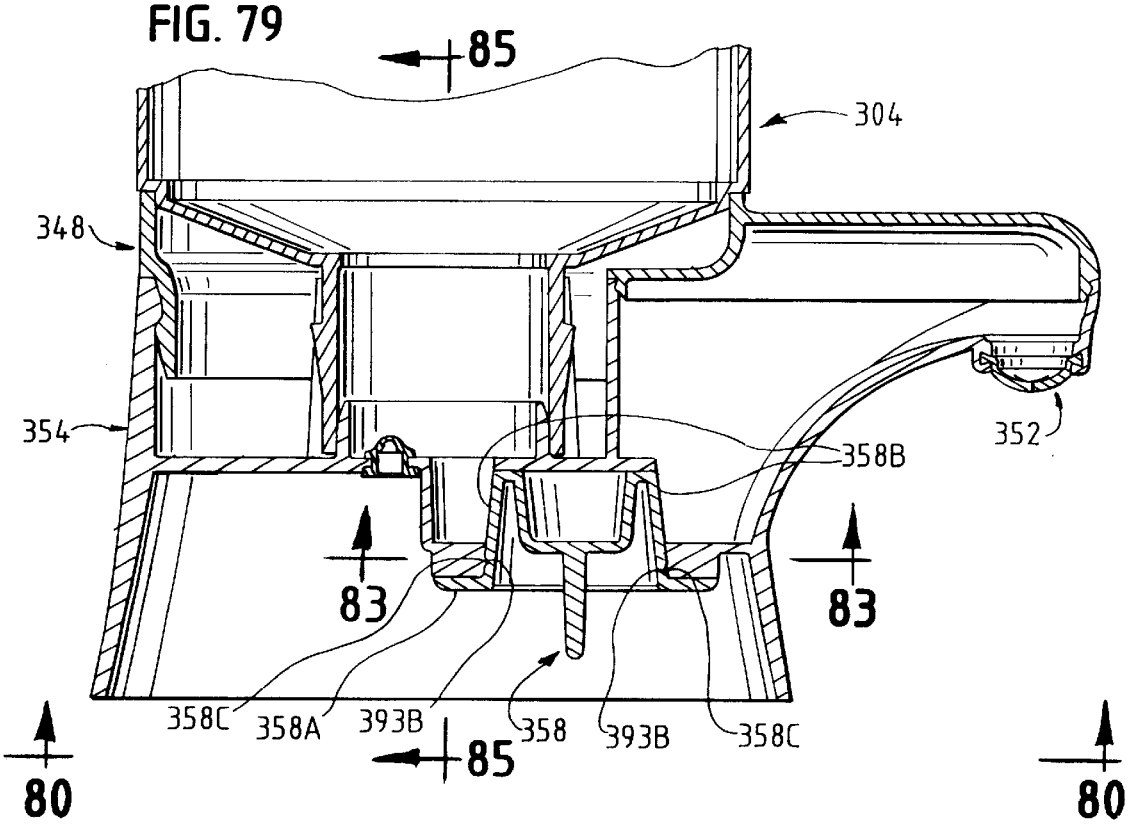
FIG. 79 is a fragmentary, cross-sectional view of the assembled components of the third embodiment shown with the plug component in the closed orientation.
Figure 80:
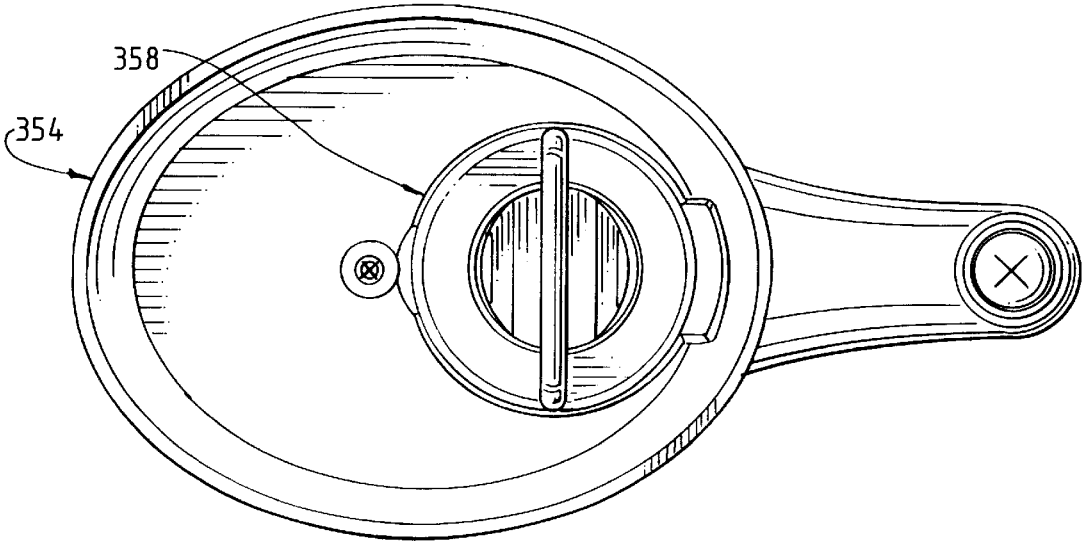
FIG. 80 is a bottom plan view taken generally along the plane 80—80 in FIG.79.
Figure 83:
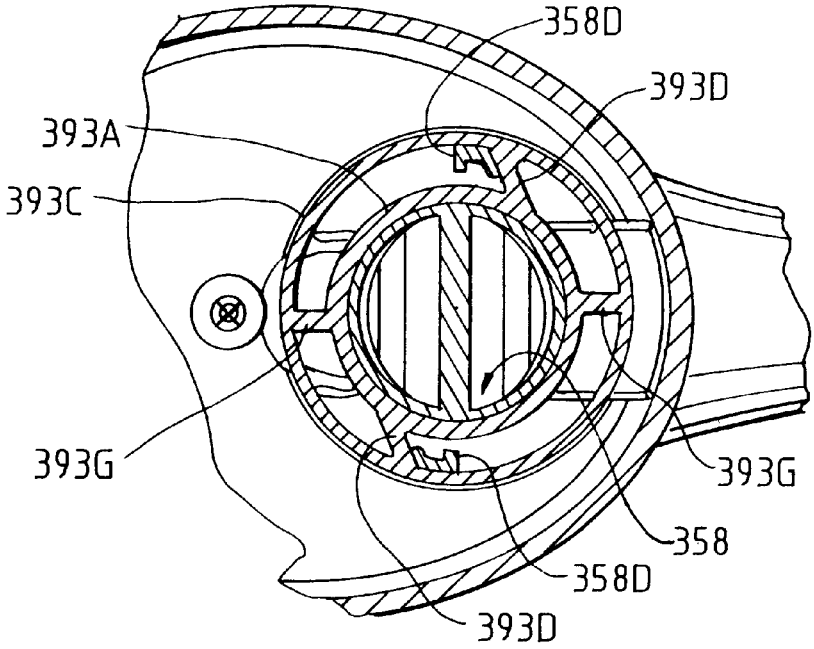
FIG. 83 is a fragmentary, cross-sectional view taken generally along the plane 83—83 in FIG. 79 to show the plug component in the closed orientation.
Figure 84:
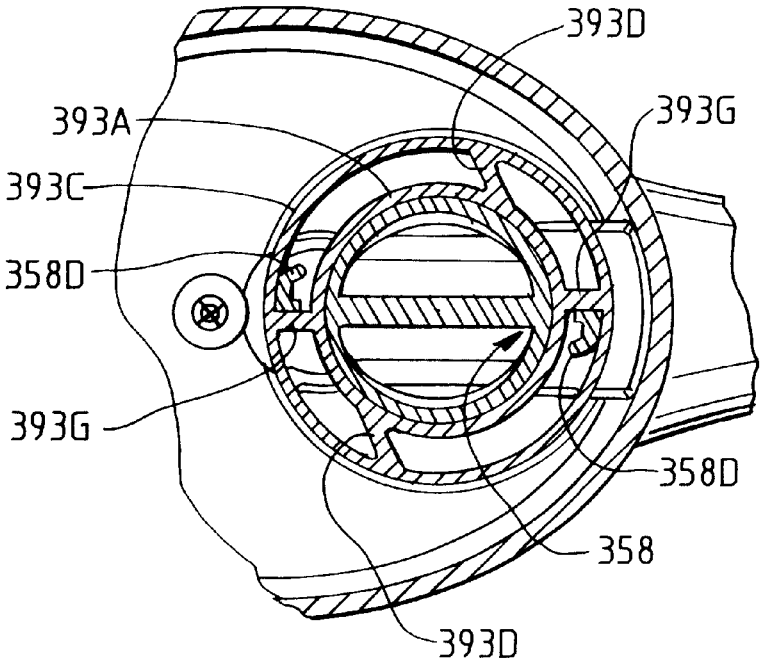
FIG. 84 is a view similar to FIG. 83, but FIG. 84 shows the plug component rotated 90 degrees in the open orientation illustrated in FIGS. 81 and 82.
Figure 85:
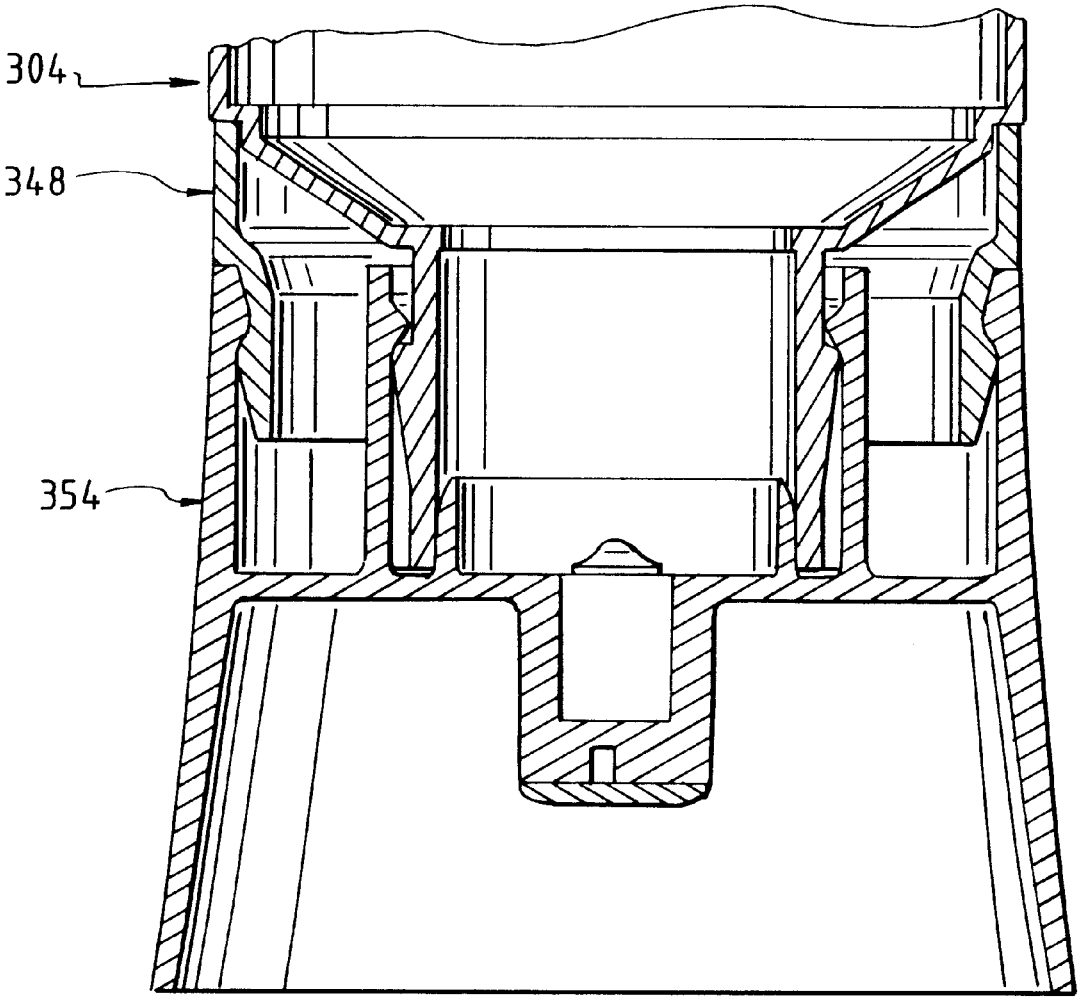
FIG. 85 is a fragmentary, cross-sectional view taken generally along the plane 85—85 in FIG. 79.

As shown FIG. 79, the plug component 358 includes a pair of spaced-apart walls 358B which define between them a flow channel and which extend upwardly from a flange 358A. Just above the flange 358A, the plug component 358 defines an annular groove 358C. The groove 358C is adapted to receive in snap-fit engagement an annular bead 393B which is defined on the inside surface of an inner annular wall 393A (FIGS. 83 and 84). The annular wall 393A is surrounded by a concentric outer annular wall 393C (FIGS. 83 and 84). With continued reference to FIGS. 83 and 84, there are two slanted ribs 393D which connect the annular walls 393A and 393C. There are also two parallel ribs 393G which are slightly offset from each other and which connect the annular walls 393A and 393C. The two ribs 393D are substantially 180 degrees apart from each other. The two ribs 393G are substantially 180 degrees apart from each other.

Figure 81:
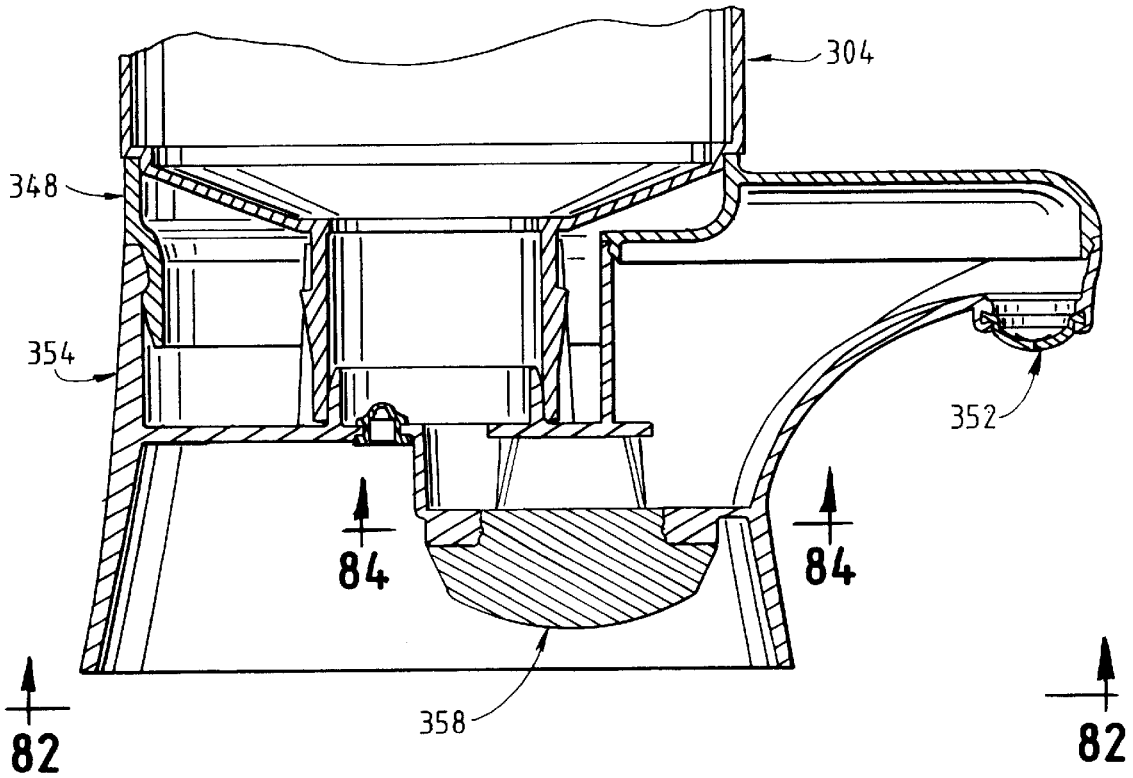
FIG. 81 is fragmentary, a cross-sectional view similar to FIG. 79, but FIG. 81 shows the plug component rotated 90 degrees in the open orientation.
Figure 82:
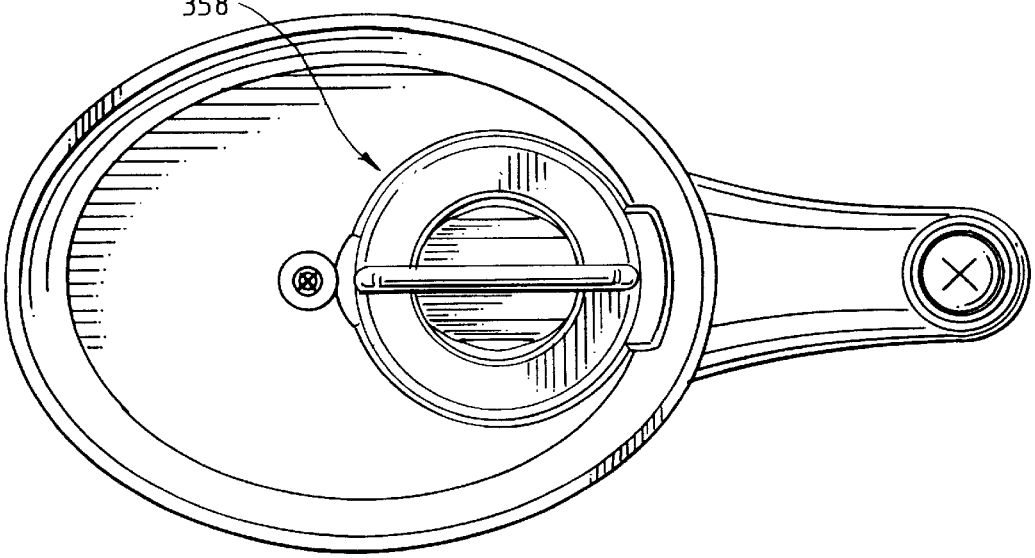
FIG. 82 is a bottom plan view taken generally along the plane 82—82 in FIG. 81.

As can be seen in FIG. 63, the plug component 358 includes a pair of lugs 358D (one of which is not visible in FIG. 63, but which is oriented 180 degrees from the visible lug 358D). FIGS. 83 and 84 show both of the plug component lugs 358D located between the base component annular walls 393A and 393C. FIG. 83 illustrates the plug component 358 in the closed orientation wherein the lugs 358D each abut a respective one of the ribs 393D. This abutting relationship defines the full closed position of the plug component 358. The user can rotate the plug component 358 substantially 90 degrees counterclockwise as viewed in FIGS. 83 and 84 to bring the plug component lugs 358D into abutting relationship with the ribs 393G, and this establishes the full open orientation of the plug component 358 which corresponds to the orientation as shown in FIGS. 81 and 82.

The third embodiment dispensing system may be operated by squeezing or otherwise pressurizing the container 304 in the same manner as described above with reference to the first embodiment illustrated in FIGS. 1–37. In one presently contemplated preferred embodiment, the user would initially receive the container 304 already attached to, and mounted in, the support base 302 (FIG. 75) as a complete package. Alternatively, because the third embodiment container 304 does not include a refill valve, such as the refill valve 110 employed in the first embodiment, the container 304 could be initially provided separately to the user with a suitable closure or overcap (not shown) which would be removed prior to inverting the container 304 and mounting it within a separately provided support base 302 as shown in FIG. 75. Otherwise, the operation of the third embodiment dispensing system is generally analogous to the operation described above with respect to the first embodiment illustrated in FIGS. 1–37. If desired, the third embodiment dispensing system illustrated in FIGS. 63–85 may include a fitment and/or refill valve, such as the fitment 108 and refill valve 110, respectively, described above for the first embodiment illustrated in FIGS. 1–37.

It will be appreciated that the third embodiment of the dispensing system may be modified in ways that are analogous to the modifications described above with respect to the first embodiment of the, dispensing system illustrated in FIGS. 1–37. Thus, the third embodiment vent valve 356 may be modified or omitted altogether, the third embodiment plug component may be modified or omitted altogether, the third embodiment dispensing valve 354 may be modified or omitted altogether, etc.

With respect to all three embodiments, it will be appreciated that the support base (base 102 in FIG. 13, base 202 in FIG. 48, or base 302 in FIG. 75) is preferably assembled from two separate, main components: the top component (148, 248, and 348) and the base component (154, 254, and 354). This is done for ease of molding. However, the invention contemplates that the support base may be manufactured as a unitary structure into which the container can be releasably mounted.

Further, in all three embodiments, the discharge opening of the container (104, 204, 304) could have another configuration; and/or location, such as an opening in the sidewall of the container near one end of the container. With such a modified container, the receiving aperture of the support base would have to be modified for compatibility.

Figure 86:
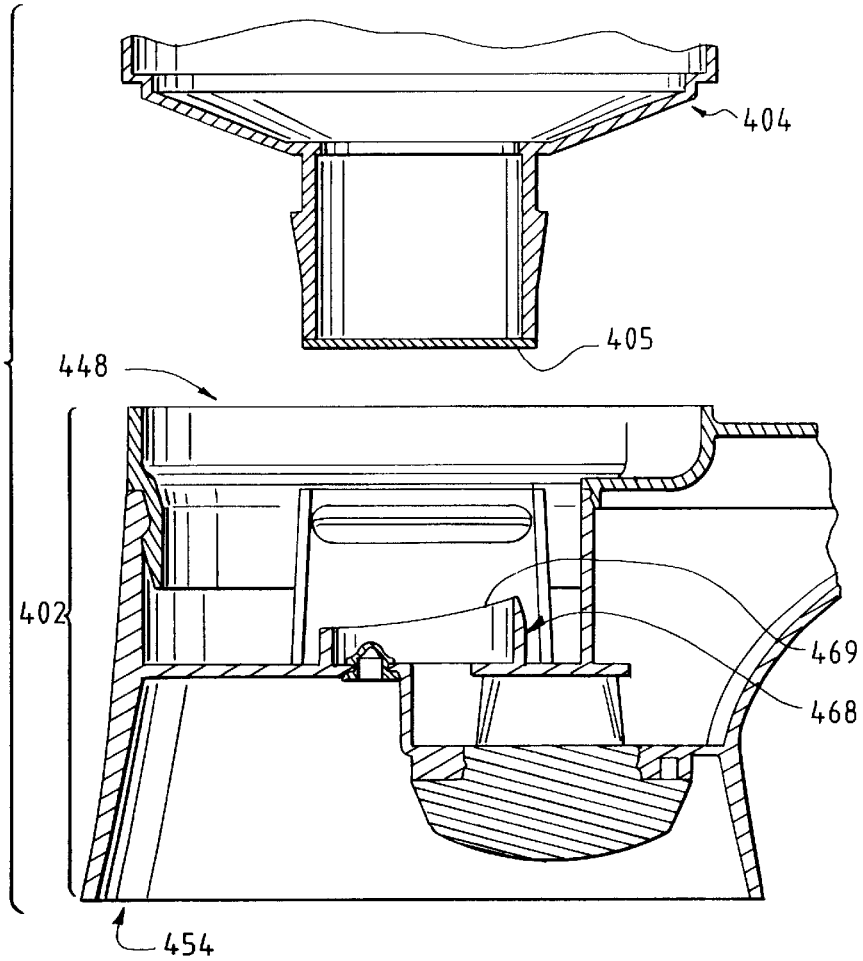
FIG. 86 is a fragmentary, exploded, cross-sectional view of a fourth embodiment of the dispensing system of the present invention showing a support base with a piercing element and showing a container with a pierceable liner prior to mounting the container in the support base.
Figure 87:
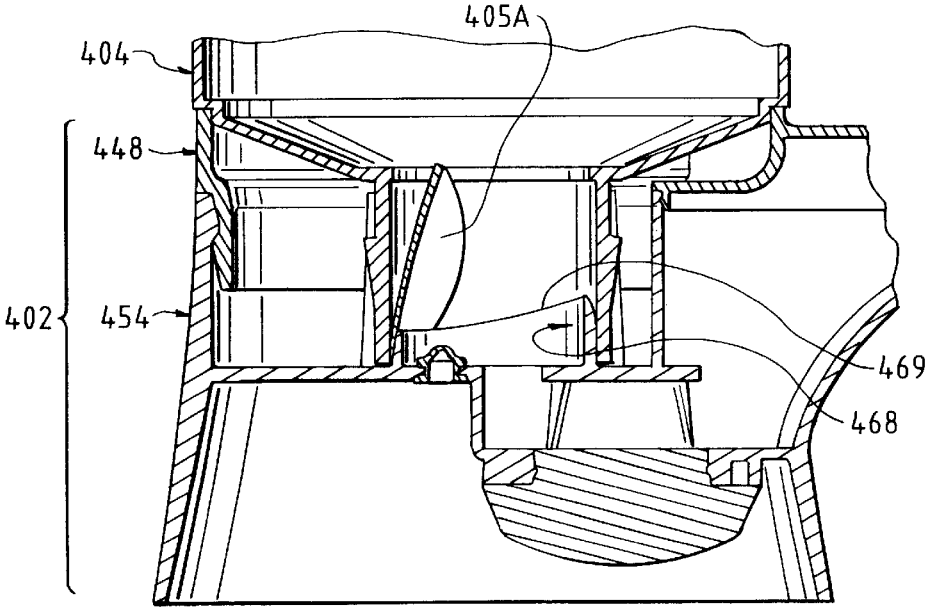
FIG. 87 is a fragmentary, cross-sectional view of the fourth embodiment of the components shown in FIG. 86 after the container has been fully mounted in the support base.

FIGS. 86 and 87 illustrate a fourth embodiment of the dispensing system which is similar to the third embodiment dispensing system described above with reference to FIGS. 63–85. The fourth embodiment includes many features which are identical, similar, or analogous to features of the third embodiment described above with reference to FIGS. 63–85. The elements or features of the third embodiment have been designated with reference numbers in the 300 series. The reference numbers for the fourth embodiment are in the 400 series. The elements of the fourth embodiment which are identical, similar, or functionally analogous to the elements of the third embodiment employ the same last two digits as used for the reference numbers of the third embodiment features.

In the fourth embodiment, a container 404 (FIGS. 86 and 87) is provided for holding a fluent product and has substantially the same configuration as the third embodiment container 304 described above with reference to FIGS. 63–85. However, in the fourth embodiment container 404, there is a pierceable film, liner, membrane, or film liner structure 405 which is initially sealed across the opening of the container 404. The container 404 may also include a closure or overcap (not illustrated) to protect the liner structure 405 against inadvertent puncture prior to use.

As shown in FIGS. 86 and 87, the fourth embodiment dispensing system includes a support base 402 which includes a top component 448 and a base component 454. The top component 448 and base component 454 are substantially similar to the third embodiment top component 348 and third embodiment base component 354, respectively. However, the fourth embodiment base component 454 includes the modified, annular plug seal wall 468 which has a sharp upper edge 469. When the container 404 is initially inverted and mounted in the support base 402 as illustrated in FIG. 87, the sharp edge 469 punctures the liner structure 405. A punctured or torn film portion 405A of the liner structure 405 is forced upwardly and away from the opening of the container 404 so as to permit the flow of the fluent product from the container through the dispensing system.

It will be readily apparent from the foregoing detailed description of the invention and from the illustrations thereof that numerous variations and modifications may be effected without departing from the true spirit and scope of the novel concepts or principles of this invention.

What is claimed is:

1. A dispensing system comprising:

a container that has an opening to the container interior and that is adapted to hold a fluent product; and a support base for releasably supporting said container with said container opening oriented at least somewhat downwardly to accommodate gravity flow of the fluent product out of the container through said container opening, said support base having (1) a receiving aperture for receiving said container opening, (2) a discharge aperture, and (3) a flow path extending between said receiving aperture and said discharge aperture, a shut-off valve which is (a) located in said support base in said flow path between said receiving aperture and said discharge aperture, and (b) manually actuatable between (i) a closed orientation occluding fluent flow through said flow path, and (ii) an open orientation permitting fluent flow through said flow path, said shut-off valve being actuatable at least when said container is not on said support base.

2. The dispensing system in accordance with claim 1 in which said system includes a pressure-openable valve in said container opening.

3. The dispensing system in accordance with claim 2 in which said system includes a fitment engaged with said container at said opening; and said valve is mounted to said fitment.

4. The dispensing system in accordance with claim 1 in which said container has a resiliently flexible wall.

5. The dispensing system in accordance with claim 1 in which said support base includes a top component and a base component mounted together in a snap-fit engagement.

6. The dispensing system in accordance with claim 1 in which said support base includes a laterally projecting spout defining part of said flow path.

7. The dispensing system in accordance with claim 1 in which said support base includes a pressure-openable valve at said discharge aperture.

8. The dispensing system in accordance with claim 1 in which said support base includes a pressure-openable vent valve at said receiving aperture for venting ambient atmosphere into said container opening.

9. The dispensing system in accordance with claim 1 in which said shut-off valve is a plug which (1) has walls defining a flow channel, and (2) is rotatable about 90 degrees between (a) said open orientation wherein said flow channel communicates with said flow path, and (b) said closed orientation wherein at least one of said flow channel walls occludes said flow path.

10. The dispensing system in accordance with claim 1 in which said support base and container each include at least one dividing wall to provide separate flow paths and chambers, respectively, for separate fluent materials.

11. The dispensing system in accordance with claim 1 in which said system further includes a pierceable film liner sealingly secured to said container over said opening to initially occlude said opening; and said support base includes a piercing element at said receiving aperture for piercing said film liner when said container is supported in said support base.

12. A dispensing system comprising:

a container that has an opening to the container interior and that is adapted to hold a fluent product; and a support base for releasably supporting said container with said container opening oriented at least somewhat downwardly to accommodate gravity flow of the fluent product out of the container through said container opening, said support base having (1) a receiving aperture for receiving said container opening, (2) a discharge aperture, and (3) a flow path extending between said receiving aperture and said discharge aperture, and in which said system includes a pressure-openable valve in said container opening;

said system includes a fitment engaged with said container at said opening;

said valve is mounted to said fitment;

said system includes a removable overcap on said container to occlude said opening;

said fitment is engaged with said valve to create an engagement that resists disengagement when said fitment and valve are subjected to oppositely acting tension forces below a first predetermined magnitude; and said fitment is frictionally engaged with said overcap to create an engagement that is released when said overcap and fitment are subjected to oppositely acting tension forces equal to a second predetermined magnitude which is less than said first predetermined magnitude.

13. A dispensing system comprising:

a support base for supporting a container that has an opening to the container interior and that is adapted to hold a fluent product, said support base adapted to support said container with said container opening oriented at least somewhat downwardly to accommodate gravity flow of the fluent product out of the container through said container opening, said support base having (1) a receiving aperture for receiving said container opening, (2) a discharge aperture, and (3) a flow path extending between said receiving aperture and said discharge aperture, a shut-off valve which is (a) located in said support base in said flow path between said receiving aperture and said discharge aperture, and (b) manually actuatable between (i) a closed orientation occluding fluent flow through said flow path, and (ii) an open orientation permitting fluent flow through said flow path, said shut-off valve being actuatable at least when said container is not on said support base.

14. The dispensing system in accordance with claim 13 in which said system further includes said container in combination with said support base wherein said container is mounted in said support base.

15. The dispensing system in accordance with claim 14 in which said support base and container each includes at least one dividing wall to provide separate flow paths and chambers, respectively, for separate fluent materials.

16. The dispensing system in accordance with claim 13 in which said support base includes a pressure-openable valve at said discharge aperture; and said support base includes a pressure-openable vent valve at said receiving aperture for venting ambient atmosphere into said container opening.

17. The dispensing system in accordance with claim 13 in which said shut-off valve is a plug which (1) has walls defining a flow channel, and (2) is rotatable about 90 degrees between (a) said open orientation wherein said flow channel communicates with said flow path, and (b) said closed orientation wherein at least one of said flow channel walls occludes said flow path.

18. A dispensing system comprising a container in combination with a support base wherein said container is mounted in said support base;

said container has an opening to the container interior and that is adapted to hold a fluent product;

said support base is adapted to support said container with said container opening oriented at least somewhat downwardly to accommodate gravity flow of the fluent product out of the container through said container opening;

said support base has (1) a receiving aperture for receiving said container opening, (2) a discharge aperture, and (3) a flow path extending between said receiving aperture and said discharge aperture;

said system includes a fitment engaged with said container at said opening;

a pressure-openable valve is mounted to said fitment;

said system includes a removable overcap on said container to occlude said opening;

said fitment is engaged with said valve to create an engagement that resists disengagement when said fitment and valve are subjected to oppositely acting tension forces below a first predetermined magnitude; and said fitment is frictionally engaged with said overcap to create an engagement that is released when said overcap and fitment are subjected to oppositely acting tension forces equal to a second predetermined magnitude, which is less than said first predetermined magnitude.

19. A dispensing system comprising:

a support base for supporting a container that has an opening to the container interior and that is adapted to hold a fluent product, said support base adapted to support said container with said container opening oriented at least somewhat downwardly to accommodate gravity flow of the fluent product out of the container through said container opening, said support base having (1) a receiving aperture for receiving said container opening, (2) a discharge aperture, (3) a flow path extending between said receiving aperture and said discharge aperture, (4) a base component including a wall defining an aperture communicating with said container receiving aperture, and (5) a pressure-openable vent valve disposed in said base component wall aperture and mounted to said base component wall to vent ambient atmosphere, into said receiving aperture and said container when said container is mounted on said support base.

20. The dispensing system in accordance with claim 19 further including a shut-off valve which is (a) located in said flow path between said receiving aperture and said discharge aperture, and (b) manually actuatable between (i) a closed orientation occluding fluent flow through said flow path, and (ii) an open orientation permitting fluent flow through said flow path.

21. The dispensing system in accordance with claim 19 in which said system further includes said container in combination with said support base wherein said container is mounted in said support base.

22. The dispensing system in accordance with claim 21 in which said support base and container each includes at least one dividing wall to provide separate flow paths and chambers, respectively, for separate fluent materials.

23. The dispensing system in accordance with claim 21 in which said system includes a fitment engaged with said container at said opening;

a pressure-openable discharge valve is mounted to said fitment;

said system includes a removable overcap on said container to occlude said opening;

said fitment is engaged with said pressure openable discharge valve to create an engagement that resists disengagement when said fitment and pressure openable discharge valve are subjected to oppositely acting tension forces below a first predetermined magnitude; and said fitment is frictionally engaged with said overcap to create an engagement that is released when said overcap and fitment are subjected to oppositely acting tension forces equal to a second predetermined magnitude which is less than said first predetermined magnitude.

24. The dispensing system in accordance with claim 19 in which said system further includes a shut-off valve which is (a) located in said flow path between said receiving aperture and said discharge aperture, and (b) manually actuatable between (i) a closed orientation occluding fluent flow through said flow path, and (ii) an open orientation permitting fluent flow through said flow path, and said shut-off valve is a plug which (1) has walls defining a flow channel, and (2) is rotatable about 90 degrees between (a) said open orientation wherein said flow channel communicates with said flow path, and (b) said closed orientation wherein at least one of said flow channel walls occludes said flow path.

* * * * *